US009132624B2

(12) United States Patent
Otake et al.

(10) Patent No.: US 9,132,624 B2
(45) Date of Patent: Sep. 15, 2015

(54) CONTACT PRESSURE ADJUSTING METHOD AND CONTACT PRESSURE ADJUSTING APPARATUS FOR PRINTING PRESS

(75) Inventors: Kenzo Otake, Tsukuba (JP); Norihiro Kumagai, Tsukuba (JP); Hideki Mori, Tsukuba (JP); Hiromitsu Numauchi, Tsukuba (JP); Soichi Nakamura, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 521 days.

(21) Appl. No.: 13/152,951

(22) Filed: Jun. 3, 2011

(65) Prior Publication Data

US 2011/0297028 A1 Dec. 8, 2011

(30) Foreign Application Priority Data

| | | |
|---|---|---|
| Jun. 4, 2010 | (JP) | 2010-128572 |
| Jun. 4, 2010 | (JP) | 2010-128573 |
| Jun. 4, 2010 | (JP) | 2010-128574 |
| Oct. 29, 2010 | (JP) | 2010-243338 |
| Oct. 29, 2010 | (JP) | 2010-243339 |

(51) Int. Cl.

| | |
|---|---|
| ***B41F 1/34*** | (2006.01) |
| ***B41F 9/02*** | (2006.01) |
| ***B41F 9/10*** | (2006.01) |
| ***B41F 33/00*** | (2006.01) |

(52) U.S. Cl.

CPC ..... *B41F 9/028* (2013.01); *B41F 9/1018* (2013.01); *B41F 9/1027* (2013.01); *B41F 9/1036* (2013.01); *B41F 33/0072* (2013.01)

(58) Field of Classification Search

CPC ..... B41F 1/54; B41F 9/1036; B41F 9/1027; B41F 9/028; B41F 9/1018; B41F 33/0072; B41L 41/00; B41L 41/02; B41L 41/06; B41L 41/04; B41P 2235/00; B41P 2235/10; B41P 2235/246; B41P 2235/20; B41P 2235/21; B41P 2235/22

USPC ..... 101/155, 485, 153, 167

See application file for complete search history.

(56) References Cited

U.S. PATENT DOCUMENTS

| | | | | |
|---|---|---|---|---|
| 4,935,683 | A * | 6/1990 | Kobler et al. | 318/603 |
| 5,152,220 | A * | 10/1992 | Lindner et al. | 101/155 |
| 5,218,903 | A * | 6/1993 | MacConnell et al. | 101/148 |
| 5,485,785 | A | 1/1996 | Schneider et al. | |
| 6,095,040 | A * | 8/2000 | Ashikagaya et al. | 101/120 |
| 2005/0072328 | A1 | 4/2005 | Gilliam et al. | |

FOREIGN PATENT DOCUMENTS

| | | |
|---|---|---|
| EP | 0 786 341 A2 | 7/1997 |
| JP | 60-42047 A | 3/1985 |

(Continued)

OTHER PUBLICATIONS

Extended European Search Report dated Oct. 7, 2011.

*Primary Examiner* — Matthew G Marini

(74) *Attorney, Agent, or Firm* — Birch, Stewart, Kolasch & Birch, LLP

(57) ABSTRACT

A contact pressure adjusting method and a contact pressure adjusting apparatus for a printing press, which can adjust a contact pressure automatically and always highly accurately without the influence of mechanical oscillations (disturbance such as noise), are provided. For this purpose, the contact pressure (load) of a wiping roll on an intaglio cylinder is converted into the torque value (electric current value) of a wiping roll drive motor, and given as feedback to a wiping roll contact pressure adjusting motor.

14 Claims, 52 Drawing Sheets

(56) References Cited

FOREIGN PATENT DOCUMENTS

| | | | | |
|---|---|---|---|---|
| JP | 63-268647 | A | | 11/1988 |
| JP | 4-37542 | A | | 2/1992 |
| JP | 9-193337 | A | | 7/1997 |
| JP | 2003-72022 | A | | 3/2003 |
| JP | 2003182882 | A | * | 7/2003 |
| JP | 2005-7628 | A | | 1/2005 |
| JP | 2008-6632 | A | | 1/2008 |

* cited by examiner

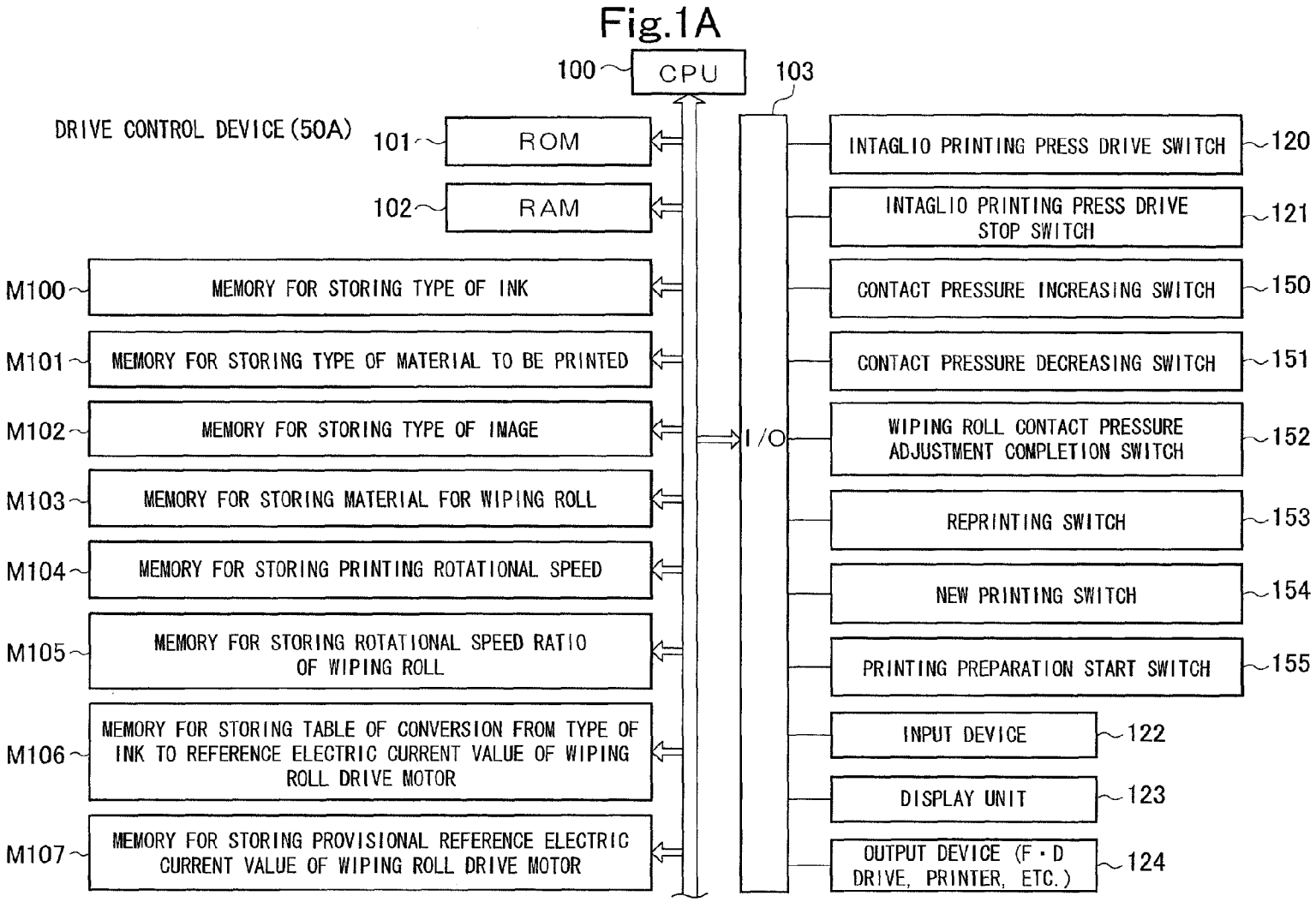
Fig.1A
DRIVE CONTROL DEVICE (50A)
100
CPU
101
ROM
102
RAM
103
I/O
120
INTAGLIO PRINTING PRESS DRIVE SWITCH
121
INTAGLIO PRINTING PRESS DRIVE STOP SWITCH
150
CONTACT PRESSURE INCREASING SWITCH
151
CONTACT PRESSURE DECREASING SWITCH
152
WIPING ROLL CONTACT PRESSURE ADJUSTMENT COMPLETION SWITCH
153
REPRINTING SWITCH
154
NEW PRINTING SWITCH
155
PRINTING PREPARATION START SWITCH
122
INPUT DEVICE
123
DISPLAY UNIT
124
OUTPUT DEVICE (F・D DRIVE, PRINTER, ETC.)
M100
MEMORY FOR STORING TYPE OF INK
M101
MEMORY FOR STORING TYPE OF MATERIAL TO BE PRINTED
M102
MEMORY FOR STORING TYPE OF IMAGE
M103
MEMORY FOR STORING MATERIAL FOR WIPING ROLL
M104
MEMORY FOR STORING PRINTING ROTATIONAL SPEED
M105
MEMORY FOR STORING ROTATIONAL SPEED RATIO OF WIPING ROLL
M106
MEMORY FOR STORING TABLE OF CONVERSION FROM TYPE OF INK TO REFERENCE ELECTRIC CURRENT VALUE OF WIPING ROLL DRIVE MOTOR
M107
MEMORY FOR STORING PROVISIONAL REFERENCE ELECTRIC CURRENT VALUE OF WIPING ROLL DRIVE MOTOR

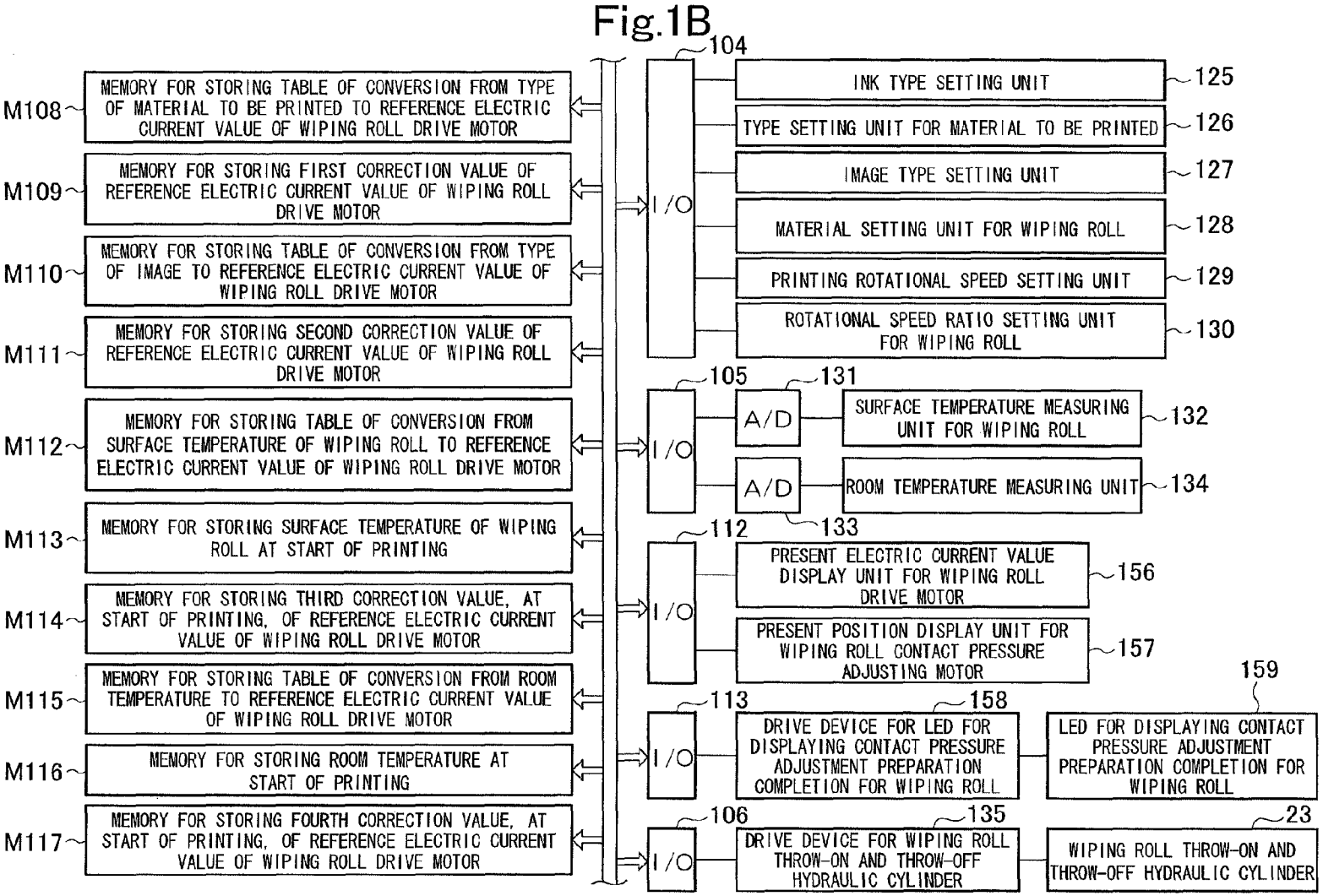
Fig.1B
104
I/O
105
112
113
106
INK TYPE SETTING UNIT
125
TYPE SETTING UNIT FOR MATERIAL TO BE PRINTED
126
IMAGE TYPE SETTING UNIT
127
MATERIAL SETTING UNIT FOR WIPING ROLL
128
PRINTING ROTATIONAL SPEED SETTING UNIT
129
ROTATIONAL SPEED RATIO SETTING UNIT FOR WIPING ROLL
130
A/D
131
SURFACE TEMPERATURE MEASURING UNIT FOR WIPING ROLL
132
A/D
133
ROOM TEMPERATURE MEASURING UNIT
134
PRESENT ELECTRIC CURRENT VALUE DISPLAY UNIT FOR WIPING ROLL DRIVE MOTOR
156
PRESENT POSITION DISPLAY UNIT FOR WIPING ROLL CONTACT PRESSURE ADJUSTING MOTOR
157
DRIVE DEVICE FOR LED FOR DISPLAYING CONTACT PRESSURE ADJUSTMENT PREPARATION COMPLETION FOR WIPING ROLL
158
LED FOR DISPLAYING CONTACT PRESSURE ADJUSTMENT PREPARATION COMPLETION FOR WIPING ROLL
159
DRIVE DEVICE FOR WIPING ROLL THROW-ON AND THROW-OFF HYDRAULIC CYLINDER
135
WIPING ROLL THROW-ON AND THROW-OFF HYDRAULIC CYLINDER
23
M108
MEMORY FOR STORING TABLE OF CONVERSION FROM TYPE OF MATERIAL TO BE PRINTED TO REFERENCE ELECTRIC CURRENT VALUE OF WIPING ROLL DRIVE MOTOR
M109
MEMORY FOR STORING FIRST CORRECTION VALUE OF REFERENCE ELECTRIC CURRENT VALUE OF WIPING ROLL DRIVE MOTOR
M110
MEMORY FOR STORING TABLE OF CONVERSION FROM TYPE OF IMAGE TO REFERENCE ELECTRIC CURRENT VALUE OF WIPING ROLL DRIVE MOTOR
M111
MEMORY FOR STORING SECOND CORRECTION VALUE OF REFERENCE ELECTRIC CURRENT VALUE OF WIPING ROLL DRIVE MOTOR
M112
MEMORY FOR STORING TABLE OF CONVERSION FROM SURFACE TEMPERATURE OF WIPING ROLL TO REFERENCE ELECTRIC CURRENT VALUE OF WIPING ROLL DRIVE MOTOR
M113
MEMORY FOR STORING SURFACE TEMPERATURE OF WIPING ROLL AT START OF PRINTING
M114
MEMORY FOR STORING THIRD CORRECTION VALUE, AT START OF PRINTING, OF REFERENCE ELECTRIC CURRENT VALUE OF WIPING ROLL DRIVE MOTOR
M115
MEMORY FOR STORING TABLE OF CONVERSION FROM ROOM TEMPERATURE TO REFERENCE ELECTRIC CURRENT VALUE OF WIPING ROLL DRIVE MOTOR
M116
MEMORY FOR STORING ROOM TEMPERATURE AT START OF PRINTING
M117
MEMORY FOR STORING FOURTH CORRECTION VALUE, AT START OF PRINTING, OF REFERENCE ELECTRIC CURRENT VALUE OF WIPING ROLL DRIVE MOTOR

CONTACT PRESSURE ADJUSTING METHOD AND CONTACT PRESSURE ADJUSTING APPARATUS FOR PRINTING PRESS

TECHNICAL FIELD

The present invention relates to a contact pressure adjusting method and a contact pressure adjusting apparatus for a printing press such as an intaglio printing press.

BACKGROUND ART

A wiping device of an intaglio printing press, for example, presses a wiping roll against an intaglio mounted on an intaglio cylinder to generate a nip, and rotates the wiping roll in a direction opposite to the direction of the intaglio cylinder, thereby scraping off excess ink in non-image areas on the intaglio. Since the surface of the wiping roll is composed of resin or rubber, however, it wears out upon use, or swells because of heat during use.

As disclosed in Patent Document 1, therefore, it has been common practice to drive the wiping roll independently by a dedicated motor, interpose a magnetostriction sensor (torque sensor) in its rotational drive system via a coupling, and control a contact pressure adjusting motor, which adjusts the contact pressure of the wiping roll on the intaglio cylinder, in accordance with the output of the magnetostriction sensor. By so doing, control has been exercised to render the contact pressure of the wiping roll on the intaglio cylinder always constant.

CITATION LIST

Patent Literature

[Patent Document 1] JP-A-9-193337

SUMMARY OF INVENTION

Technical Problem

However, the magnetostriction sensor is designed to detect the mechanical strain of the rotational drive system, and thus undergoes the influence of mechanical oscillations at the time of the following switching: During printing, a state where the surface of the intaglio cylinder and the surface of an impression cylinder are opposed in contact and printing pressure is exerted is switched to a state where gap portions of the respective cylinders are opposed and no printing pressure is exerted. The magnetostriction sensor is also under the influence of mechanical oscillations at the time of switching from the latter state to the former state. That is, the magnetostriction sensor detects disturbance such as noise, too. Hence, the first problem has been posed that the magnetostriction sensor cannot stably detect changes over time in the wiping roll.

The magnetostriction sensor is provided between a speed reducer connected to a wiping roll independent drive motor and a drive shaft of the wiping roll. This has posed the second problem that the magnetostriction sensor is directly influenced by the above mechanical oscillations.

Whenever an operator starts to implement a new printing specification (job), such as the type of ink or the type of a pattern or image, the operator visually confirms the intaglio while doing printing, and adjusts the contact pressure of the wiping roll. Thus, the third problem has occurred that the operator is burdened, and printing materials such as paper and ink are wasted.

It is an object of the present invention, therefore, to solve the above-mentioned first problem by controlling the contact pressure adjusting motor for adjusting a contact pressure, at which the wiping roll is pressed against the intaglio cylinder, in accordance with the driving torque of the wiping roll independent drive motor, thereby making the contact pressure adjustable with high accuracy.

It is another object of the present invention to solve the above-mentioned second problem by interposing the speed reducer between the wiping roll independent drive motor and the drive shaft of the wiping roll, thereby enabling only long-term load variations to be detected stably.

It is still another object of the present invention to solve the above-mentioned third problem by storing the contact pressure of the wiping roll after an adjustment is made in accordance with the printing specification, such as the type of ink or the type of image and, when printing is to be performed again with the same printing specification, reading or loading the stored contact pressure of the wiping roll and setting it.

Solution to Problem

An aspect of the present invention for solving the above problems is a contact pressure adjusting method for a printing press, which includes providing a first rotating body, a second rotating body opposed to and making contact with the first rotating body, a second rotating body drive motor for rotationally driving the second rotating body, a contact pressure adjusting mechanism for adjusting a contact pressure of the second rotating body on the first rotating body, and a contact pressure adjusting motor for driving the contact pressure adjusting mechanism, the contact pressure adjusting method comprising:

driving the contact pressure adjusting motor in accordance with a torque value for driving the second rotating body drive motor.

The contact pressure adjusting method for a printing press may further comprise providing first storage means for storing a reference torque value for driving the second rotating body drive motor, second storage means for storing a torque value for driving the second rotating body drive motor, third storage means for storing tolerance for the torque value for driving the second rotating body drive motor, and fourth storage means for storing a drive amount for driving the contact pressure adjusting motor, and driving the contact pressure adjusting motor by the drive amount stored in the fourth storage means when a difference between the reference torque value stored in the first storage means and the torque value stored in the second storage means exceeds the tolerance for the torque value stored in the third storage means.

A speed reducer may be interposed in a drive system between the second rotating body drive motor and the second rotating body.

The first rotating body may be an intaglio cylinder on which an intaglio is mounted, the second rotating body may be a wiping roll for scraping off excess ink of the intaglio mounted on the intaglio cylinder, and the printing press may be an intaglio printing press.

The first rotating body may be an intaglio cylinder having an intaglio supported thereon, the second rotating body may be a wiping roll opposed to and making contact with the intaglio and supported rotatably, the second rotating body drive motor may be a wiping roll drive motor for rotationally driving the wiping roll, and the contact pressure adjusting mechanism may adjust a contact pressure of the wiping roll on the intaglio, and the contact pressure adjusting method may further comprise providing a setting unit for setting a printing specification, storing a position of the contact pressure adjusting motor together with the printing specification set by the setting unit, and when a printing specification identical with the printing specification is then set by the setting unit, loading the position of the contact pressure adjusting motor stored together with the set printing specification, and controlling the contact pressure adjusting motor so as to be located at the loaded position.

The first rotating body may be an intaglio cylinder having an intaglio supported thereon, the second rotating body may be a wiping roll opposed to and making contact with the intaglio and supported rotatably, the second rotating body drive motor may be a wiping roll drive motor for rotationally driving the wiping roll, and the contact pressure adjusting mechanism may adjust a contact pressure of the wiping roll on the intaglio, and the contact pressure adjusting method may further comprise setting printing conditions, determining a reference load of the wiping roll drive motor in accordance with the set printing conditions, and during printing, driving the contact pressure adjusting motor so that a load of the wiping roll drive motor equals the reference load.

The first rotating body may be an intaglio cylinder having an intaglio supported thereon, the second rotating body may be a wiping roll opposed to and making contact with the intaglio and supported rotatably, the second rotating body drive motor may be a wiping roll drive motor for rotationally driving the wiping roll, and the contact pressure adjusting mechanism may adjust a contact pressure of the wiping roll on the intaglio, and the contact pressure adjusting method may further comprise detecting a surface temperature of the wiping roll, correcting a reference load of the wiping roll drive motor in accordance with the detected surface temperature of the wiping roll, and driving the contact pressure adjusting motor so that a load of the wiping roll drive motor equals the corrected reference load.

Another aspect of the present invention for solving the above problems is a contact pressure adjusting apparatus for a printing press, which includes a first rotating body, a second rotating body opposed to and making contact with the first rotating body, a second rotating body drive motor for rotationally driving the second rotating body, a contact pressure adjusting mechanism for adjusting a contact pressure of the second rotating body on the first rotating body, and a contact pressure adjusting motor for driving the contact pressure adjusting mechanism, the contact pressure adjusting apparatus comprising:

a control device for driving the contact pressure adjusting motor in accordance with a torque value for driving the second rotating body drive motor.

The contact pressure adjusting apparatus for a printing press may further comprise first storage means for storing a reference torque value for driving the second rotating body drive motor, second storage means for storing a torque value for driving the second rotating body drive motor, third storage means for storing tolerance for the torque value for driving the second rotating body drive motor, and fourth storage means for storing a drive amount for driving the contact pressure adjusting motor, and the control device may drive the contact pressure adjusting motor by the drive amount stored in the fourth storage means when a difference between the reference torque value stored in the first storage means and the torque value stored in the second storage means exceeds the tolerance for the torque value stored in the third storage means.

In the contact pressure adjusting apparatus for a printing press, a speed reducer may be interposed in a drive system between the second rotating body drive motor and the second rotating body.

In the contact pressure adjusting apparatus for a printing press, the first rotating body may be an intaglio cylinder on which an intaglio is mounted, the second rotating body may be a wiping roll for scraping off excess ink of the intaglio mounted on the intaglio cylinder, and the printing press may be an intaglio printing press.

In the contact pressure adjusting apparatus for a printing press, the first rotating body may be an intaglio cylinder having an intaglio supported thereon, the second rotating body may be a wiping roll opposed to and making contact with the intaglio and supported rotatably, the second rotating body drive motor may be a wiping roll drive motor for rotationally driving the wiping roll, and the contact pressure adjusting mechanism may adjust a contact pressure of the wiping roll on the intaglio, the contact pressure adjusting apparatus may further comprise a setting unit for setting a printing specification, and the control device may store a position of the contact pressure adjusting motor together with the printing specification set by the setting unit and, when a printing specification identical with the printing specification is than set by the setting unit, may load the position of the contact pressure adjusting motor stored together with the set printing specification, and may control the contact pressure adjusting motor so as to be located at the loaded position.

In the contact pressure adjusting apparatus for a printing press, the first rotating body may be an intaglio cylinder having an intaglio supported thereon, the second rotating body may be a wiping roll opposed to and making contact with the intaglio and supported rotatably, the second rotating body drive motor may be a wiping roll drive motor for rotationally driving the wiping roll, and the contact pressure adjusting mechanism may adjust a contact pressure of the wiping roll on the intaglio, the contact pressure adjusting apparatus may further comprise a setting unit for setting printing conditions, and the control device may determine a reference load of the wiping roll drive motor in accordance with the printing conditions set by the setting unit and, during printing, may drivingly control the contact pressure adjusting motor so that a load of the wiping roll drive motor equals the reference load.

In the contact pressure adjusting apparatus for a printing press, the first rotating body may be an intaglio cylinder having an intaglio supported thereon, the second rotating body may be a wiping roll opposed to and making contact with the intaglio and supported rotatably, the second rotating body drive motor may be a wiping roll drive motor for rotationally driving the wiping roll, and the contact pressure adjusting mechanism may adjust a contact pressure of the wiping roll on the intaglio, the contact pressure adjusting apparatus may further comprise detection means for detecting a surface temperature of the wiping roll, and the control device may correct a reference load of the wiping roll drive motor in accordance with the surface temperature of the wiping roll detected by the detection means, and may drivingly control the contact pressure adjusting motor so that a load of the wiping roll drive motor equals the corrected reference load.

Advantageous Effects of Invention

According to the contact pressure adjusting method and apparatus concerned with the present invention described above, the contact pressure (load) of the second rotating body on the first rotating body is converted into the torque value (electric current value) of the second rotating body drive motor, and is given as feedback to the contact pressure adjusting motor. Thus, the contact pressure can be adjusted automatically and always with high accuracy, without being influenced by mechanical oscillations (disturbances such as noise).

Moreover, the speed reducer is interposed in the drive system between the second rotating body drive motor and the second rotating body. Thus, mechanical oscillations (load variations) can be absorbed by the backlash within the speed reducer. The worm gear mechanism, in particular, minimally transmits mechanical oscillations (load variations) from the second rotating body toward the wiping roll drive motor side. Hence, only long-term load variations can be effectively detected even more stably.

When printing is performed again under the same printing specification, the contact pressure of the wiping roll prestored in conformity therewith is loaded and set. Thus, the burden imposed on the operator when making preparations for printing is lessened, and a waste of printing materials such as paper and ink is reduced.

BRIEF DESCRIPTION OF DRAWINGS

FIG. 1A is a hardware block diagram of a drive control device for a wiping roll drive motor and a wiping roll contact pressure adjusting motor in Embodiment 1 of the present invention.

FIG. 1B is a hardware block diagram of the drive control device for the wiping roll drive motor and the wiping roll contact pressure adjusting motor in Embodiment 1 of the present invention.

DESCRIPTION OF EMBODIMENTS

Hereinafter, a contact pressure adjusting method and a contact pressure adjusting apparatus for a printing press according to the present invention will be described in detail by embodiments with reference to the accompanying drawings.

EMBODIMENT 1

Figure 1C:
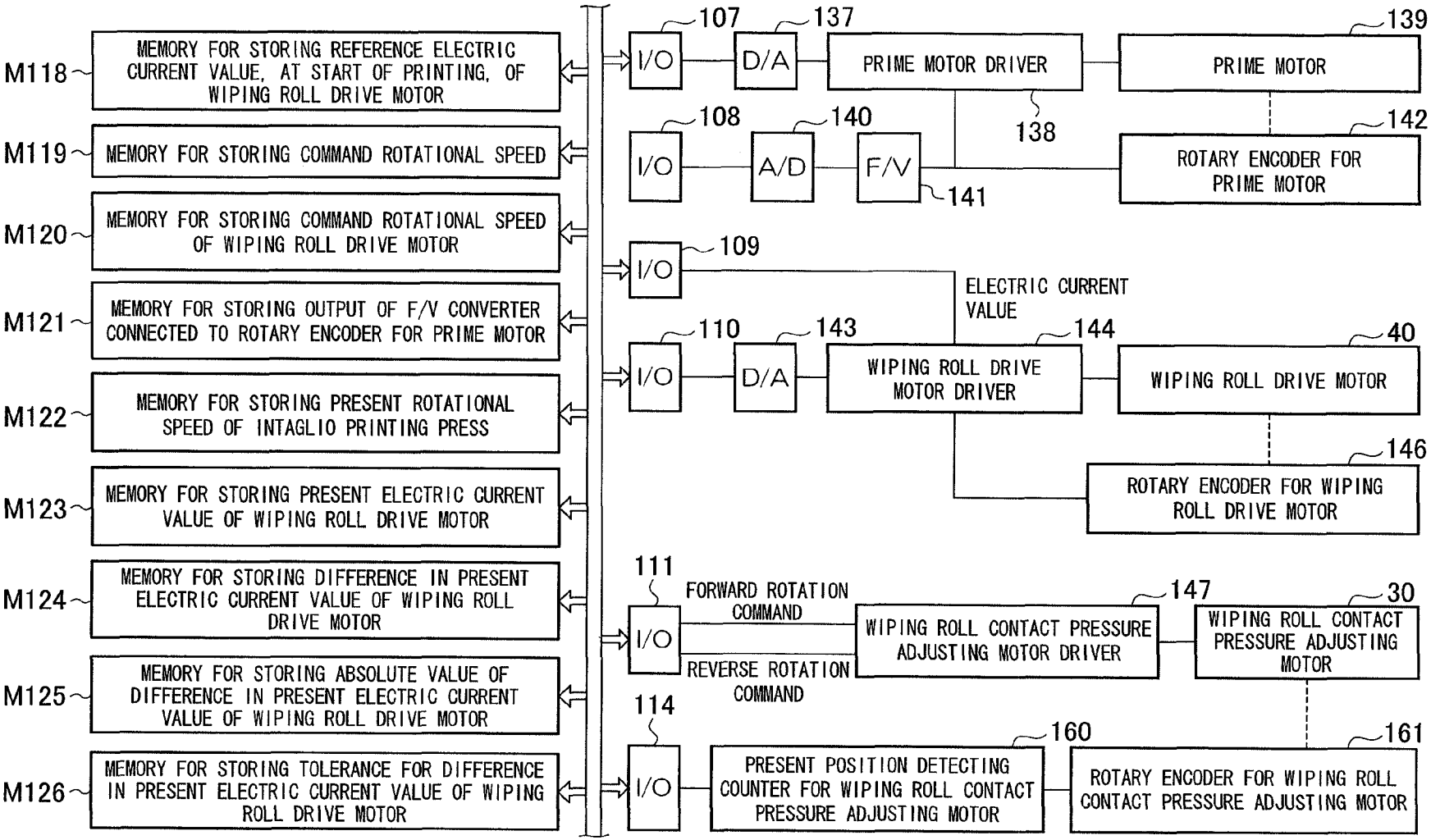
FIG. 1C is a hardware block diagram of the drive control device for the wiping roll drive motor and the wiping roll contact pressure adjusting motor in Embodiment 1 of the present invention.
Figure 1D:
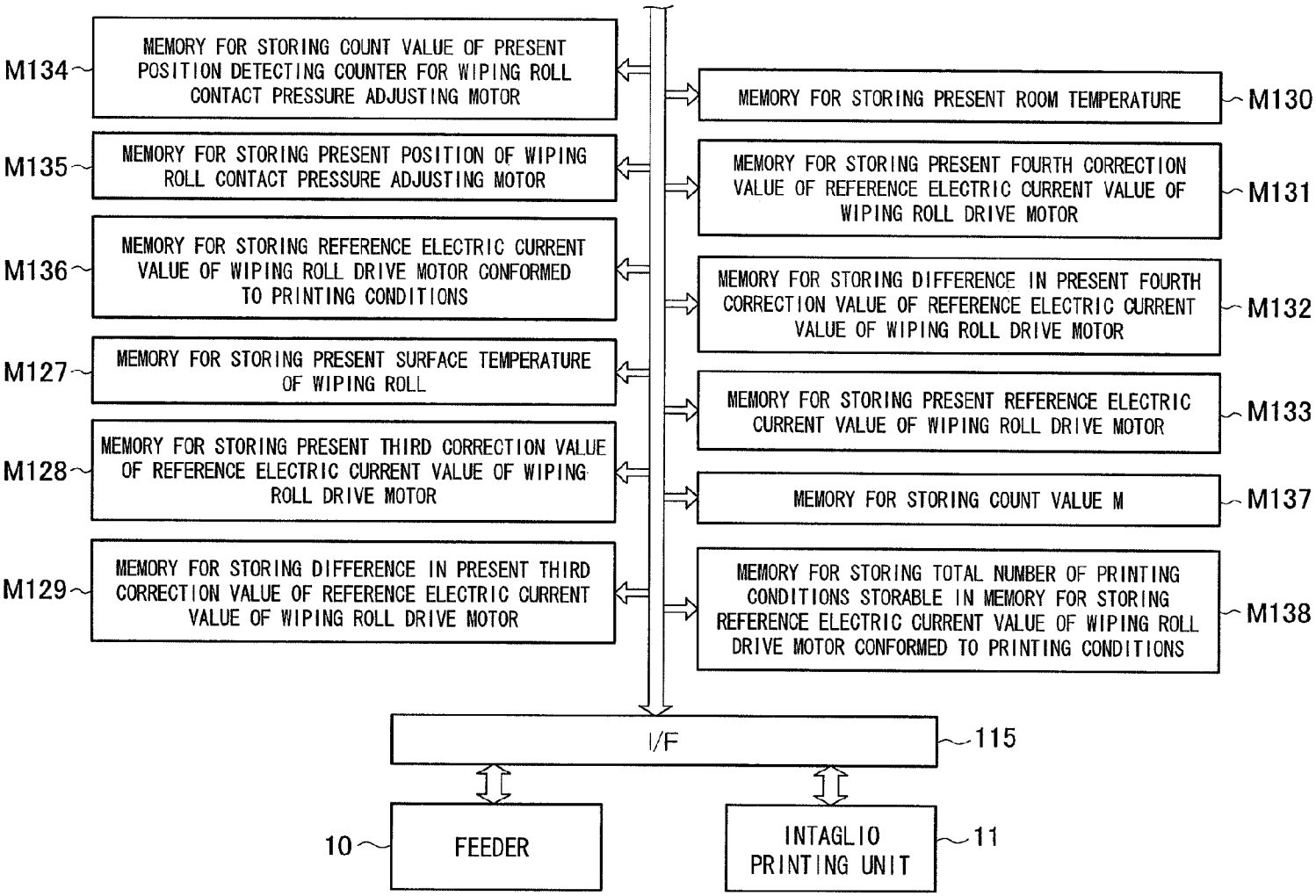
FIG. 1D is a hardware block diagram of the drive control device for the wiping roll drive motor and the wiping roll contact pressure adjusting motor in Embodiment 1 of the present invention.
Figure 2A:
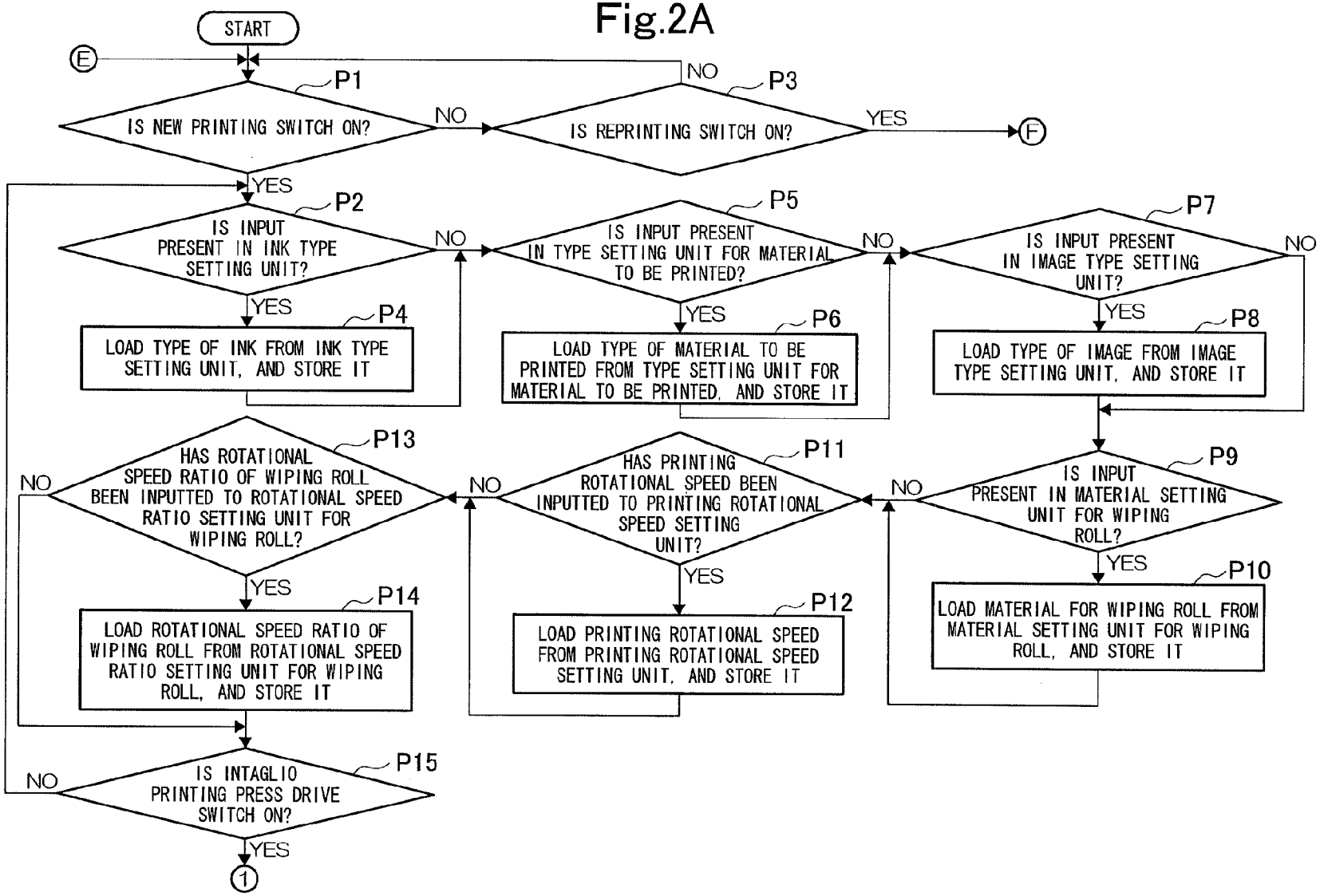
FIG. 2A is an operational or action flow chart of the drive control device for the wiping roll drive motor and the wiping roll contact pressure adjusting motor in Embodiment 1 of the present invention.
Figure 2B:
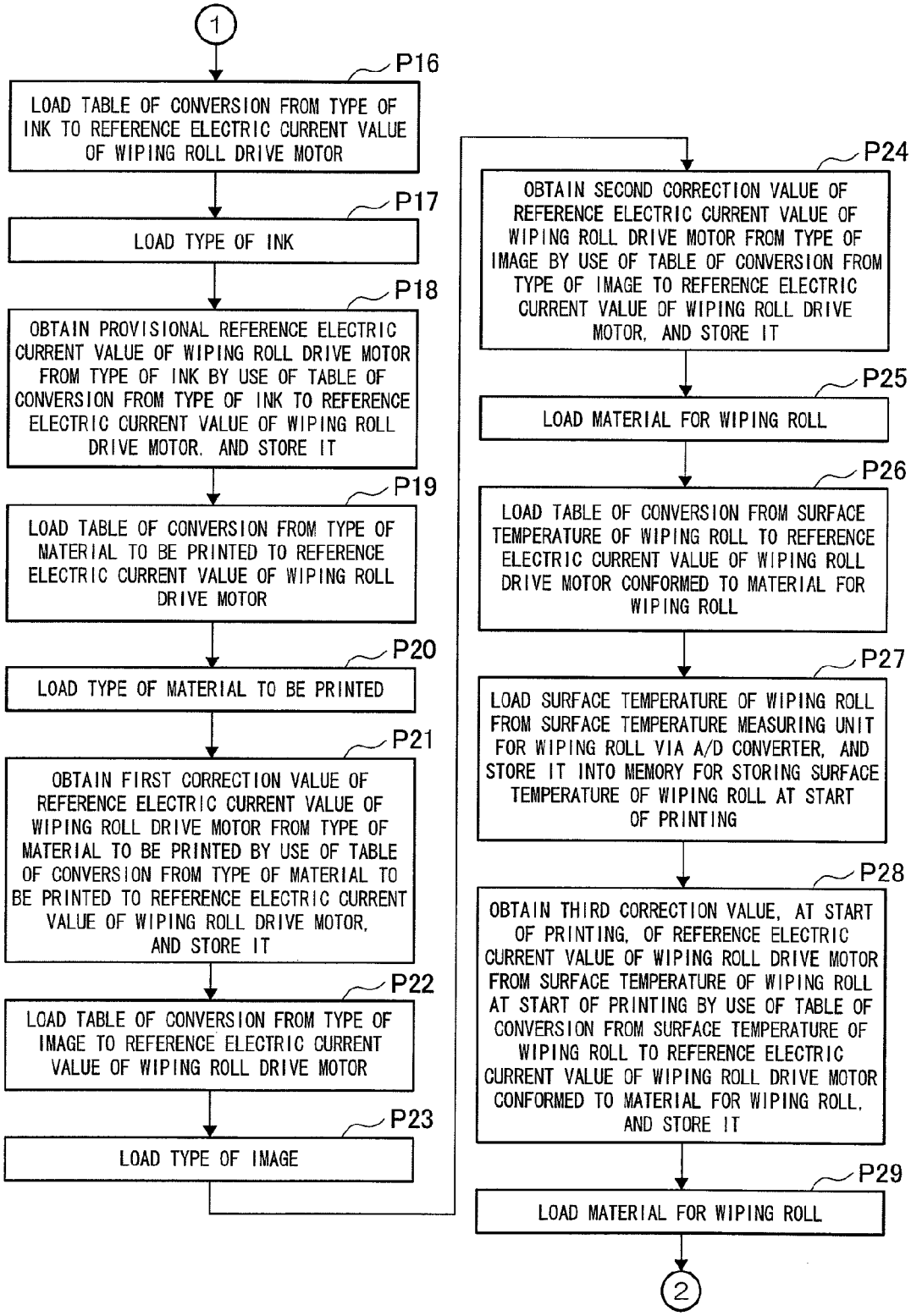
FIG. 2B is an action flow chart of the drive control device for the wiping roll drive motor and the wiping roll contact pressure adjusting motor in Embodiment 1 of the present invention.
Figure 2C:
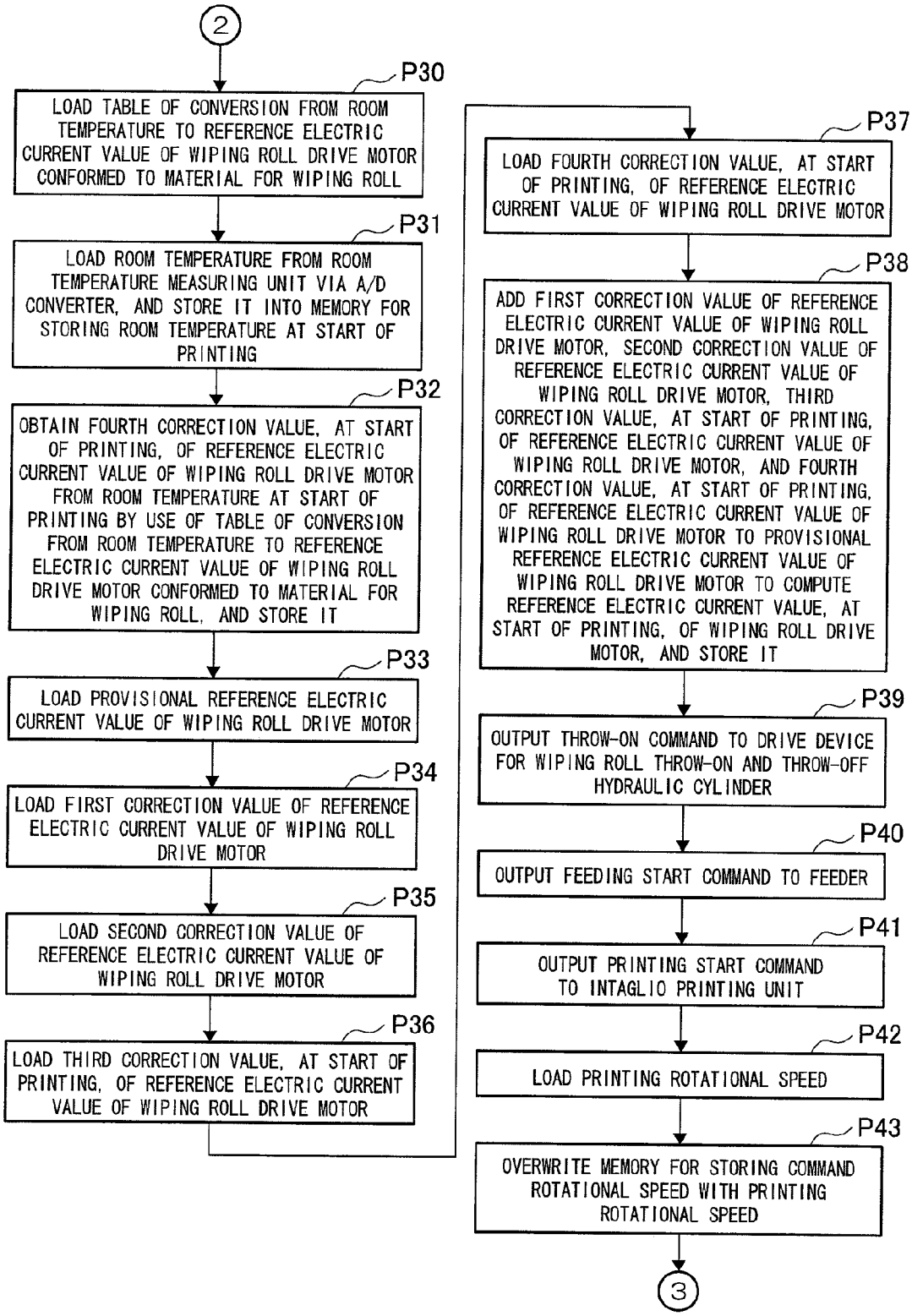
FIG. 2C is an action flow chart of the drive control device for the wiping roll drive motor and the wiping roll contact pressure adjusting motor in Embodiment 1 of the present invention.
Figure 2D:
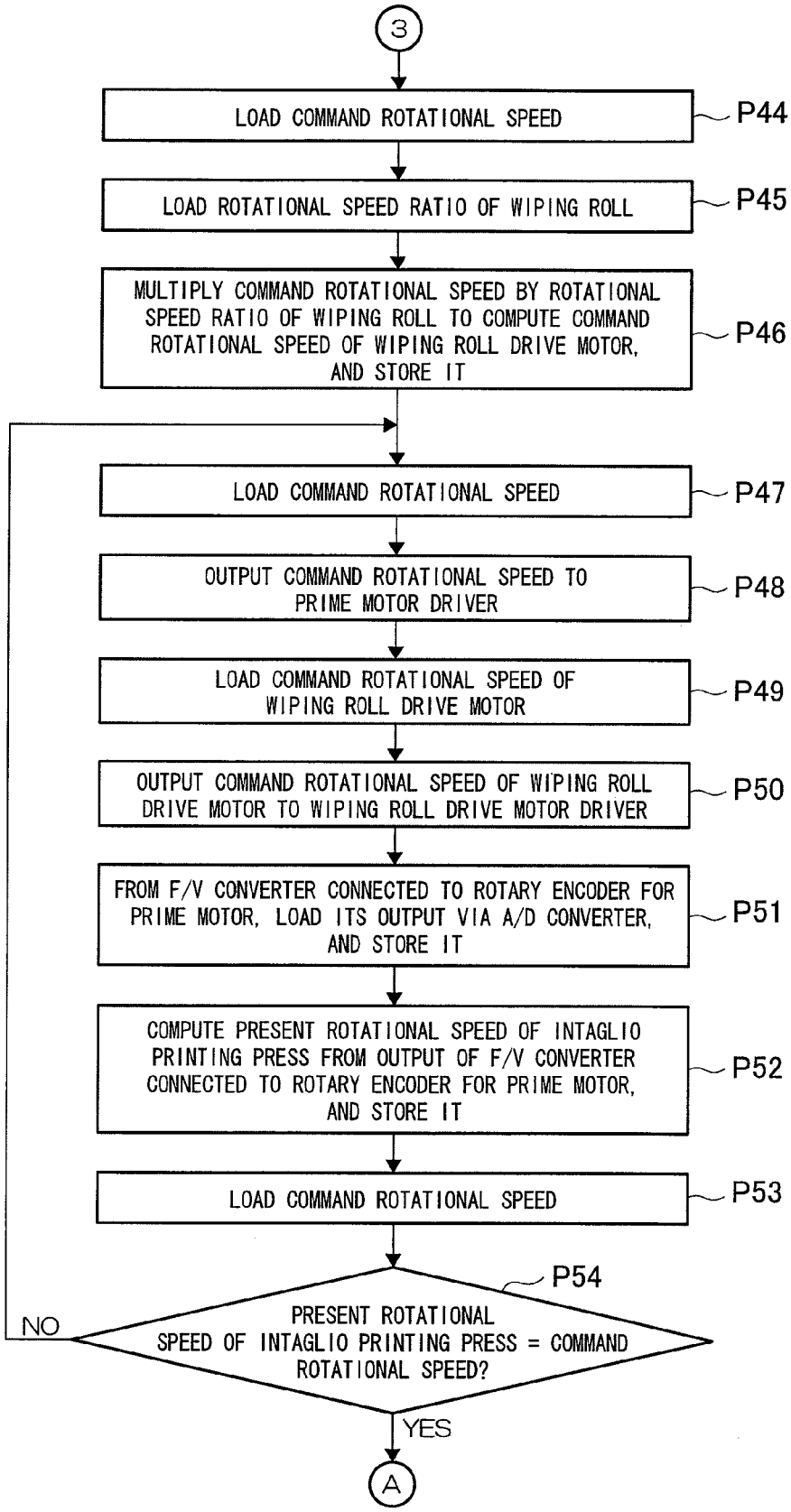
FIG. 2D is an action flow chart of the drive control device for the wiping roll drive motor and the wiping roll contact pressure adjusting motor in Embodiment 1 of the present invention.
Figure 3A:
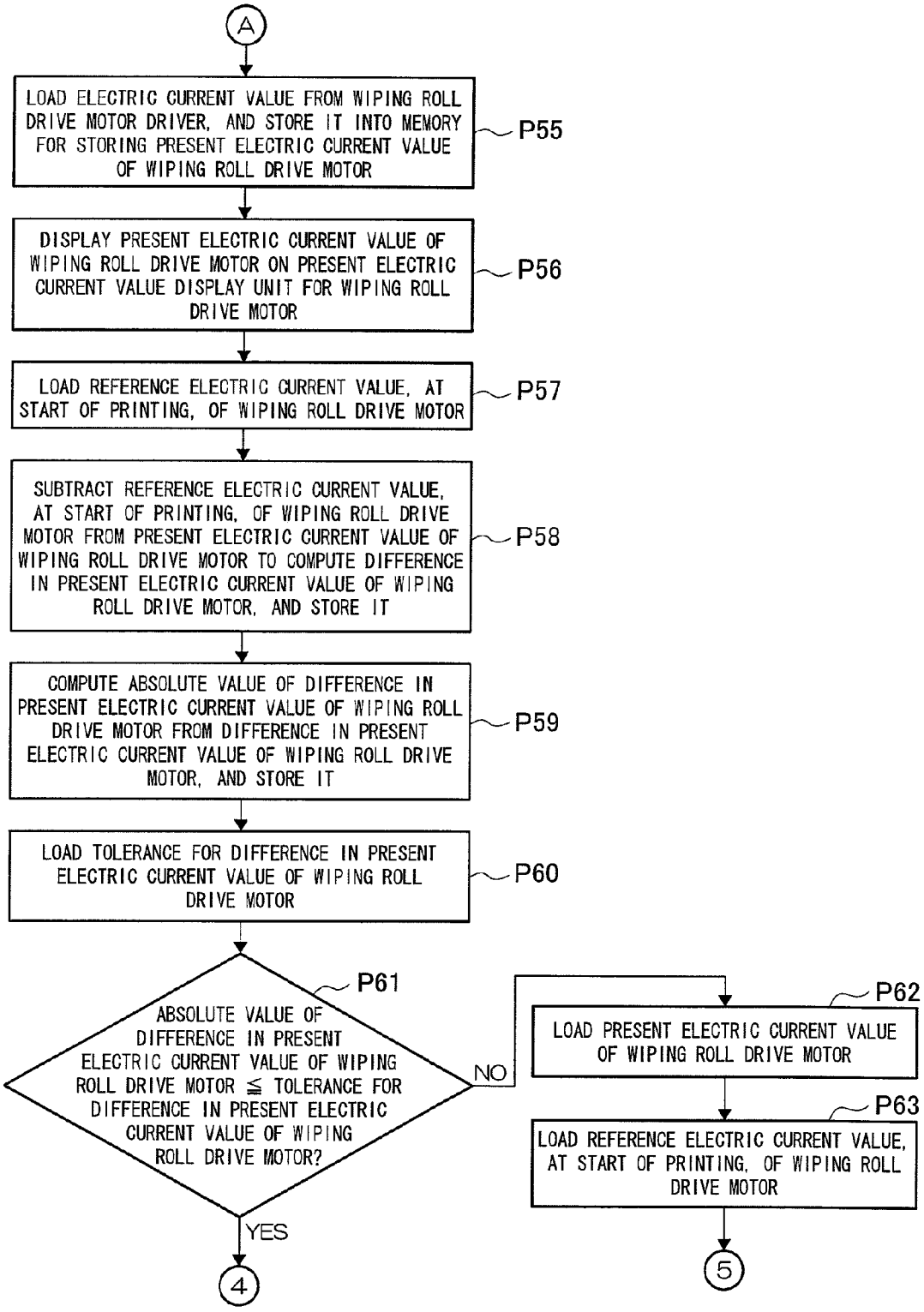
FIG. 3A is an action flow chart of the drive control device for the wiping roll drive motor and the wiping roll contact pressure adjusting motor in Embodiment 1 of the present invention.
Figure 3B:
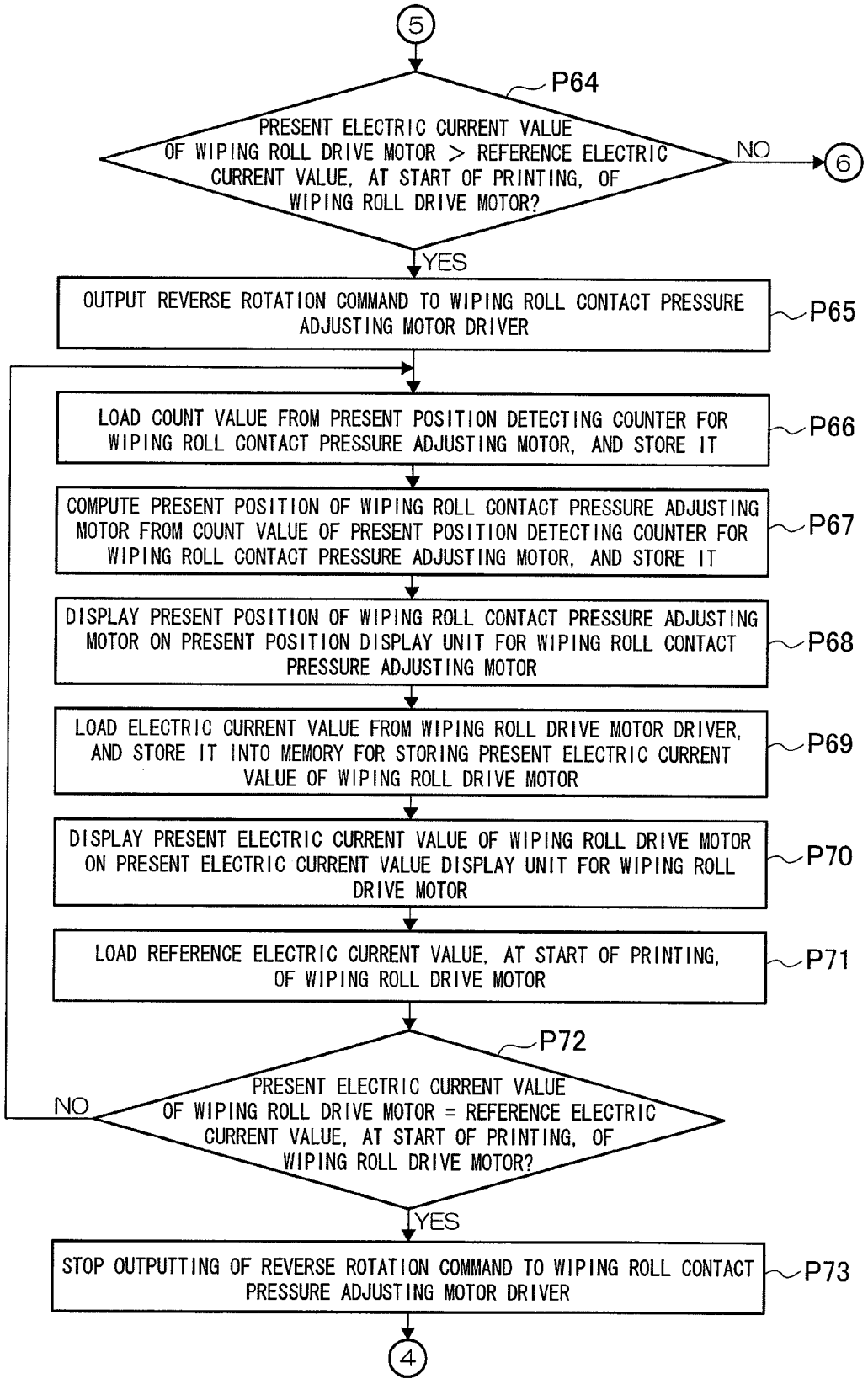
FIG. 3B is an action flow chart of the drive control device for the wiping roll drive motor and the wiping roll contact pressure adjusting motor in Embodiment 1 of the present invention.
Figure 3C:
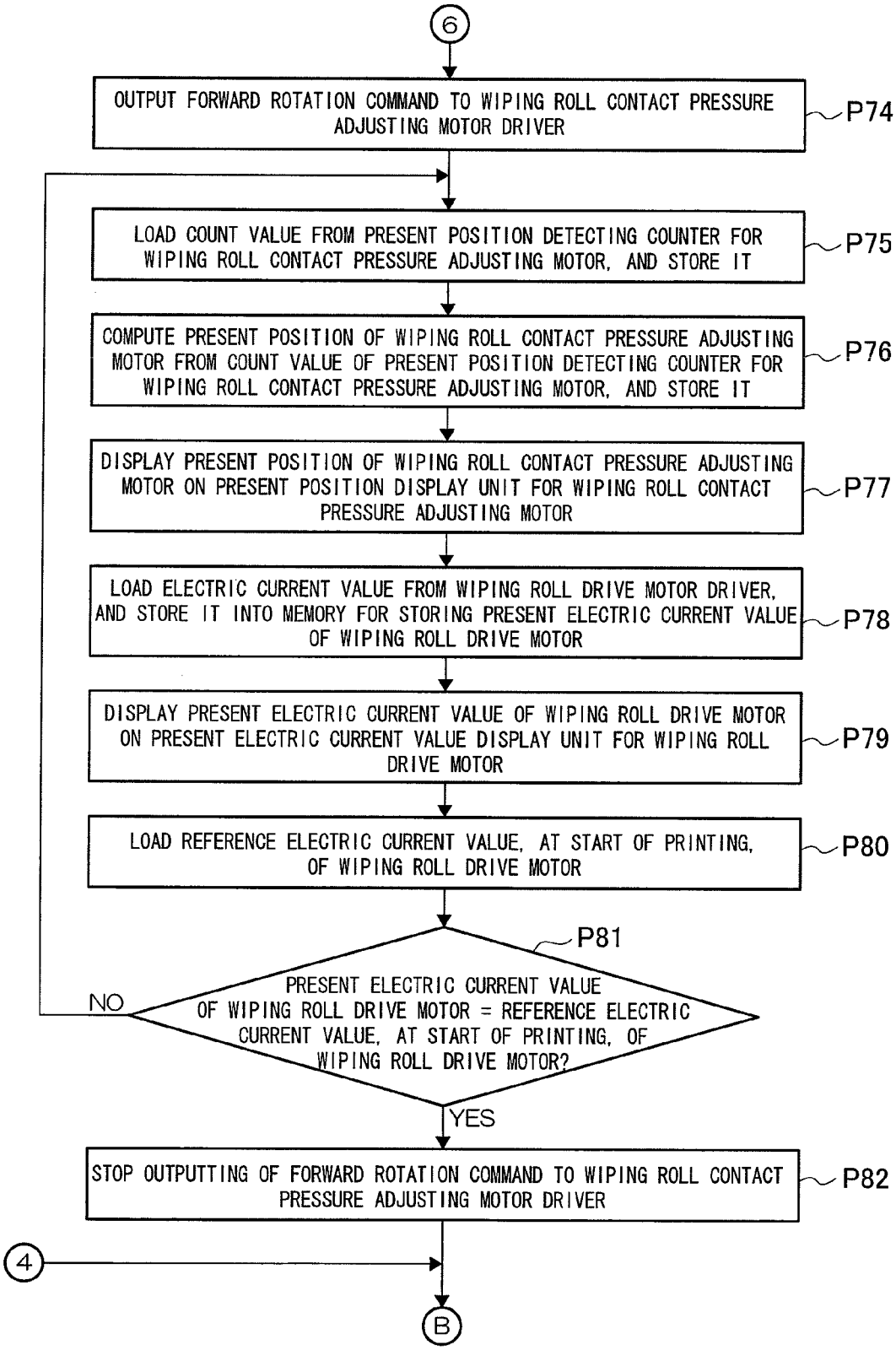
FIG. 3C is an action flow chart of the drive control device for the wiping roll drive motor and the wiping roll contact pressure adjusting motor in Embodiment 1 of the present invention.
Figure 4A:
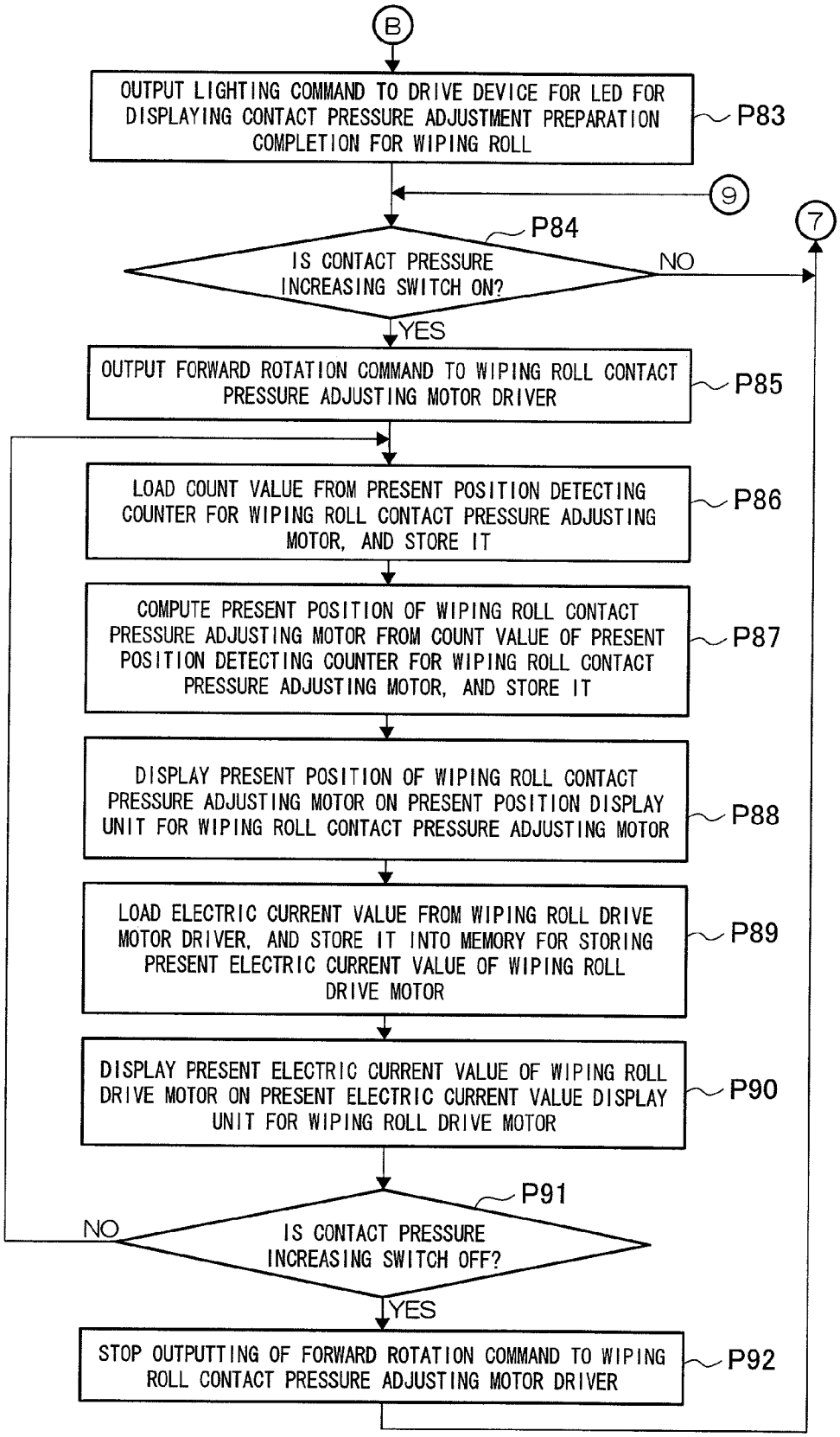
FIG. 4A is an action flow chart of the drive control device for the wiping roll drive motor and the wiping roll contact pressure adjusting motor in Embodiment 1 of the present invention.
Figure 4B:
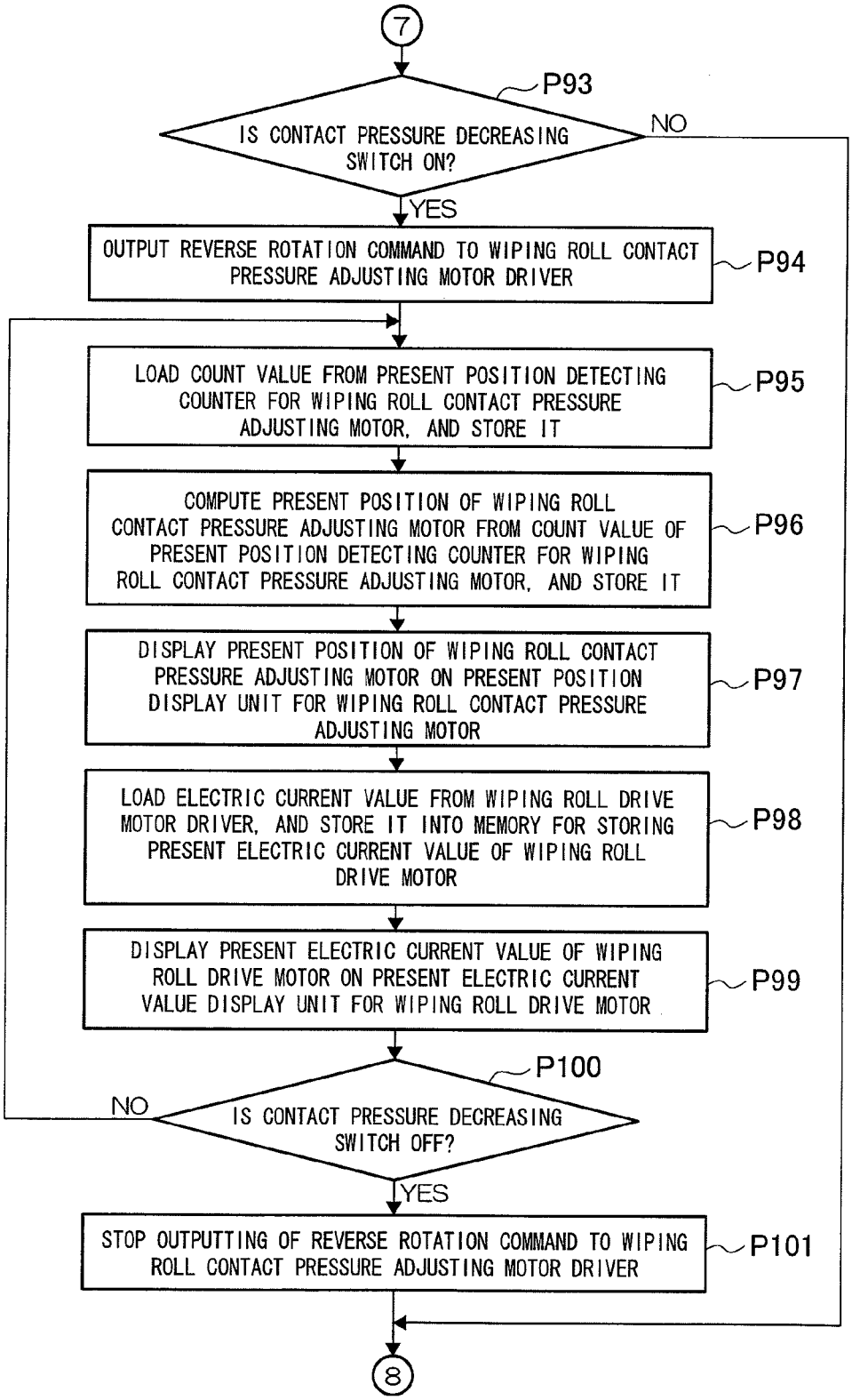
FIG. 4B is an action flow chart of the drive control device for the wiping roll drive motor and the wiping roll contact pressure adjusting motor in Embodiment 1 of the present invention.
Figure 4C:
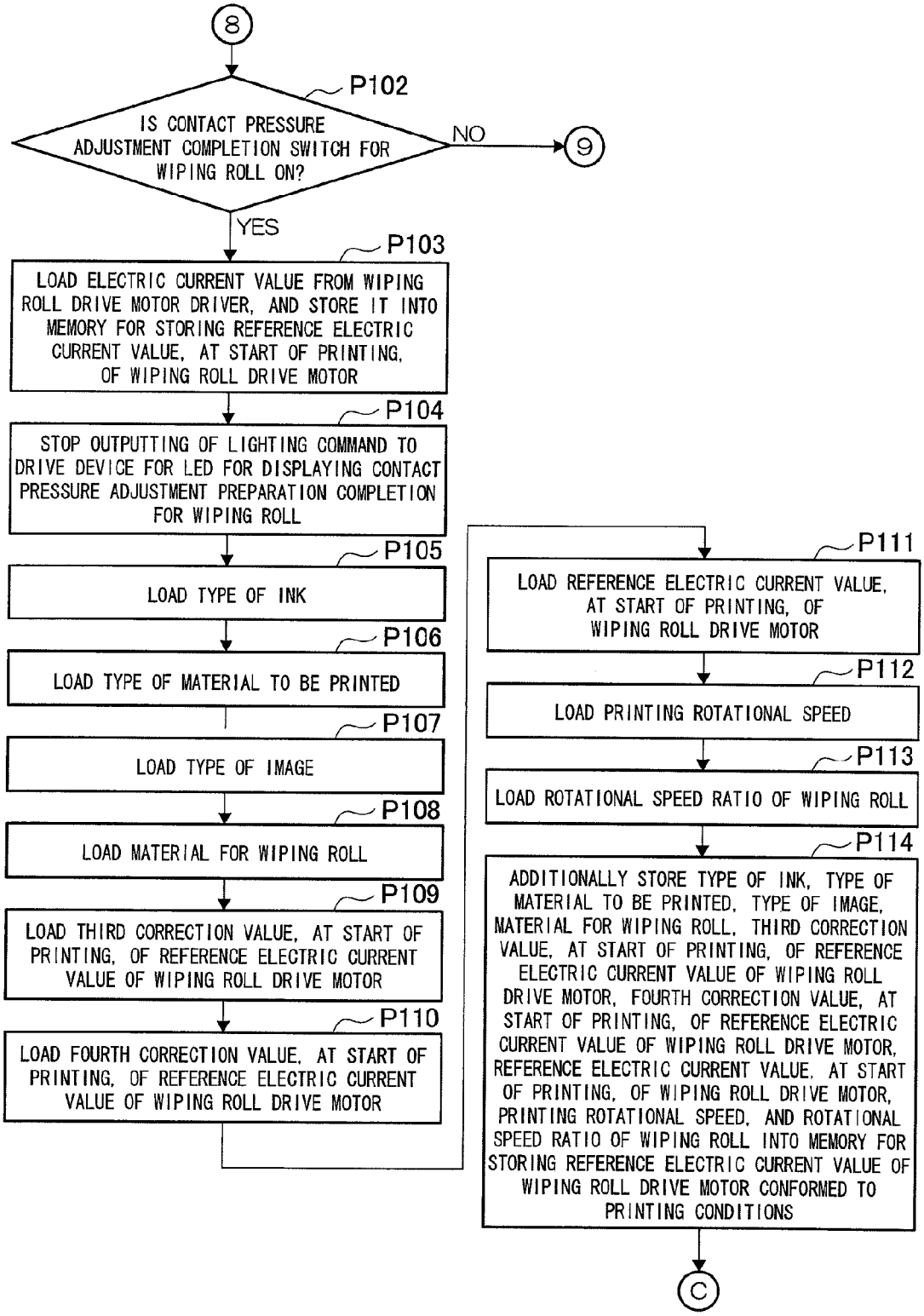
FIG. 4C is an action flow chart of the drive control device for the wiping roll drive motor and the wiping roll contact pressure adjusting motor in Embodiment 1 of the present invention.
Figure 5A:
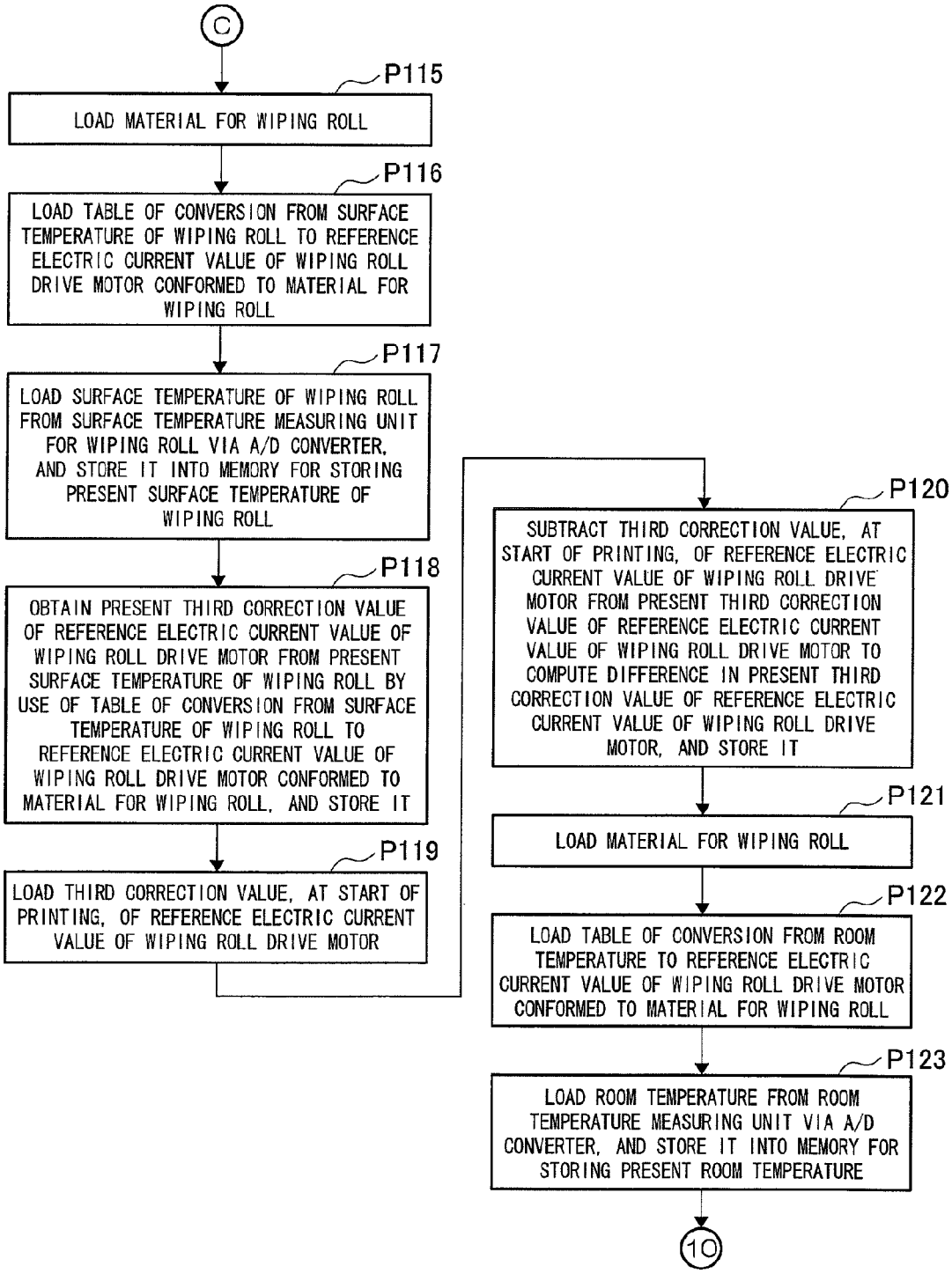
FIG. 5A is an action flow chart of the drive control device for the wiping roll drive motor and the wiping roll contact pressure adjusting motor in Embodiment 1 of the present invention.
Figure 5B:
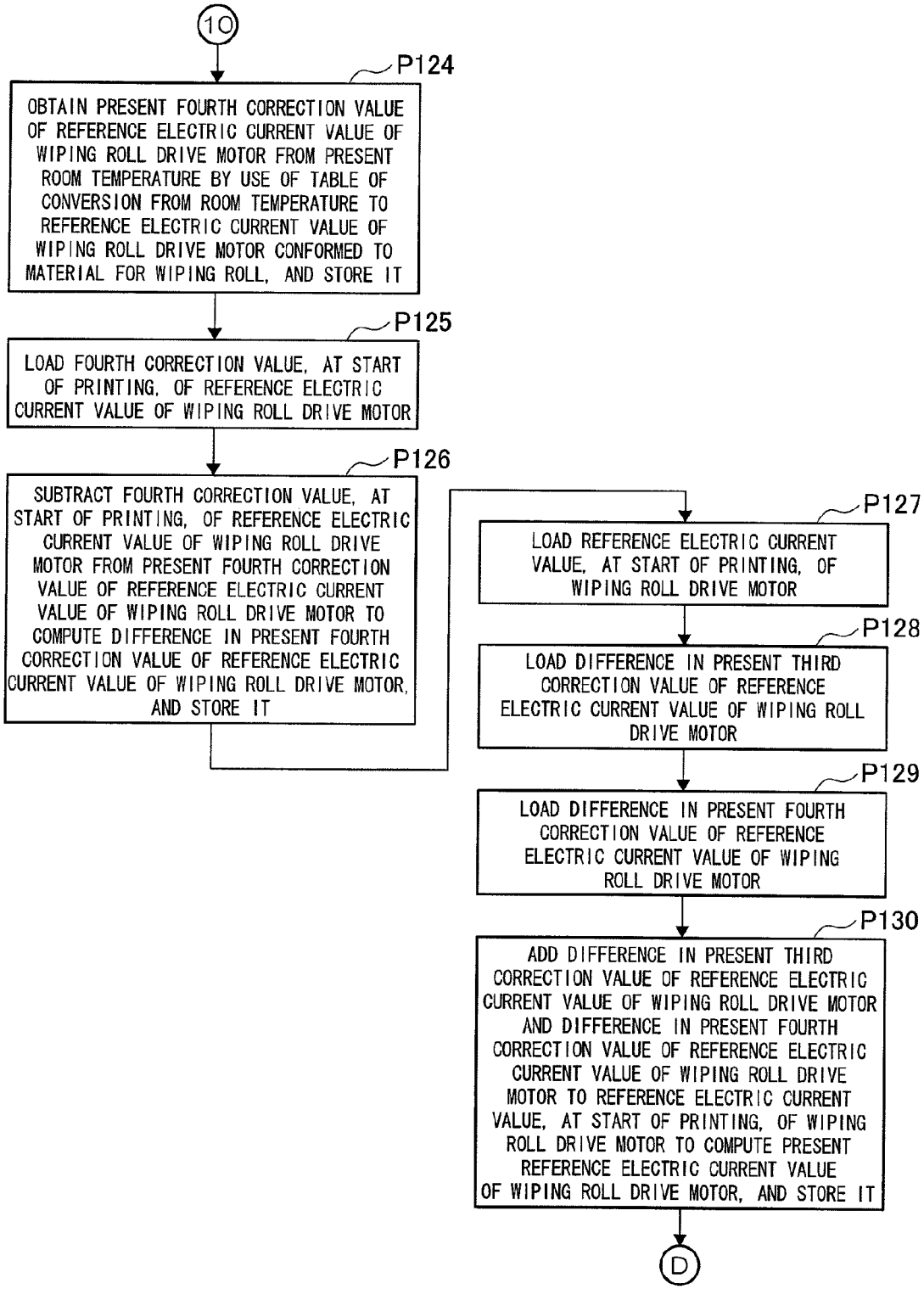
FIG. 5B is an action flow chart of the drive control device for the wiping roll drive motor and the wiping roll contact pressure adjusting motor in Embodiment 1 of the present invention.
Figure 6A:
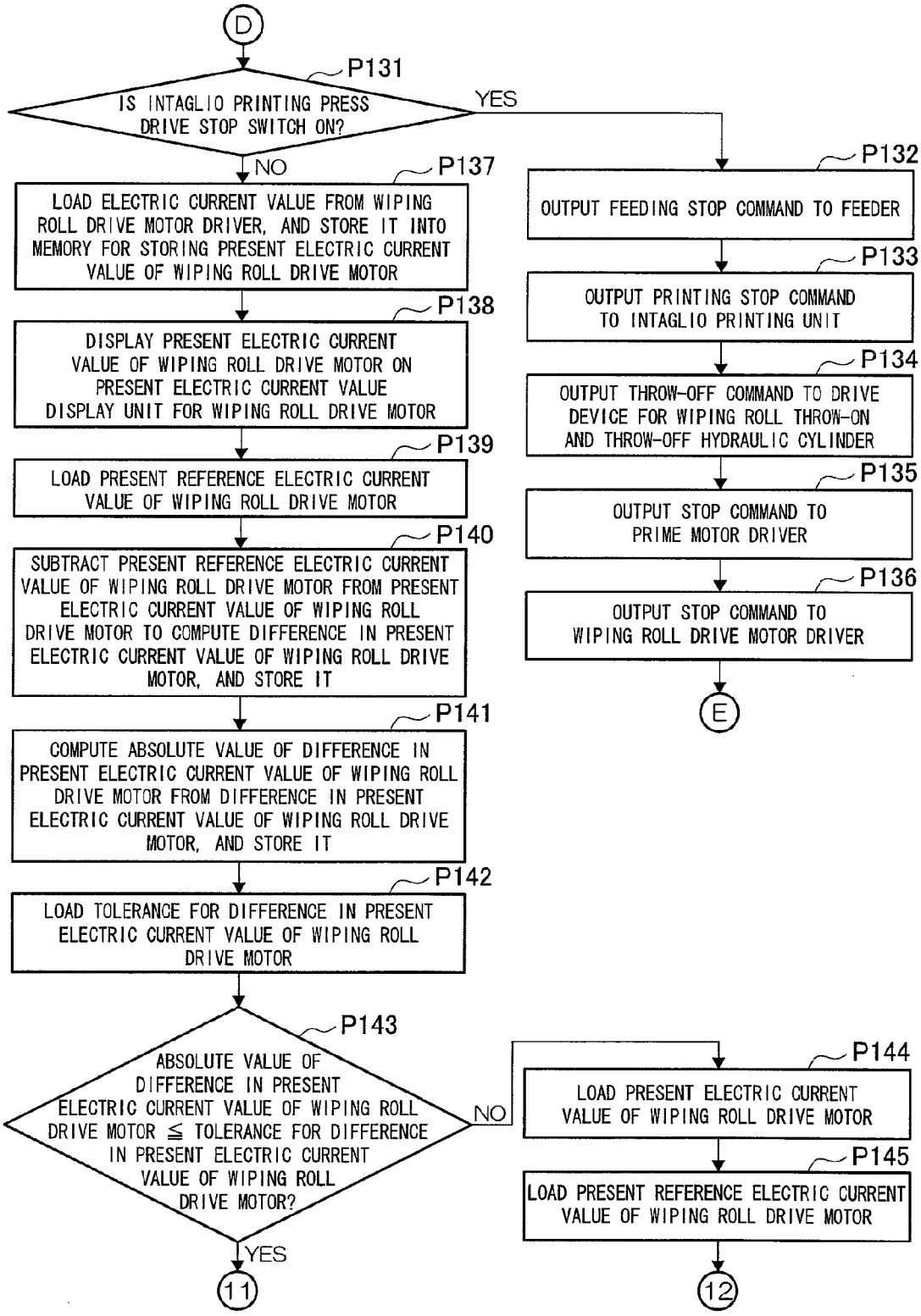
FIG. 6A is an action flow chart of the drive control device for the wiping roll drive motor and the wiping roll contact pressure adjusting motor in Embodiment 1 of the present invention.
Figure 6B:
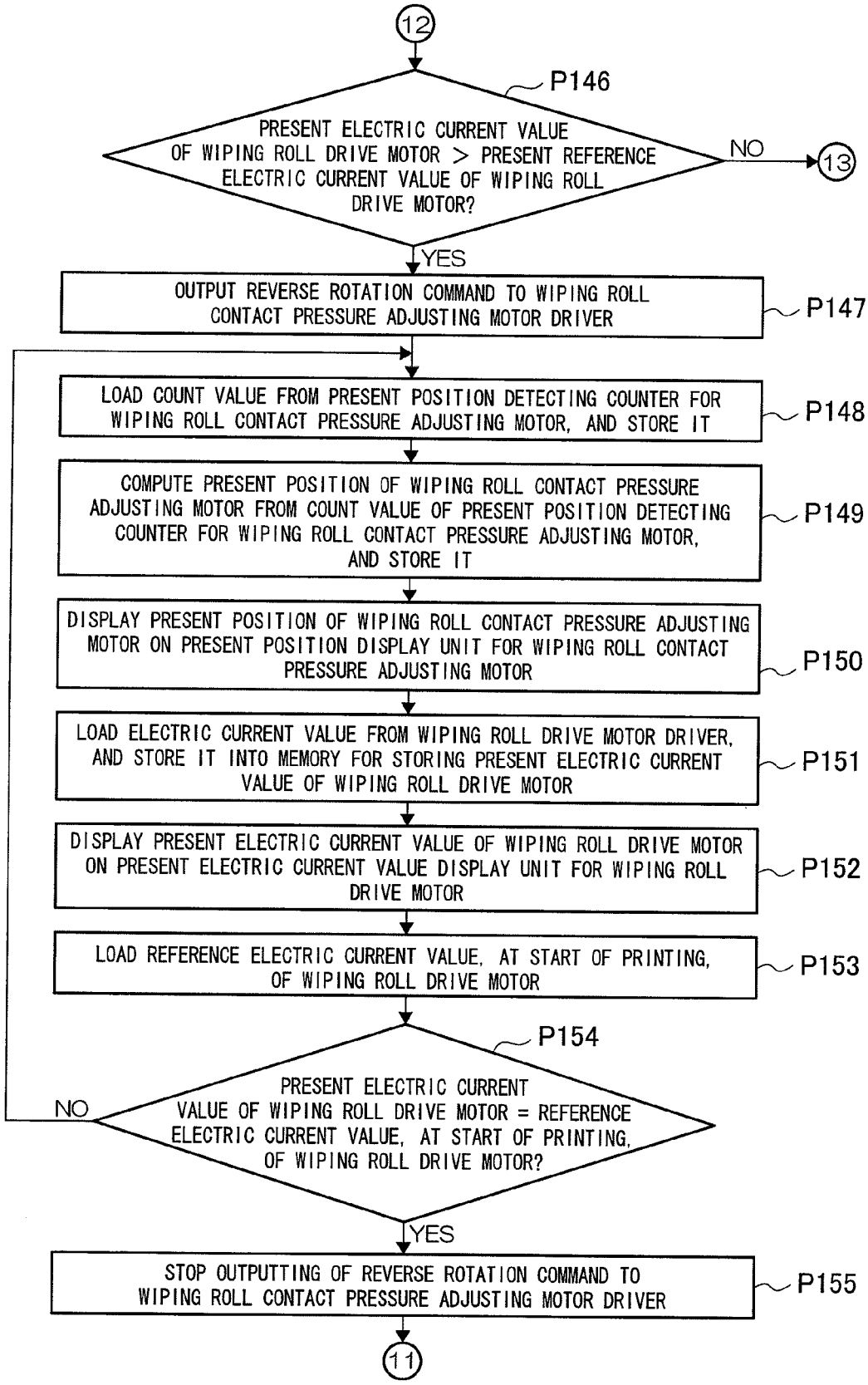
FIG. 6B is an action flow chart of the drive control device for the wiping roll drive motor and the wiping roll contact pressure adjusting motor in Embodiment 1 of the present invention.
Figure 6C:
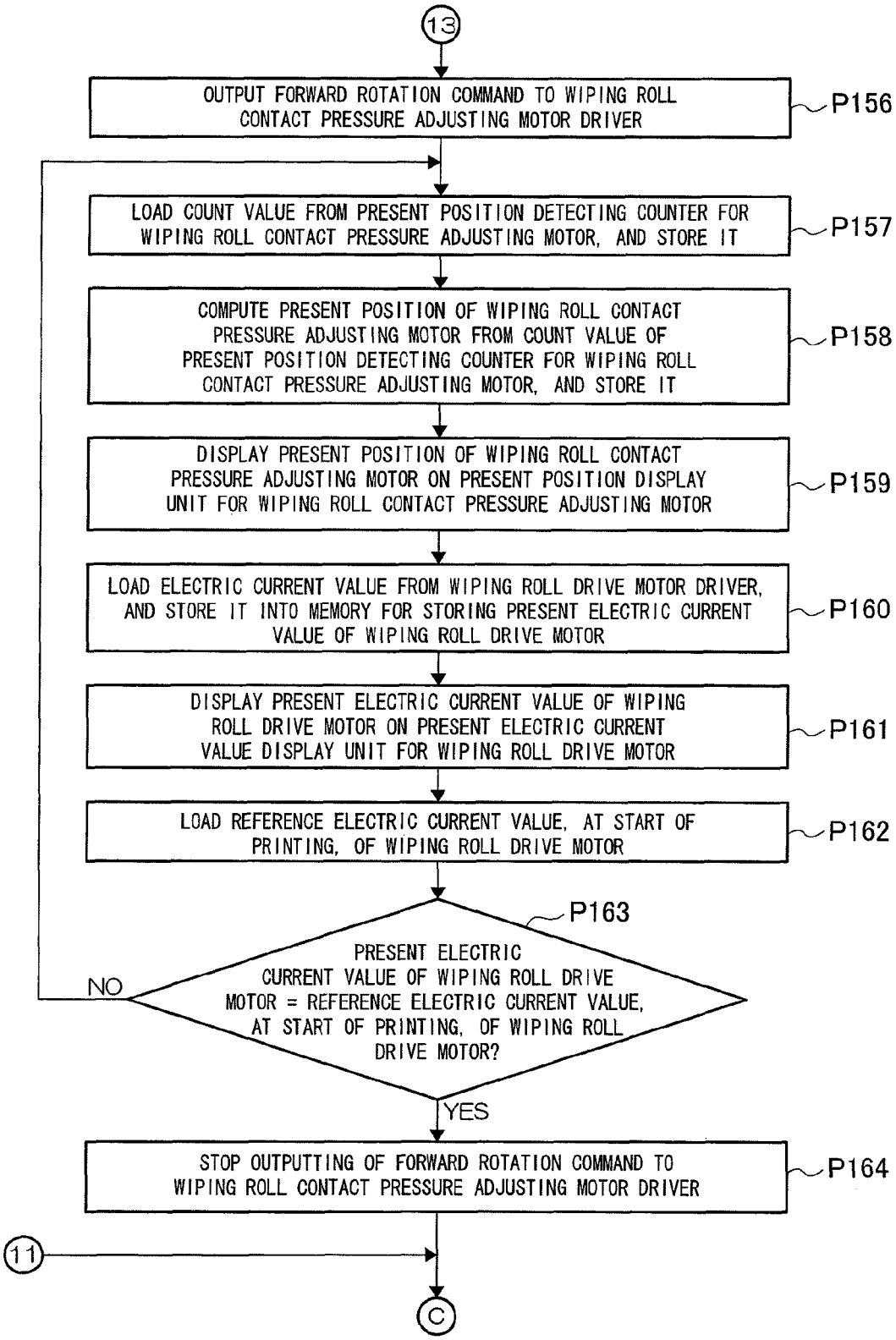
FIG. 6C is an action flow chart of the drive control device for the wiping roll drive motor and the wiping roll contact pressure adjusting motor in Embodiment 1 of the present invention.
Figure 7A:
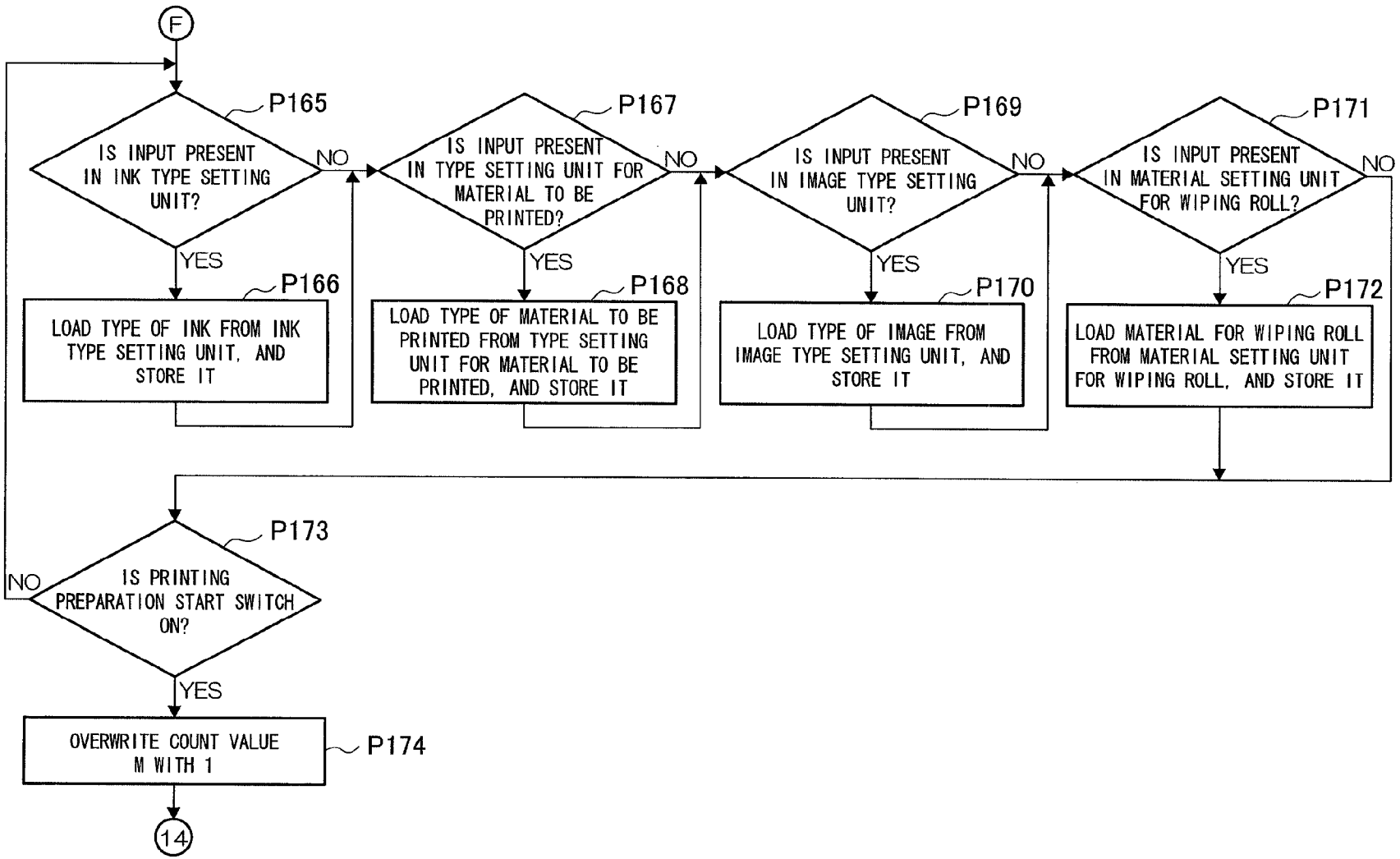
FIG. 7A is an action flow chart of the drive control device for the wiping roll drive motor and the wiping roll contact pressure adjusting motor in Embodiment 1 of the present invention.
Figure 7B:
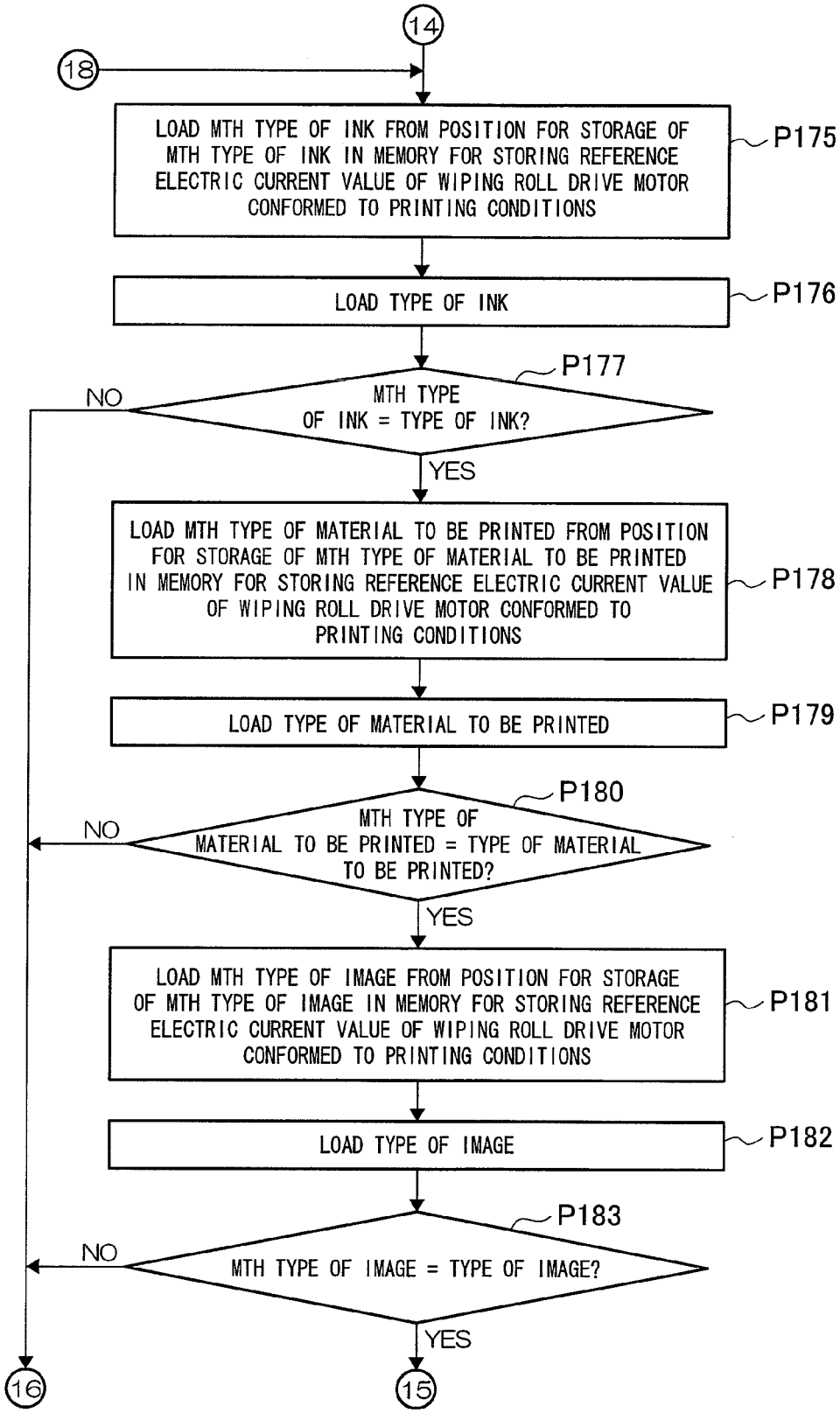
FIG. 7B is an action flow chart of the drive control device for the wiping roll drive motor and the wiping roll contact pressure adjusting motor in Embodiment 1 of the present invention.
Figure 7C:
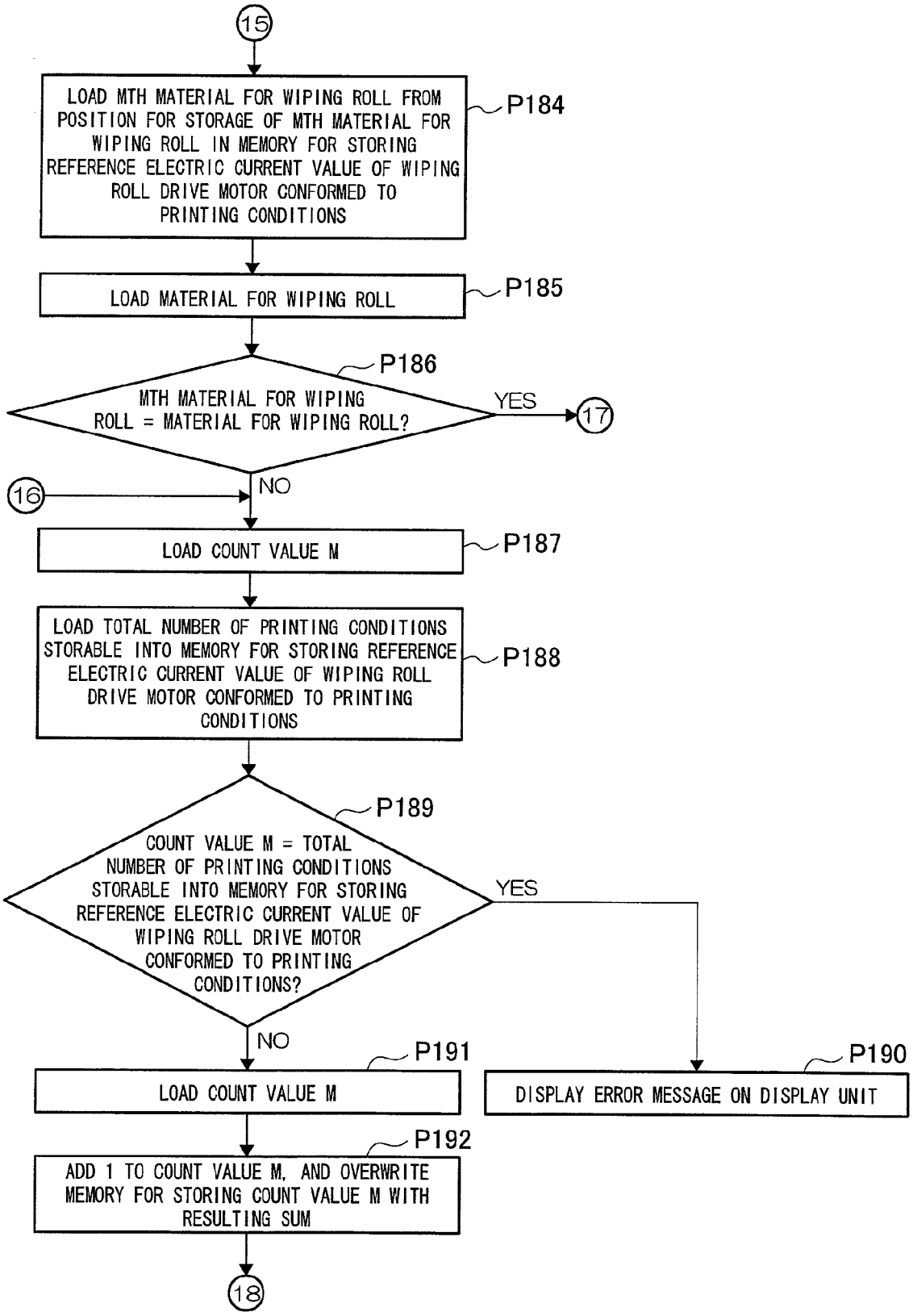
FIG. 7C is an action flow chart of the drive control device for the wiping roll drive motor and the wiping roll contact pressure adjusting motor in Embodiment 1 of the present invention.
Figure 7D:
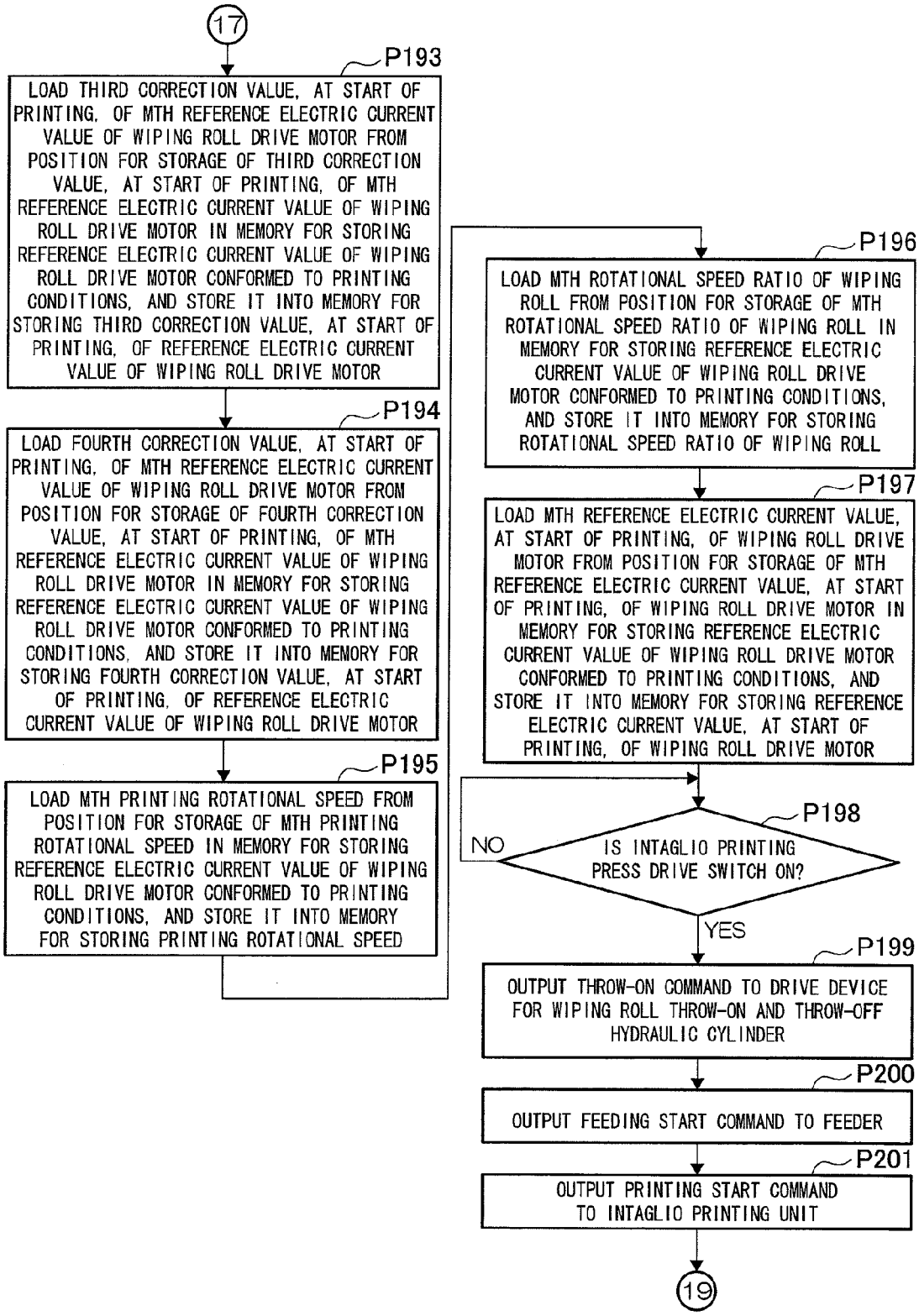
FIG. 7D is an action flow chart of the drive control device for the wiping roll drive motor and the wiping roll contact pressure adjusting motor in Embodiment 1 of the present invention.
Figure 7E:
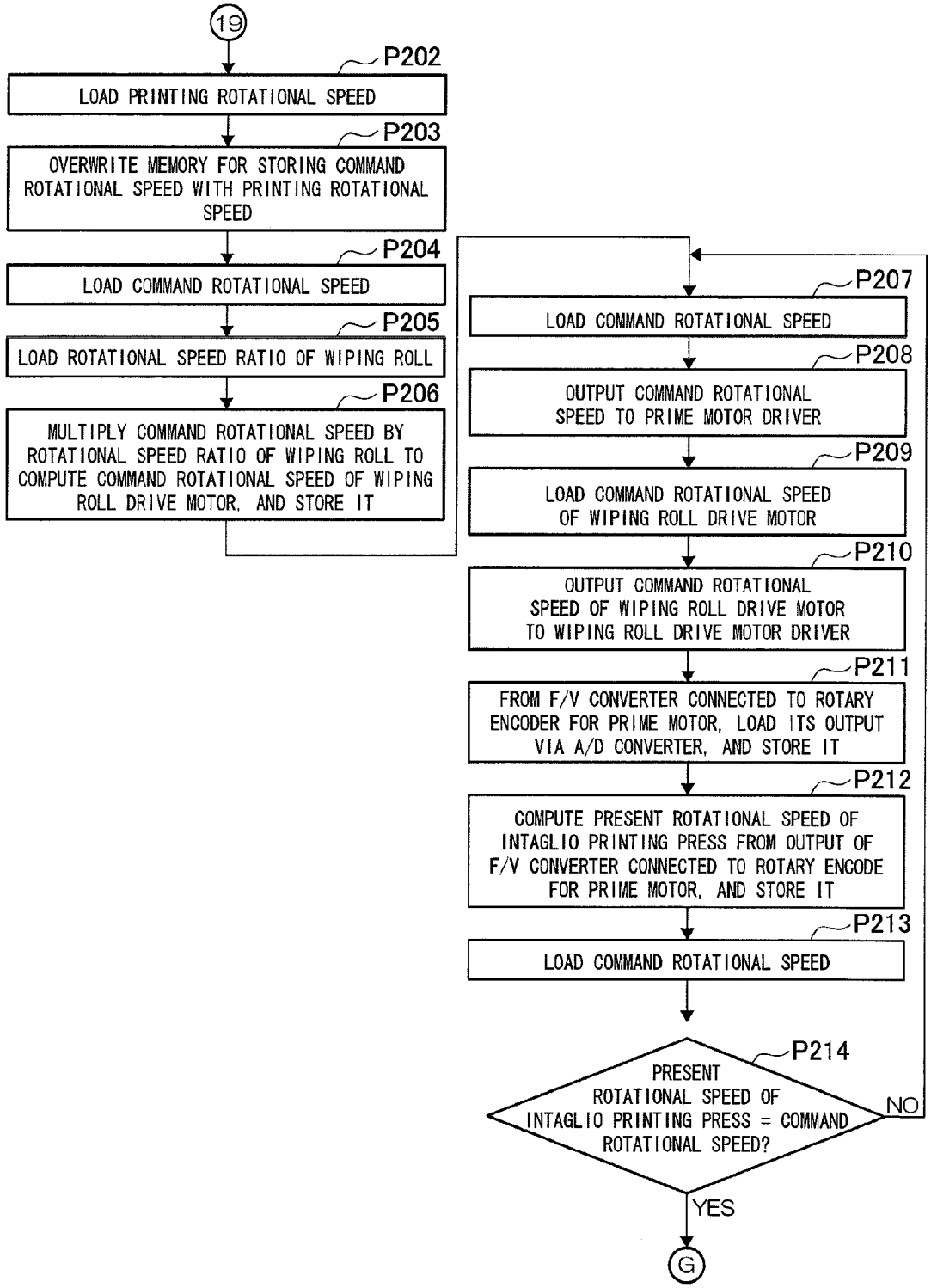
FIG. 7E is an action flow chart of the drive control device for the wiping roll drive motor and the wiping roll contact pressure adjusting motor in Embodiment 1 of the present invention.
Figure 8A:
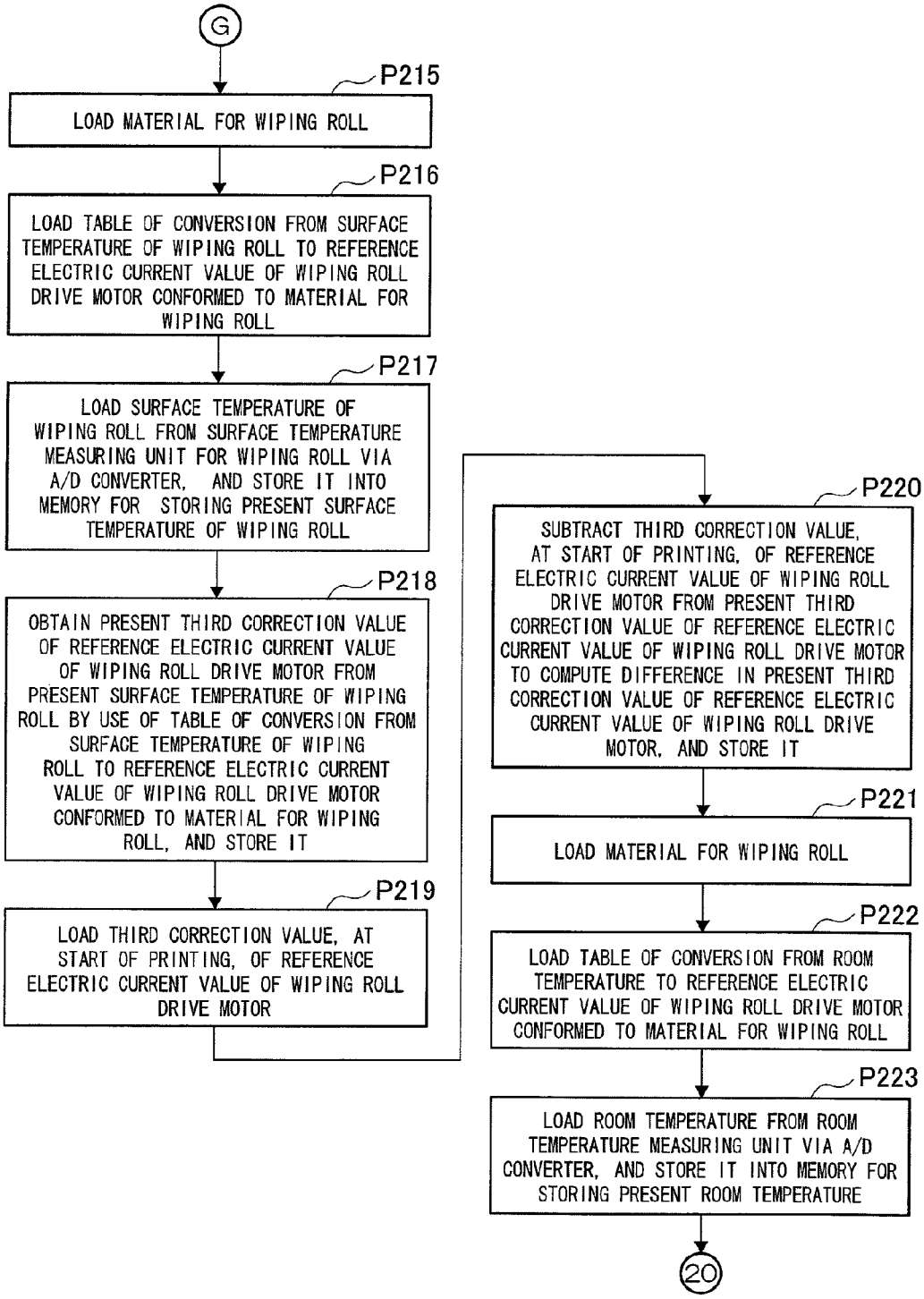
FIG. 8A is an action flow chart of the drive control device for the wiping roll drive motor and the wiping roll contact pressure adjusting motor in Embodiment 1 of the present invention.
Figure 8B:
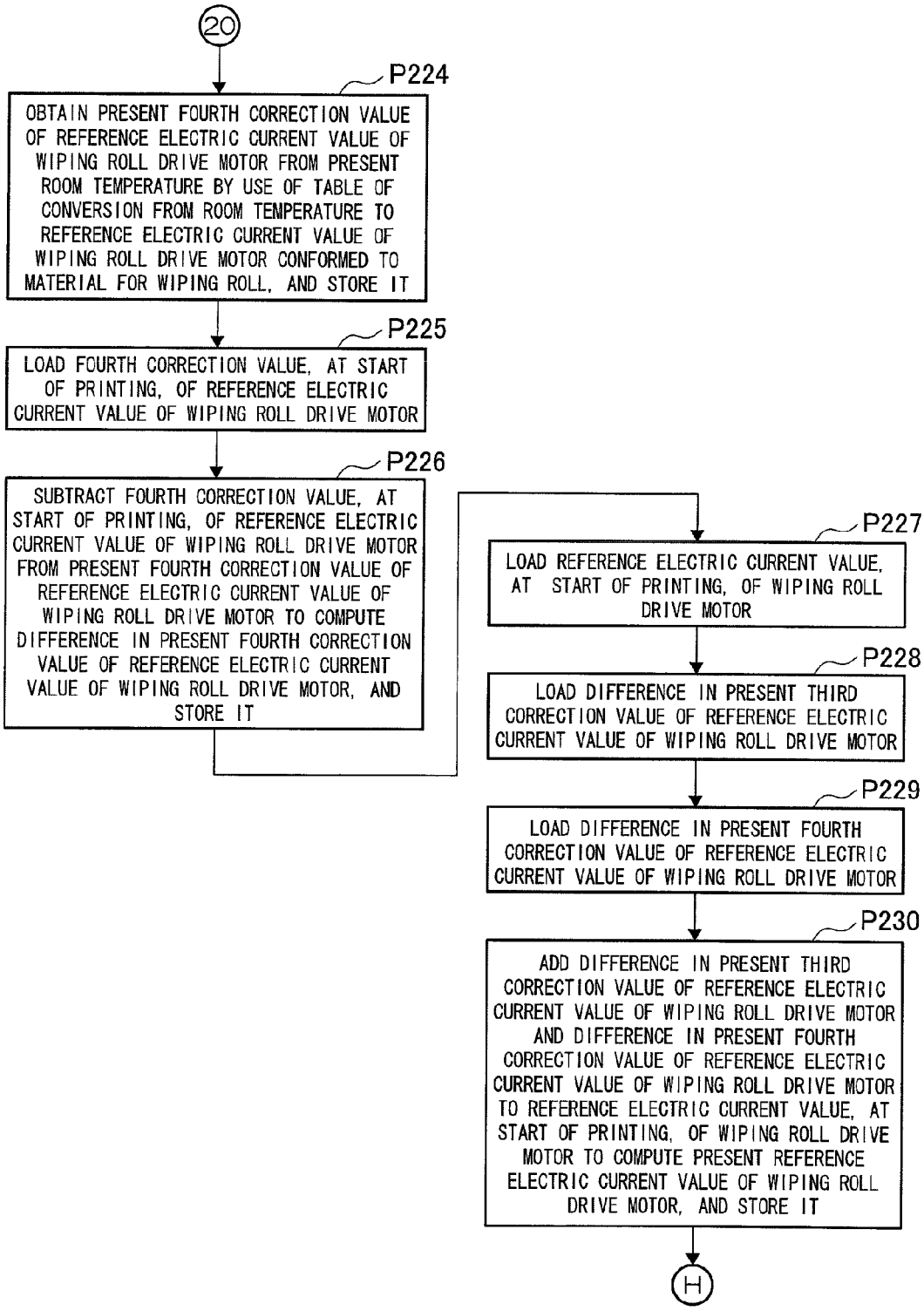
FIG. 8B is an action flow chart of the drive control device for the wiping roll drive motor and the wiping roll contact pressure adjusting motor in Embodiment 1 of the present invention.
Figure 9A:
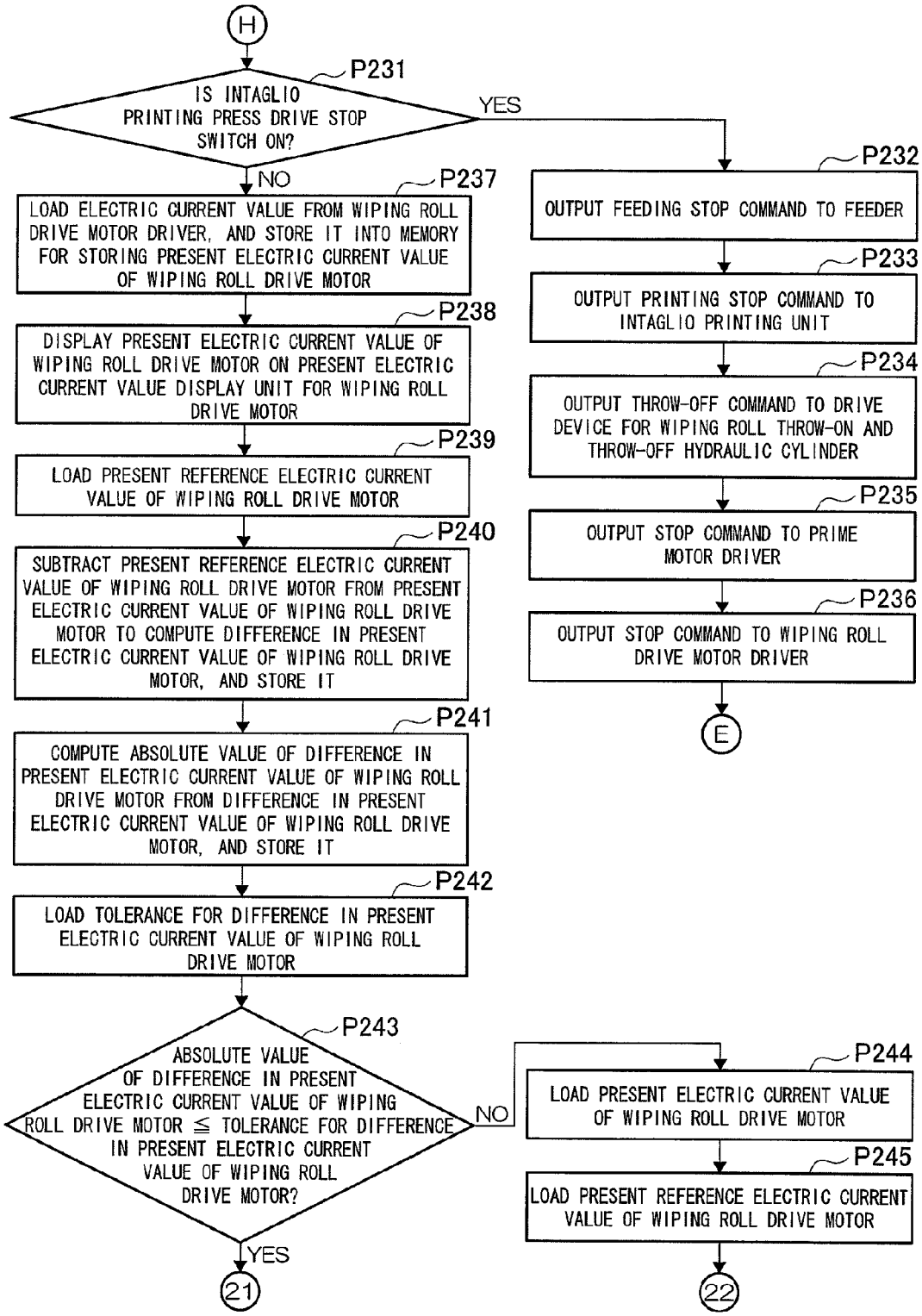
FIG. 9A is an action flow chart of the drive control device for the wiping roll drive motor and the wiping roll contact pressure adjusting motor in Embodiment 1 of the present invention.
Figure 9B:
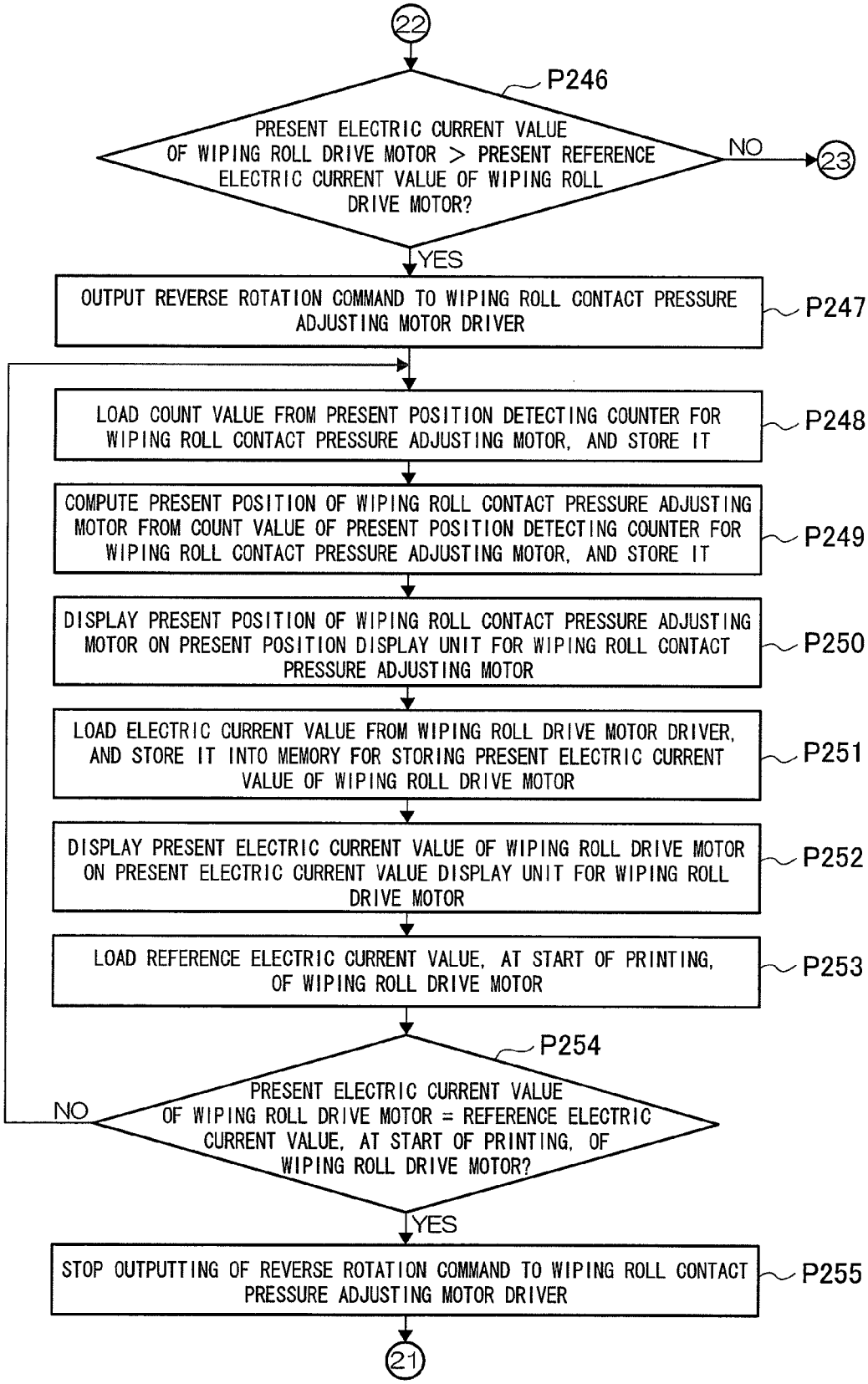
FIG. 9B is an action flow chart of the drive control device for the wiping roll drive motor and the wiping roll contact pressure adjusting motor in Embodiment 1 of the present invention.
Figure 9C:
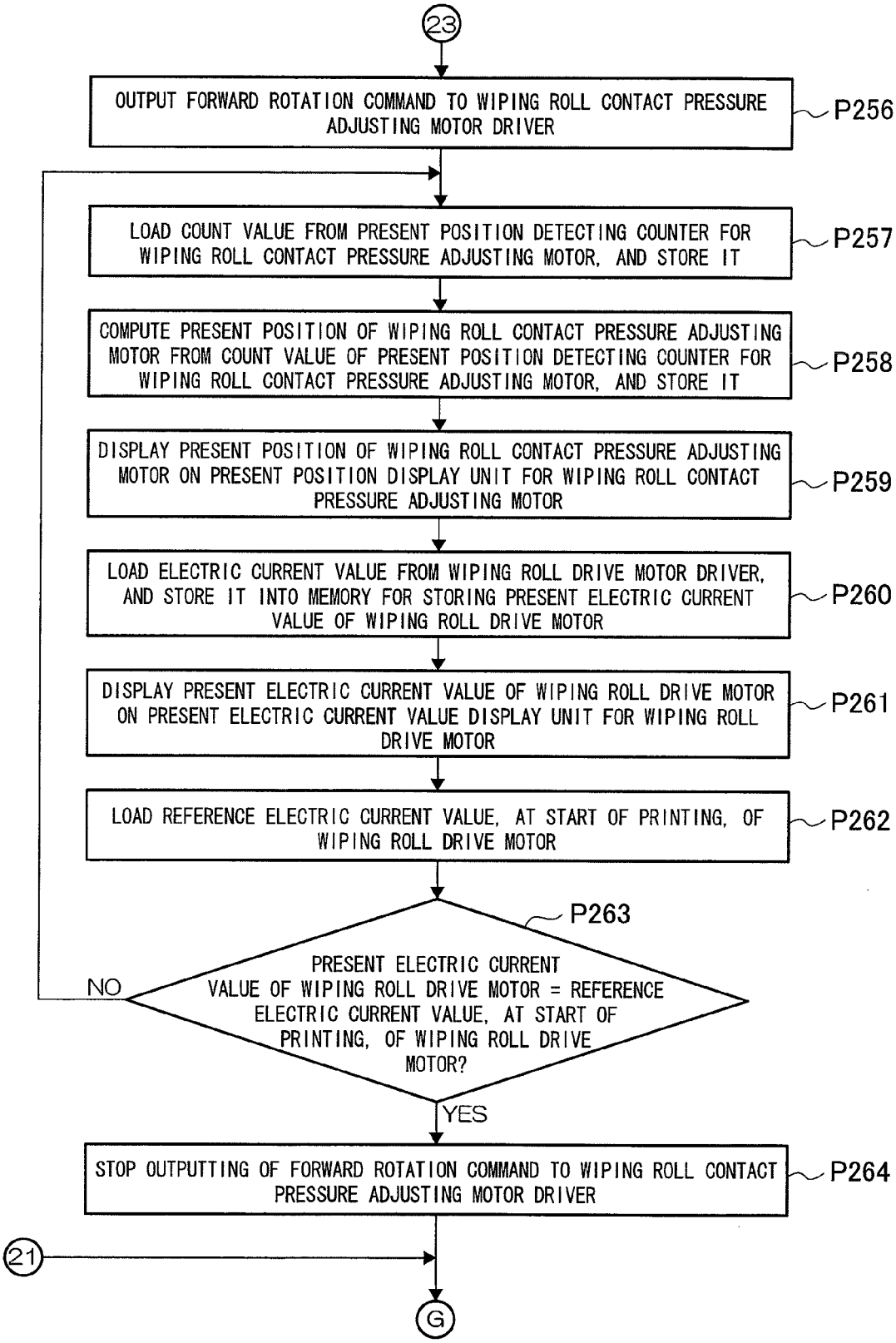
FIG. 9C is an action flow chart of the drive control device for the wiping roll drive motor and the wiping roll contact pressure adjusting motor in Embodiment 1 of the present invention.
Figure 10:
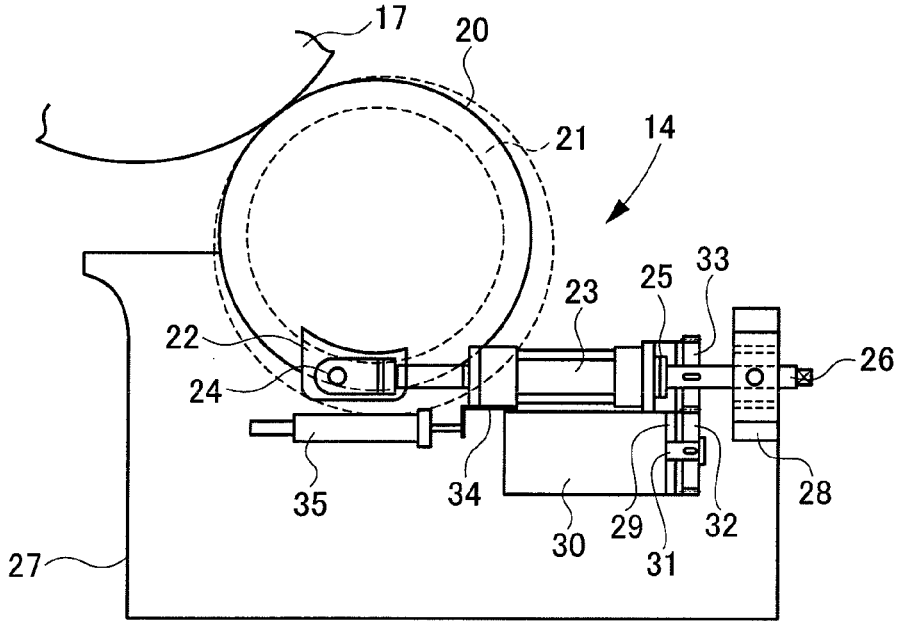
FIG. 10 is a side view of a contact pressure adjusting mechanism of a wiping device.
Figure 11:
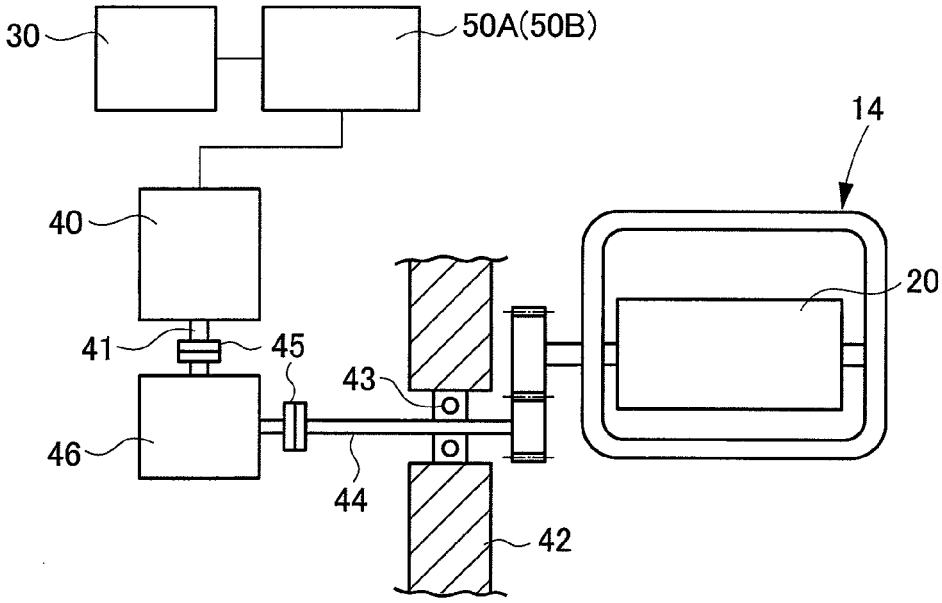
FIG. 11 is a plan view showing a drive system for the wiping device.
Figure 12:
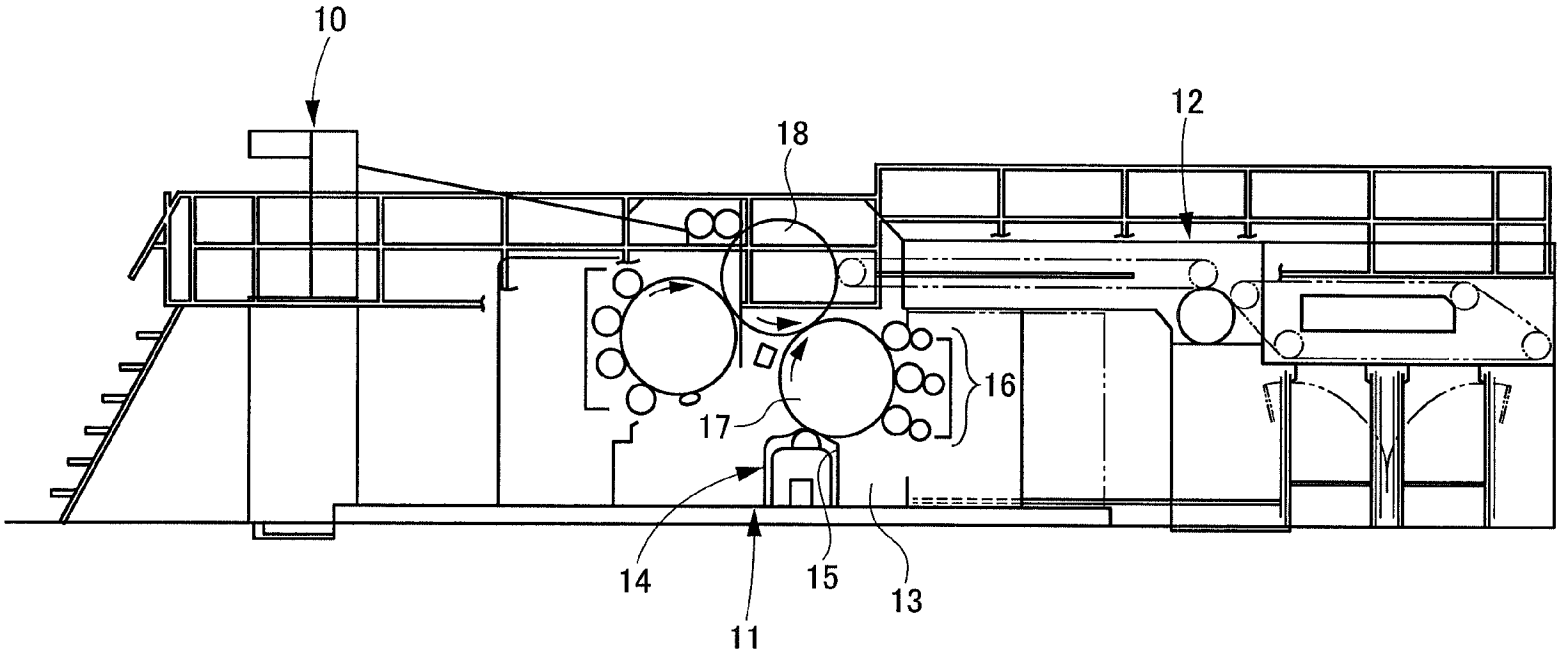
FIG. 12 is a general side view of an intaglio printing press.

FIGS. 1A to 1D are hardware block diagrams of a drive control device for a wiping roll drive motor and a wiping roll contact pressure adjusting motor in Embodiment 1 of the present invention. FIGS. 2A to 2D, FIGS. 3A to 3C, FIGS. 4A to 4C, FIGS. 5A and 5B, FIGS. 6A to 6C, FIGS. 7A to 7E, FIGS. 8A and 8B, and FIGS. 9A to 9C are action flow charts of the drive control device for the wiping roll drive motor and the wiping roll contact pressure adjusting motor in Embodiment 1 of the present invention. FIG. 10 is a side view of a contact pressure adjusting mechanism of a wiping device. FIG. 11 is a plan view showing a drive system for the wiping device. FIG. 12 is a general side view of an intaglio printing press.

As shown in FIG. 12, an intaglio printing press (printing press or machine) is equipped with a feeder 10, an intaglio printing unit 11, and a delivery unit 12. At a site of a machine frame 13 to which they are connected, the site corresponding to a wiping device 14 in the intaglio printing unit 11, a notch 15 for withdrawal of the wiping device is formed so that the entire wiping device 14 can be withdrawn sideways outside the machine on the operating side.

In the intaglio printing unit 11, ink from an inker is transferred from ink form rollers 16 to an intaglio (not shown) mounted on an intaglio cylinder (first rotating body) 17, and then ink in areas other than pattern or image areas is removed by the wiping device 14. Ink in the image areas is transferred to paper passing between the intaglio cylinder 17 and an impression cylinder 18.

In the wiping device 14, a wiping roll (second rotating body) 20 has a shaft pivotally supported in an internal hole of an eccentric bearing 21. By reciprocating a metal fitting 22 fixed to the outer peripheral side of the eccentric bearing 21, the wiping roll 20 is thrown on and off the intaglio cylinder 17.

In detail, a leading end of a piston rod of a wiping roll throw-on and throw-off hydraulic cylinder 23 is pivotally attached to the metal fitting 22 by a pin 24, while a threaded shaft 26 is connected to the head side of the cylinder 23 via a thrust bearing 25. The thrust bearing 25 transmits movements of the threaded shaft 26 along the axial direction to the wiping roll throw-on and throw-off hydraulic cylinder 23, but does not transmit rotations of the threaded shaft 26 to the wiping roll throw-on and throw-off hydraulic cylinder 23. The threaded shaft 26 is screwed to a threaded bearing 28 fixed to a cleaning fluid tank 27.

A wiping roll contact pressure adjusting motor (contact pressure adjusting motor) 30 is fixed to a bracket 29 incorporating the thrust bearing 25. A gear 32 fixed to a motor shaft 31 of the wiping roll contact pressure adjusting motor 30 is screwed to a gear 33 fixed to the threaded shaft 26. On the other hand, the wiping roll throw-on and throw-off hydraulic cylinder 23 is provided with a detection body 34, and a direct acting potentiometer 35 is provided to detect the position of the detection body 34.

Thus, when the wiping roll throw-on and throw-off hydraulic cylinder 23 acts to extend, the wiping roll 20 contacts the intaglio cylinder 17, and when the wiping roll throw-on and throw-off hydraulic cylinder 23 acts to contract, the wiping roll 30 leaves the intaglio cylinder 17. When the wiping roll contact pressure adjusting motor 30 is rotated during contact of the wiping roll 20 with the intaglio cylinder 17, the threaded shaft 26 rotates and moves in the axial direction. In accordance with this movement, the wiping roll throw-on and throw-off hydraulic cylinder 23 also moves, whereby the contact pressure between the wiping roll 20 and the intaglio cylinder 17 can be adjusted (contact pressure adjusting mechanism). FIG. 10 shows the left side (operating side) of the wiping roll 20, and a device of the same configuration as mentioned above is assembled to the right side (drive side) of the wiping roll 20 as well.

As shown in FIG. 11, the wiping roll contact pressure adjusting motor 30 is drivingly controlled by a drive control device (control device) 50A for a wiping roll drive motor and the wiping roll contact pressure adjusting motor. When the wiping roll contact pressure adjusting motor 30 rotates in a forward direction during the above-mentioned contact under a drive command from the drive control device 50A (50B), the contact pressure is increased. Its rotation in a reverse direction results in a decreased contact pressure.

The drive control device 50A (50B) drivingly controls the wiping roll drive motor (second rotating body drive motor) 40, and also drivingly controls the wiping roll contact pressure adjusting motor 30 in accordance with the electric current value (torque value) of the wiping roll drive motor 40.

A speed reducer 46 comprising a worm gear mechanism is interposed, via couplings 45, between an output shaft 41 of the wiping roll drive motor 40 and a drive shaft 44 of the wiping roll 20 supported by a frame 42 via a bearing 43.

As shown in FIGS. 1A to 1D, the drive control device 50A is composed of CPU 100, ROM 101, RAM 102, input/output devices 103 to 114, and an interface 115 which are interconnected by BUS (bus line).

To the BUS, the following memories are connected: a memory M100 for storing the type of ink; a memory M101 for storing the type of a material to be printed; a memory M102 for storing the type of an image; a memory M103 for storing a material for the wiping roll; a memory M104 for storing a printing rotational speed; a memory M105 for storing the rotational speed ratio of the wiping roll; a memory M106 for storing a table of conversion from the type of ink to the reference electric current value of the wiping roll drive motor; a memory M107 for storing the provisional reference electric current value of the wiping roll drive motor; a memory M108 for storing a table of conversion from the type of the material to be printed to the reference electric current value of the wiping roll drive motor; a memory M109 for storing the first correction value of the reference electric current value of the wiping roll drive motor; and a memory M110 for storing a table of conversion from the type of image to the reference electric current value of the wiping roll drive motor.

To the BUS, the following memories are also connected: a memory M111 for storing the second correction value of the reference electric current value of the wiping roll drive motor; a memory M112 for storing a table of conversion from the surface temperature of the wiping roll to the reference electric current value of the wiping roll drive motor; a memory M113 for storing the surface temperature of the wiping roll at the start of printing; a memory M114 for storing the third correction value, at the start of printing, of the reference electric current value of the wiping roll drive motor; a memory M115 for storing a table of conversion from room temperature to the reference electric current value of the wiping roll drive motor; a memory M116 for storing room temperature at the start of printing; a memory M117 for storing the fourth correction value, at the start of printing, of the reference electric current value of the wiping roll drive motor; a memory M118 for storing the reference electric current value, at the start of printing, of the wiping roll drive motor; a memory M119 for storing a command rotational speed; and a memory M120 for storing the command rotational speed of the wiping roll drive motor.

To the BUS, the following memories are further connected: a memory M121 for storing the output of an F/V converter connected to a rotary encoder for a prime motor; a memory M122 for storing the present rotational speed of the intaglio printing press; a memory M123 for storing the present electric current value of the wiping roll drive motor; a memory M124 for storing a difference in the present electric current value of the wiping roll drive motor; a memory M125 for storing the absolute value of the difference in the present electric current value of the wiping roll drive motor; a memory M126 for storing tolerance for the difference in the present electric current value of the wiping roll drive motor; a memory M127 for storing the present surface temperature of the wiping roll; a memory M128 for storing the present third correction value of the reference electric current value of the wiping roll drive motor; a memory M129 for storing a difference in the present third correction value of the reference electric current value of the wiping roll drive motor; a memory M130 for storing present room temperature; a memory M131 for storing the present fourth correction value of the reference electric current value of the wiping roll drive motor; a memory M132 for storing a difference in the present fourth correction value of the reference electric current value of the wiping roll drive motor; and a memory M133 for storing the present reference electric current value of the wiping roll drive motor.

To the BUS, the following memories are further connected: a memory M134 for storing the count value of a present position detecting counter for the wiping roll contact pressure adjusting motor; a memory M135 for storing the present position of the wiping roll contact pressure adjusting motor; a memory M136 for storing the reference electric current value of the wiping roll drive motor conformed to the printing conditions; a memory M137 for storing a count value M; and a memory M138 for storing the total number of the printing conditions storable in the memory for storing the reference electric current value of the wiping roll drive motor conformed to the printing conditions.

To the input/output device 103, the following are further connected: an intaglio printing press drive switch 120; an intaglio printing press drive stop switch 121; an input device 122 including a keyboard, various switches, buttons, and the like; a display unit 123 including CRT, lamps and the like; an output device 124 including a floppy (registered trademark) disk drive, a printer, and the like; a contact pressure increasing switch 150; a contact pressure decreasing switch 151; a contact pressure adjustment completion switch 152 for the wiping roll; a reprinting switch 153; a new printing switch 154; and a printing preparation start switch 155.

To the input/output device 104, the following are connected: an ink type setting unit 125; a type setting unit 126 for the material to be printed; an image type setting unit 127; a material setting unit 128 for the wiping roll; a printing rotational speed setting unit 129; and a rotational speed ratio setting unit 130 for the wiping roll.

To the input/output device 105, a surface temperature measuring unit 132 for the wiping roll is connected via an A/D converter 131, and a room temperature measuring unit 134 is connected via an A/D converter 133.

To the input/output device 106, the wiping roll throw-on and throw-off hydraulic cylinder 23 is connected via a drive device 135 for the wiping roll throw-on and throw-off hydraulic cylinder.

To the input/output device 107, a prime motor 139 is connected via a D/A converter 137 and a prime motor driver 138.

To the input/output device 108, a rotary encoder 142 for the prime motor, which is linked to and driven by the prime motor, is connected via an A/D converter 140 and an F/V converter 141. The rotary encoder 142 for the prime motor is also connected to the prime motor driver 138.

To the input/output device 109, an electric current value is inputted from a wiping roll drive motor driver 144 to be described later.

To the input/output device 110, the wiping roll drive motor 40 is connected via a D/A converter 143 and the above-mentioned wiping roll drive motor driver 144. A rotary encoder 146 for the wiping roll drive motor, which is linked to and driven by the wiping roll drive motor 40, is connected to the wiping roll drive motor driver 144.

To the input/output device 111, the wiping roll contact pressure adjusting motor 30 is connected via a wiping roll contact pressure adjusting motor driver 147.

To the input/output device 112, a present electric current value display unit 156 for the wiping roll drive motor and a present position display unit 157 for the wiping roll contact pressure adjusting motor are connected.

To the input/output device 113, an LED 159 for displaying contact pressure adjustment preparation completion for the wiping roll is connected via a drive device 158 for the LED for displaying contact pressure adjustment preparation completion for the wiping roll.

To the input/output device 114, a rotary encoder 161 for the wiping roll contact pressure adjusting motor, which is linked to and driven by the wiping roll contact pressure adjusting motor 30, is connected via a present position detecting counter 160 for the wiping roll contact pressure adjusting motor.

To the interface 115, the feeder 10 and the intaglio printing unit 11 are connected.

The actions of the above-described drive control device 50A for the wiping roll drive motor and the wiping roll contact pressure adjusting motor will be described below.

The drive control device 50A operates in accordance with an operational or action flow shown in FIGS. 2A to 2D, FIGS. 3A to 3C, FIGS. 4A to 4C, FIGS. 5A and 5B, FIGS. 6A to 6C, FIGS. 7A to 7E, FIGS. 8A and 8B, and FIGS. 9A to 9C.

In Step P1, it is determined whether the new printing switch 154 is ON. If the answer is yes (YES), the program shifts to Step P2 to be described below. If the answer is no (NO), it is determined in Step P3 whether the reprinting switch 153 is ON. If the answer is YES in this Step P3, the program shifts to Step P165 to be described later. If the answer is NO in Step P3, the program returns to Step P1.

Then, in the above-mentioned Step P2, it is determined whether input has been provided to the ink type setting unit 125. If the answer is YES, the type of ink is loaded from the ink type setting unit 125, and stored into the memory M100, in Step P4. If the answer is NO in Step P2, the program directly shifts to Step P5 to be described below.

Then, in Step P5, it is determined whether input has been provided to the type setting unit 126 for the material to be printed. If the answer is YES, the type of the material to be printed is loaded from the type setting unit 126 for the material to be printed, and stored into the memory M101, in Step P6. If the answer is NO in Step P5, the program directly shifts to Step P7 to be described below.

Then, in the above-mentioned Step P7, it is determined whether input has been provided to the image type setting unit 127. If the answer is YES, the type of image is loaded from the image type setting unit 127, and stored into the memory M102, in Step P8. If the answer is NO in Step P7, the program directly shifts to Step P9 to be described below.

Then, in the above Step P9, it is determined whether input has been provided to the material setting unit 128 for the wiping roll. If the answer is YES, in Step P10, the material for the wiping roll 20 is loaded from the material setting unit 128 for the wiping roll, and stored into the memory M103. If the answer is NO in Step P9, the program directly shifts to Step P11 to be described below.

Then, in the above Step P11, it is determined whether a printing rotational speed has been inputted to the printing rotational speed setting unit 129. If the answer is YES, in Step P12, the printing rotational speed is loaded from the printing rotational speed setting unit 129, and stored into the memory M104. If the answer is NO in Step P11, the program directly shifts to Step P13 to be described below.

Then, in Step P13, it is determined whether the rotational speed ratio of the wiping roll 20 has been inputted to the rotational speed ratio setting unit 130 for the wiping roll. If the answer is YES, in Step P14, the rotational speed ratio of the wiping roll 20 is loaded from the rotational speed ratio setting unit 130 for the wiping roll, and stored into the memory M105. If the answer is NO in Step P13, the program directly shifts to Step P15 to be described below.

Then, in Step P15, it is determined whether the intaglio printing press drive switch 120 is ON. If the answer is YES, in Step P16, the table of conversion from the type of ink to the reference electric current value of the wiping roll drive motor is loaded from the memory M106. If the answer is NO in Step P15, the program returns to Step P2.

Then in Step P17, the type of ink is loaded from the memory M100. Then, in Step P18, the provisional reference electric current value of the wiping roll drive motor 40 is obtained from the type of ink by use of the table of conversion from the type of ink to the reference electric current value of the wiping roll drive motor, and stored into the memory M107.

Then, in Step P19, the table of conversion from the type of material to be printed to the reference electric current value of the wiping roll drive motor is loaded from the memory M108. Then, in Step P20, the type of the material to be printed is loaded from the memory M101.

Then, in Step P21, a first correction value of the reference electric current value of the wiping roll drive motor 40 is obtained from the type of the material to be printed by use of the table of conversion from the type of the material to be printed to the reference electric current value of the wiping roll drive motor, and is stored into the memory M109. Then, in Step P22, the table of conversion from the type of image to the reference electric current value of the wiping roll drive motor is loaded from the memory M110.

Then, in Step P23, the type of image is loaded from the memory M102. Then, in Step P24, a second correction value of the reference electric current value of the wiping roll drive motor 40 is obtained from the type of image by use of the table of conversion from the type of image to the reference electric current value of the wiping roll drive motor, and stored into the memory M111.

Then, in Step P25, the material for the wiping roll 20 is loaded from the memory M103. Then, in Step P26, the table of conversion from the surface temperature of the wiping roll to the reference electric current value of the wiping roll drive motor conformed to the material for the wiping roll 20 is loaded from the memory M112.

Then, in Step P27, the surface temperature of the wiping roll 20 is loaded from the surface temperature measuring unit 132 for the wiping roll via the A/D converter 131, and stored into the memory M113 for storing the surface temperature of the wiping roll at the start of printing. Then, in Step P28, a third correction value, at the start of printing, of the reference electric current value of the wiping roll drive motor 40 is obtained from the surface temperature of the wiping roll at the start of printing by use of the table of conversion from the surface temperature of the wiping roll to the reference electric current value of the wiping roll drive motor conformed to the material for the wiping roll 20, and it is stored into the memory M114.

Then, in Step P29, the material for the wiping roll 20 is loaded from the memory M103. Then, in Step P30, the table of conversion from room temperature to the reference electric current value of the wiping roll drive motor conformed to the material for the wiping roll 20 is loaded from the memory M115.

Then, in Step P31, room temperature is loaded the room temperature measuring unit 134 via the A/D converter 133, and stored into the memory M116 for storing room temperature at the start of printing. Then, in Step P32, a fourth correction value, at the start of printing, of the reference electric current value of the wiping roll drive motor 40 is obtained from room temperature at the start of printing by use of the table of conversion from room temperature to the reference electric current value of the wiping roll drive motor conformed to the material for the wiping roll 20, and it is stored into the memory M117.

Then, in Step P33, the provisional reference electric current value of the wiping roll drive motor 40 is loaded from the memory M107. Then, in Step P34, the first correction value of the reference electric current value of the wiping roll drive motor 40 is loaded from the memory M109.

Then, in Step P35, the second correction value of the reference electric current value of the wiping roll drive motor 40 is loaded from the memory M111. Then, in Step P36, the third correction value, at the start of printing, of the reference electric current value of the wiping roll drive motor 40 is loaded from the memory M114.

Then, in Step P37, the fourth correction value, at the start of printing, of the reference electric current value of the wiping roll drive motor 40 is loaded from the memory M117. Then, in Step P38, the first correction value of the reference electric current value of the wiping roll drive motor 40, the second correction value of the reference electric current value of the wiping roll drive motor 40, the third correction value, at the start of printing, of the reference electric current value of the wiping roll drive motor 40, and the fourth correction value, at the start of printing, of the reference electric current value of the wiping roll drive motor are added to the provisional reference electric current value of the wiping roll drive motor 40 to compute the reference electric current value, at the start of printing, of the wiping roll drive motor 40, and it is stored into the memory M118.

In accordance with the above-described operational or action flow, the reference electric current value, at the start of printing, of the wiping roll drive motor 40 is computed.

Then, in Step P39, a throw-on command is outputted to the drive device 135 for the wiping roll throw-on and throw-off hydraulic cylinder. Then, in Step P40, a feeding start command is outputted to the feeder 10.

Then, in Step P41, a printing start command is outputted to the intaglio printing unit 11. Then, in Step P42, the printing rotational speed is loaded from the memory M104.

Then, in Step P43, the memory M119 for storing the command rotational speed is overwritten with the printing rotational speed. Then, in Step P44, the command rotational speed is loaded from the memory M119.

Then, in Step P45, the rotational speed ratio of the wiping roll 20 is loaded from the memory M105. Then, in Step P46, the command rotational speed is multiplied by the rotational speed ratio of the wiping roll 20 to compute the command rotational speed of the wiping roll drive motor 40, which is stored into the memory M120.

Then, in Step P47, the command rotational speed is loaded from the memory M119. Then, in Step P48, the command rotational speed is outputted to the prime motor driver 138 via the D/A converter 137.

Then, in Step P49, the command rotational speed of the wiping roll drive motor 40 is loaded from the memory M120. Then, in Step P50, the command rotational speed of the wiping roll drive motor 40 is outputted to the wiping roll drive motor driver 144 via the D/A converter 143.

Then, in Step P51, output from the F/V converter 141 connected to the rotary encoder 142 for the prime motor is loaded via the A/D converter 140, and stored into the memory M121. Then, in Step P52, the present rotational speed of the intaglio printing press is computed from the output of F/V converter 141 connected to the rotary encoder 142 for the prime motor, and stored into the memory M122.

Then, in Step P53, the command rotational speed is loaded from the memory M119. Then, in Step P54, it is determined whether the present rotational speed of the intaglio printing press is equal to the command rotational speed.

If the answer is YES in the above Step P54, the electric current value is loaded from the wiping roll drive motor driver 144, and stored into the memory M123 for storing the present electric current value of the wiping roll drive motor, in Step P55. If the answer is NO in Step P54, the program returns to Step P47.

Then, in Step P56, the present electric current value of the wiping roll drive motor 40 is displayed on the present electric current value display unit 156 for the wiping roll drive motor. Then, in Step P57, the reference electric current value, at the start of printing, of the wiping roll drive motor 40 is loaded from the memory M118. Then follows Step P58 to subtract the reference electric current value, at the start of printing, of the wiping roll drive motor 40 from the present electric current value of the wiping roll drive motor 40, thereby computing a difference in the present electric current value of the wiping roll drive motor 40, and store it into the memory M124.

Then, in Step P59, the absolute value of the difference in the present electric current value of the wiping roll drive motor 40 is computed from the difference in the present electric current value of the wiping roll drive motor 40, and is stored into the memory M125. Then, in Step P60, tolerance for the difference in the present electric current value of the wiping roll drive motor 40 is loaded from the memory M126.

Then, in Step P61, it is determined whether the absolute value of the difference in the present electric current value of the wiping roll drive motor is equal to or less than the tolerance for the difference in the present electric current value of the wiping roll drive motor. If the answer is YES, the program shifts to Step P83 to be described later. If the answer is NO, the present electric current value of the wiping roll drive motor 40 is loaded from the memory M123 in Step P62.

Then, in Step P63, the reference electric current value, at the start of printing, of the wiping roll drive motor 40 is loaded from the memory M118. Then, in Step P64, it is determined whether the present electric current value of the wiping roll drive motor is greater than the reference electric current value, at the start of printing, of the wiping roll drive motor.

If the answer is YES in the above Step P64, a reverse rotation command is outputted to the wiping roll contact pressure adjusting motor driver 147 in Step P65. If the answer is NO in Step P64, the program shifts to Step P74 to be described later.

Then, in Step P66, the count value is loaded from the present position detecting counter 160 for the wiping roll contact pressure adjusting motor, and stored into the memory M134. Then, in Step P67, the present position of the wiping roll contact pressure adjusting motor 30 is computed from the count value of the present position detecting counter 160 for the wiping roll contact pressure adjusting motor, and stored into the memory M135.

Then, in Step P68, the present position of the wiping roll contact pressure adjusting motor 30 is displayed on the present position display unit 157 for the wiping roll contact pressure adjusting motor. Then, in Step P69, the electric current value is loaded from the wiping roll drive motor driver 144, and stored into the memory M123 for storing the present electric current value of the wiping roll drive motor.

Then, in Step P70, the present electric current value of the wiping roll drive motor 40 is displayed on the present electric current value display unit 156 for the wiping roll drive motor. Then, in Step P71, the reference electric current value, at the start of printing, of the wiping roll drive motor 40 is loaded from the memory M118.

Then, in Step P72, it is determined whether the present electric current value of the wiping roll drive motor is equal to the reference electric current value, at the start of printing, of the wiping roll drive motor. If the answer is YES, outputting of the reverse rotation command to the wiping roll contact pressure adjusting motor driver 147 is stopped in Step P73. Then, the program shifts to Step P83 to be described later. If the answer is NO in Step P72, the program returns to Step P66.

Then, in the above-mentioned Step P74, a forward rotation command is outputted to the wiping roll contact pressure adjusting motor driver 147. Then, in Step P75, the count value is loaded from the present position detecting counter 160 for the wiping roll contact pressure adjusting motor, and stored into the memory M134. Then, in Step P76, the present position of the wiping roll contact pressure adjusting motor 30 is computed from the count value of the present position detecting counter 160 for the wiping roll contact pressure adjusting motor, and stored into the memory M135.

Then, in Step P77, the present position of the wiping roll contact pressure adjusting motor 30 is displayed on the present position display unit 157 for the wiping roll contact pressure adjusting motor. Then, in Step P78, the electric current value is loaded from the wiping roll drive motor driver 144, and stored into the memory M123 for storing the present electric current value of the wiping roll drive motor.

Then, in Step P79, the present electric current value of the wiping roll drive motor 40 is displayed on the present electric current value display unit 156 for the wiping roll drive motor. Then, in Step P80, the reference electric current value, at the start of printing, of the wiping roll drive motor 40 is loaded from the memory M118.

Then, in Step P81, it is determined whether the present electric current value of the wiping roll drive motor is equal to the reference electric current value, at the start of printing, of the wiping roll drive motor. If the answer is YES, Step P82 is executed to stop outputting of the forward rotation command to the wiping roll contact pressure adjusting motor driver 147, and the program shifts to Step P83 to be described later. If the answer is NO in Step P81, the program returns to Step P75.

In accordance with the above-described action flow, the contact pressure of the wiping roll 20 is adjusted to the reference electric current value, at the start of printing, of the wiping roll drive motor 40.

Then, in the above-mentioned Step P83, a lighting command is outputted to the drive device 158 for the LED for displaying contact pressure adjustment preparation completion for the wiping roll. Then, in Step P84, it is determined whether the contact pressure increasing switch 150 has been turned on. If the answer is YES, a forward rotation command is outputted to the wiping roll contact pressure adjusting motor driver 147 in Step P85. If the answer is NO, the program shifts to Step P93 to be described later.

Then, in Step P86, the count value is loaded from the present position detecting counter 160 for the wiping roll contact pressure adjusting motor, and stored into the memory M134. Then, in Step P87, the present position of the wiping roll contact pressure adjusting motor 30 is computed from the count value of the present position detecting counter 160 for the wiping roll contact pressure adjusting motor, and stored into the memory M135.

Then, in Step P88, the present position of the wiping roll contact pressure adjusting motor 30 is displayed on the present position display unit 157 for the wiping roll contact pressure adjusting motor. Then, in Step P89, the electric current value is loaded from the wiping roll drive motor driver 144, and stored into the memory M123 for storing the present electric current value of the wiping roll drive motor.

Then, in Step P90, the present electric current value of the wiping roll drive motor 40 is displayed on the present electric current value display unit 156 for the wiping roll drive motor. Then, in Step P91, it is determined whether the contact pressure increasing switch 150 has been turned off. If the answer is YES, outputting of the forward rotation command to the wiping roll contact pressure adjusting motor driver 147 is stopped in Step P92. If the answer is NO in Step P91, the program returns to Step P86.

Then, in the aforementioned Step P93, it is determined whether the contact pressure decreasing switch 151 has been turned on. If the answer is YES, a reverse rotation command is outputted to the wiping roll contact pressure adjusting motor driver 147 in Step P94. If the answer is NO, the program shifts to Step P102 to be described later.

Then, in Step P95, the count value is loaded from the present position detecting counter 160 for the wiping roll contact pressure adjusting motor, and stored into the memory M134. Then, in Step P96, the present position of the wiping roll contact pressure adjusting motor 30 is computed from the count value of the present position detecting counter 160 for the wiping roll contact pressure adjusting motor, and stored into the memory M135.

Then, in Step P97, the present position of the wiping roll contact pressure adjusting motor 30 is displayed on the present position display unit 157 for the wiping roll contact pressure adjusting motor. Then, in Step P98, the electric current value is loaded from the wiping roll drive motor driver 144, and stored into the memory M123 for storing the present electric current value of the wiping roll drive motor.

Then, in Step P99, the present electric current value of the wiping roll drive motor 40 is displayed on the present electric current value display unit 156 for the wiping roll drive motor. Then, in Step P100, it is determined whether the contact pressure decreasing switch 151 has been turned off. If the answer is YES, outputting of the reverse rotation command to the wiping roll contact pressure adjusting motor driver 147 is stopped in Step P101. If the answer is NO in Step P100, the program returns to Step P95.

Then, in Step P102, it is determined whether the contact pressure adjustment completion switch 152 for the wiping roll has been turned on. If the answer is YES, the electric current value is loaded from the wiping roll drive motor driver 144, and stored into the memory M118 for storing the reference electric current value, at the start of printing, of the wiping roll drive motor, in Step P103. Then, outputting of the lighting command to the drive device 158 for the LED for displaying contact pressure adjustment preparation completion for the wiping roll is stopped in Step P104. If the answer is NO in Step P102, the program returns to Step P84. In accordance with the above-described action flow, the contact pressure of the wiping roll 20 is finely adjusted, with the operator performing visual check and operation.

Then, in Step 9105, the type of ink is loaded from the memory M100. Then follows Step P106 to load the type of the material to be printed from the memory M101. Then, the type of image is loaded from the memory M102 in Step P107, whereafter the material for the wiping roll 20 is loaded from the memory M103 in Step P108.

Then, in Step P109, the third correction value, at the start of printing, of the reference electric current value of the wiping roll drive motor is loaded from the memory M114. Then, in Step P110, the fourth correction value, at the start of printing, of the reference electric current value of the wiping roll drive motor is loaded from the memory M117.

Then, in Step P111, the reference electric current value, at the start of printing, of the wiping roll drive motor is loaded from the memory M118. Then, in Step P112, the printing rotational speed is loaded from the memory M104.

Then, in Step P113, the rotational speed ratio of the wiping roll is loaded from the memory M105. Then, in Step P114, the type of ink, the type of the material to be printed, the type of image, the material for the wiping roll 20, the third correction value, at the start of printing, of the reference electric current value of the wiping roll drive motor 40, the fourth correction value, at the start of printing, of the reference electric current value of the wiping roll drive motor 40, the reference electric current value, at the start of printing, of the wiping roll drive motor 40, the printing rotational speed, and the rotational speed ratio of the wiping roll 20 are additionally stored into the memory M136 for storing the reference electric current value of the wiping roll drive motor conformed to the printing conditions.

In accordance with the above-described action flow, various data at the time of reprinting are written into the memory M136 for storing the reference electric current value of the wiping roll drive motor conformed to the printing conditions.

Then, in Step P115, the material for the wiping roll 20 is loaded from the memory M103. Then, in Step P116, the table of conversion from the surface temperature of the wiping roll to the reference electric current value of the wiping roll drive motor conformed to the material for the wiping roll 20 is loaded from the memory M112.

Then, in Step P117, the surface temperature of the wiping roll is loaded from the surface temperature measuring unit 132 for the wiping roll via the A/D converter 131, and stored into the memory M127 for storing the present surface temperature of the wiping roll. Then, in Step P118, the present third correction value of the reference electric current value of the wiping roll drive motor 40 is obtained from the present surface temperature of the wiping roll by use of the table of conversion from the surface temperature of the wiping roll to the reference electric current value of the wiping roll drive motor conformed to the material for the wiping roll 20, and the obtained value is stored into the memory M128.

Then, in Step P119, the third correction value, at the start of printing, of the reference electric current value of the wiping roll drive motor 40 is loaded from the memory M114. Then, in Step P120, the third correction value, at the start of printing, of the reference electric current value of the wiping roll drive motor 40 is subtracted from the present third correction value of the reference electric current value of the wiping roll drive motor 40 to compute the difference in the present third correction value of the reference electric current value of the wiping roll drive motor 40, and the computed value is stored into the memory M129.

Then, in Step P121, the material for the wiping roll 20 is loaded from the memory M103. Then, in Step P122, the table of conversion from room temperature to the reference electric current value of the wiping roll drive motor conformed to the material for the wiping roll 20 is loaded from the memory M115.

Then, in Step P123, room temperature is loaded from the room temperature measuring unit 134 via the A/D converter 133, and stored into the memory M130 for storing present room temperature. Then, in Step P124, the present fourth correction value of the reference electric current value of the wiping roll drive motor 40 is obtained from the present room temperature by use of the table of conversion from room temperature to the reference electric current value of the wiping roll drive motor conformed to the material for the wiping roll 20, and the obtained value is stored into the memory M131.

Then, in Step P125, the fourth correction value, at the start of printing, of the reference electric current value of the wiping roll drive motor 40 is loaded from the memory M117. Then, in Step p126, the fourth correction value, at the start of printing, of the reference electric current value of the wiping roll drive motor 40 is subtracted from the present fourth correction value of the reference electric current value of the wiping roll drive motor 40 to compute the difference in the present fourth correction value of the reference electric current value of the wiping roll drive motor 40, and the computed value is stored into the memory M132.

Then, in Step P127, the reference electric current value, at the start of printing, of the wiping roll drive motor 40 is loaded from the memory M118. Then, in Step P128, the difference in the present third correction value of the reference electric current value of the wiping roll drive motor 40 is loaded from the memory M129.

Then, in Step P129, the difference in the present fourth correction value of the reference electric current value of the wiping roll drive motor 40 is loaded from the memory M132. Then, in Step P130, the difference in the present third correction value of the reference electric current value of the wiping roll drive motor 40 and the difference in the present fourth correction value of the reference electric current value of the wiping roll drive motor 40 are added to the reference electric current value, at the start of printing, of the wiping roll drive motor 40 to compute the present reference electric current value of the wiping roll drive motor 40, and the compute value is stored into the memory M133.

In accordance with the above-described action flow, the optimum present reference electric current value of the wiping roll drive motor 40 conformed to the surface temperature of the wiping roll 20 and room temperature during printing is computed.

Then, in Step P131, it is determined whether the intaglio printing press drive stop switch 121 has been turned on. If the answer is YES, a feeding stop command is outputted to the feeder 10 in Step P132. If the answer is NO, the program shifts to Step P137 to be described later.

Then, in Step P133, a printing stop command is outputted to the intaglio printing unit 11. Then, in Step P134, a throw-off command is outputted to the drive device 135 for the wiping roll throw-on and throw-off hydraulic cylinder.

Then, in Step P135, a stop command is outputted to the prime motor driver 138. Then, in Step P136, a stop command is outputted to the wiping roll drive motor driver 144.

Then, in Step P137, the electric current value is loaded from the wiping roll drive motor driver 144, and stored into the memory M123 for storing the present electric current value of the wiping roll drive motor. Then, in Step P138, the present electric current value of the wiping roll drive motor 40 is displayed on the present electric current value display unit 156 for the wiping roll drive motor.

Then, in Step P139, the present reference electric current value of the wiping roll drive motor 40 is loaded from the memory M133. Then, in Step P140, the present reference electric current value of the wiping roll drive motor 40 is subtracted from the present electric current value of the wiping roll drive motor 40 to compute the difference in the present electric current value of the wiping roll drive motor 40, and the computed value is stored into the memory M124.

Then, in Step P141, the absolute value of the difference in the present electric current value of the wiping roll drive motor 40 is computed from the difference in the present electric current value of the wiping roll drive motor 40, and stored into the memory M125. Then, in Step P142, tolerance for the difference in the present electric current value of the wiping roll drive motor 40 is loaded from the memory M126.

Then, in Step P143, it is determined whether the absolute value of the difference in the present electric current value of the wiping roll drive motor is equal to or less than the tolerance for the difference in the present electric current value of the wiping roll drive motor. If the answer is YES, the program returns to Step P115. If the answer is NO in Step P143, the present electric current value of the wiping roll drive motor 40 is loaded from the memory M123 in Step P144.

Then, in Step P145, the present reference electric current value of the wiping roll drive motor 40 is loaded from the memory M133. Then, in Step P146, it is determined whether the present electric current value of the wiping roll drive motor is greater than the present reference electric current value of the wiping roll drive motor.

If the answer is YES in the above Step P146, a reverse rotation command is outputted to the wiping roll contact pressure adjusting motor driver 147 in Step P147. If the answer is NO in Step P146, the program shifts to Step P156 to be described later.

Then, in Step P148, the count value is loaded from the present position detecting counter 160 for the wiping roll contact pressure adjusting motor, and stored into the memory M134. Then, in Step P149, the present position of the wiping roll contact pressure adjusting motor 30 is computed from the count value of the present position detecting counter 160 for the wiping roll contact pressure adjusting motor, and stored into the memory M135.

Then, in Step P150, the present position of the wiping roll contact pressure adjusting motor 30 is displayed on the present position display unit 157 for the wiping roll contact pressure adjusting motor. Then, in Step P151, the electric current value is loaded from the wiping roll drive motor driver 144, and stored into the memory M123 for storing the present electric current value of the wiping roll drive motor.

Then, in Step P152, the present electric current value of the wiping roll drive motor 40 is displayed on the present electric current value display unit 156 for the wiping roll drive motor. Then, in Step P153, the reference electric current value, at the start of printing, of the wiping roll drive motor 40 is loaded from the memory M118.

Then, in Step P154, it is determined whether the present electric current value of the wiping roll drive motor is equal to the reference electric current value, at the start of printing, of the wiping roll drive motor. If the answer is YES, outputting of the reverse rotation command to the wiping roll contact pressure adjusting motor driver 147 is stopped in Step P155. Then, the program returns to the aforementioned Step P115. If the answer is NO in Step P154, the program returns to Step P148.

Then, in the above-mentioned Step P156, a forward rotation command is outputted to the wiping roll contact pressure adjusting motor driver 147. Then follows Step P157 to load the count value from the present position detecting counter 160 for the wiping roll contact pressure adjusting motor, and store it into the memory M134. Then, in Step P158, the present position of the wiping roll contact pressure adjusting motor 30 is computed from the count value of the present position detecting counter 160 for the wiping roll contact pressure adjusting motor, and stored into the memory M135.

Then, in Step P159, the present position of the wiping roll contact pressure adjusting motor 30 is displayed on the present position display unit 157 for the wiping roll contact pressure adjusting motor. Then, in Step P160, the electric current value is loaded from the wiping roll drive motor driver 144, and stored into the memory M123 for storing the present electric current value of the wiping roll drive motor.

Then, in Step P161, the present electric current value of the wiping roll drive motor 40 is displayed on the present electric current value display unit 156 for the wiping roll drive motor. Then, in Step P162, the reference electric current value, at the start of printing, of the wiping roll drive motor 40 is loaded from the memory M118.

Then, in Step P163, it is determined whether the present electric current value of the wiping roll drive motor is equal to the reference electric current value, at the start of printing, of the wiping roll drive motor. If the answer is YES, outputting of the forward rotation command to the wiping roll contact pressure adjusting motor driver 147 is stopped in Step P164, and the program returns to the aforementioned Step P115. If the answer is NO in Step P163, the program returns to Step P157.

In accordance with the above-described action flow, the wiping roll contact pressure adjusting motor 30 is automatically drivingly controlled so that the wiping roll 20 is always pressed, at optimum contact pressure, against the intaglio cylinder 17 during the steady-state operation of the intaglio printing press.

Next, at the time of reprinting, it is determined in the above-mentioned Step P165 whether input is present in the ink type setting unit 125. If the answer is YES, in Step P166, the type of ink is loaded from the ink type setting unit 125, and stored into the memory M100. Then, the program shifts to Step P167. If the answer is NO in Step P165, the program directly shifts to Step P167.

Then, in Step P167, it is determined whether input is present in the type setting unit 126 for the material to be printed. If the answer is YES, in Step P168, the type of the material to be printed is loaded from the type setting unit 126 for the material to be printed, and stored into the memory M101. Then, the program shifts to Step P169. If the answer is NO in Step P167, the program directly shifts to Step P169.

Then, in the above Step P169, it is determined whether input is present in the image type setting unit 127. If the answer is YES, the type of image is loaded from the image type setting unit 127, and stored into the memory M102, in Step P170. Then, the program shifts to Step P171. If the answer is NO in Step P169, the program directly shifts to Step P171.

Then, in Step P171, it is determined whether input is present in the material setting unit 128 for the wiping roll. If the answer is YES, in Step P172, the material for the wiping roll 20 is loaded from the material setting unit 128 for the wiping roll, and stored into the memory M103. Then, the program shifts to Step P173. If the answer is NO in Step P171, the program directly shifts to Step P173.

Then, in Step P173, it is determined whether the printing preparation start switch 155 has been turned on. If the answer is YES, the count value M of the memory M137 is overwritten with 1 in Step P174. If the answer is NO in Step P173, the program returns to Step P165.

Then, in Step P175, the Mth type of ink is loaded from the position for storage of the Mth type of ink in the memory M136 for storing the reference electric current value of the wiping roll drive motor conformed to the printing conditions. Then in Step P176, the type of ink is loaded from the memory M100.

Then, in Step P177, it is determined whether the Mth type of ink is the same as the type of ink. If the answer is YES, in Step P178, the Mth type of the material to be printed is loaded from the position for storage of the Mth type of the material to be printed in the memory M136 for storing the reference electric current value of the wiping roll drive motor conformed to the printing conditions. If the answer is NO in Step P177, the program shifts to Step P187 to be described later.

Then, in Step P179, the type of the material to be printed is loaded from the memory M101. Then, in Step P180, it is determined whether the Mth type of the material to be printed is the same as the type of the material to be printed. If the answer is YES, in Step P181, the Mth type of image is loaded from the position for storage of the Mth type of image in the memory M136 for storing the reference electric current value of the wiping roll drive motor conformed to the printing conditions. If the answer is NO in Step P180, the program shifts to Step P187 to be described later.

Then, in Step P182, the type of image is loaded from the memory M102. Then, in Step P183, it is determined whether the Mth type of image is the same as the type of image. If the answer is YES, in Step P184, the Mth material for the wiping roll 20 is loaded from the position for storage of the Mth material for the wiping roll 20 in the memory M136 for storing the reference electric current value of the wiping roll drive motor conformed to the printing conditions. If the answer is NO in Step P183, the program shifts to Step P187 to be described later.

Then, in Step P185, the material for the wiping roll 20 is loaded from the memory M103. Then, in Step P186, it is determined whether the Mth material for the wiping roll is the same as the material for the wiping roll. If the answer is YES, the program shifts to Step P193 to be described later. If the answer is NO in Step P186, the count value M is loaded from the memory M137 in the above mentioned Step P187.

Then, in Step P188, the total number of the printing conditions storable into the memory M136 for storing the reference electric current value of the wiping roll drive motor conformed to the printing conditions is loaded from the memory M138. Then, in Step P189, it is determined whether the count value M is equal to the total number of the printing conditions storable into the memory for storing the reference electric current value of the wiping roll drive motor conformed to the printing conditions.

If the answer is YES in the above Step P189, an error message is displayed on the display unit 123 in Step P190. If the answer is NO in Step P189, the count value M is loaded from the memory M137 in Step P191. Then, in Step P192, 1 is added to the count value M, and the memory M137 for storing the count value M is overwritten with the resulting sum. Then, the program returns to Step P175.

Then, in the above-mentioned Step P193, the third correction value, at the start of printing, of the Mth reference electric current value of the wiping roll drive motor 40 is loaded from the position for storage of the third correction value, at the start of printing, of the Mth reference electric current value of the wiping roll drive motor 40 in the memory M136 for storing the reference electric current value of the wiping roll drive motor conformed to the printing conditions, and the loaded value is stored into the memory M114 for storing the third correction value, at the start of printing, of the reference electric current value of the wiping roll drive motor.

Then, in Step P194, the fourth correction value, at the start of printing, of the Mth reference electric current value of the wiping roll drive motor is loaded from the position for storage of the fourth correction value, at the start of printing, of the Mth reference electric current value of the wiping roll drive motor 40 in the memory M136 for storing the reference electric current value of the wiping roll drive motor conformed to the printing conditions, and the loaded value is stored into the memory M117 for storing the fourth correction value, at the start of printing, of the reference electric current value of the wiping roll drive motor.

Then, in Step P195, the Mth printing rotational speed is loaded from the position for storage of the Mth printing rotational speed in the memory M136 for storing the reference electric current value of the wiping roll drive motor conformed to the printing conditions, and the loaded value is stored into the memory M104 for storing the printing rotational speed. Then, in Step P196, the Mth rotational speed ratio of the wiping roll is loaded from the position for storage of the Mth rotational speed ratio of the wiping roll in the memory M136 for storing the reference electric current value of the wiping roll drive motor conformed to the printing conditions, and the loaded value is stored into the memory M105 for storing the rotational speed ratio of the wiping roll.

Then, in Step P197, the Mth reference electric current value, at the start of printing, of the wiping roll drive motor is loaded from the position for storage of the Mth reference electric current value, at the start of printing, of the wiping roll drive motor in the memory M136 for storing the reference electric current value of the wiping roll drive motor conformed to the printing conditions, and the loaded value is stored into the memory M118 for storing the reference electric current value, at the start of printing, of the wiping roll drive motor. Then, if the intaglio printing press drive switch 120 is turned on in Step P198, a throw-on command is outputted to the drive device 135 for the wiping roll throw-on and throw-off hydraulic cylinder in Step P199.

Then, in Step P200, a feeding start command is outputted to the feeder 10, whereafter in Step P201, a printing start command is outputted to the intaglio printing unit 11. Then, in Step P202, the printing rotational speed is loaded from the memory M104. Then, in Step P203, the memory M119 for storing the command rotational speed is overwritten with the printing rotational speed.

Then, in Step P204, the command rotational speed is loaded from the memory M119. Then, in Step P205, the rotational speed ratio of the wiping roll is loaded from the memory M105. Then, in Step P206, the command rotational speed is multiplied by the rotational speed ratio of the wiping roll to compute the command rotational speed of the wiping roll drive motor 40, which is stored into the memory M120. Then, in Step P207, the command rotational speed is loaded from the memory M119.

Then, in Step P208, the command rotational speed is outputted to the prime motor driver 138. Then, in Step P209, the command rotational speed of the wiping roll drive motor 40 is loaded from the memory M120. Then, in Step P210, the command rotational speed of the wiping roll drive motor 40 is outputted to the wiping roll drive motor driver 144. Afterwards, in Step P211, from the F/V converter 141 connected to the rotary encoder 142 for the prime motor, its output is loaded via the A/D converter 140, and stored into the memory M121.

Then, in Step P212, the present rotational speed of the intaglio printing press is computed from the output of the F/V converter 141 connected to the rotary encoder 142 for the prime motor, and the computed value is stored into the memory M122. Then, in Step P213, the command rotational speed is loaded from the memory M119. Then, in Step P214, it is determined whether the present rotational speed of the intaglio printing press is equal to the command rotational speed. If the answer is YES, the program shifts to Step P215 to be described later. If the answer is NO, the program returns to Step P207.

In accordance with the above-described action flow, the reference electric current value, at the start of printing, of the wiping roll drive motor 40 conformed to the printing conditions, which has been prestored, is loaded and set at the time of reprinting.

Then, in Step P215, the material for the wiping roll 20 is loaded from the memory M103. Then, in Step P216, the table of conversion from the surface temperature of the wiping roll to the reference electric current value of the wiping roll drive motor conformed to the material for the wiping roll 20 is loaded from the memory M112.

Then, in Step P217, the surface temperature of the wiping roll is loaded from the surface temperature measuring unit 132 for the wiping roll via the A/D converter 131, and stored into the memory M127 for storing the present surface temperature of the wiping roll. Then, in Step P218, the present third correction value of the reference electric current value of the wiping roll drive motor 40 is obtained from the present surface temperature of the wiping roll by use of the table of conversion from the surface temperature of the wiping roll to the reference electric current value of the wiping roll drive motor conformed to the material for the wiping roll 20, and the obtained value is stored into the memory M128.

Then, in Step P219, the third correction value, at the start of printing, of the reference electric current value of the wiping roll drive motor 40 is loaded from the memory M114. Then, in Step P220, the third correction value, at the start of printing, of the reference electric current value of the wiping roll drive motor 40 is subtracted from the present third correction value of the reference electric current value of the wiping roll drive motor 40 to compute the difference in the present third correction value of the reference electric current value of the wiping roll drive motor 40, and stored into the memory M129.

Then, in Step P221, the material for the wiping roll 20 is loaded from the memory M103. Then, in Step P222, the table of conversion from room temperature to the reference electric current value of the wiping roll drive motor conformed to the material for the wiping roll 20 is loaded from the memory M115.

Then, in Step P223, room temperature is loaded from the room temperature measuring unit 134 via the A/D converter 133, and stored into the memory M130 for storing present room temperature. Then, in Step P224, the present fourth correction value of the reference electric current value of the wiping roll drive motor 40 is obtained from the present room temperature by use of the table of conversion from room temperature to the reference electric current value of the wiping roll drive motor conformed to the material for wiping roll 20, and the obtained value is stored into the memory M131.

Then, in Step P225, the fourth correction value, at the start of printing, of the reference electric current value of the wiping roll drive motor 40 is loaded from the memory M117. Then, in Step P226, the fourth correction value, at the start of printing, of the reference electric current value of the wiping roll drive motor 40 is subtracted from the present fourth correction value of the reference electric current value of the wiping roll drive motor 40 to compute the difference in the present fourth correction value of the reference electric current value of the wiping roll drive motor 40, and the computed value is stored into the memory M132.

Then, in Step P227, the reference electric current value, at the start of printing, of the wiping roll drive motor 40 is loaded from the memory M118. Then, in Step P228, the difference in the present third correction value of the reference electric current value of the wiping roll drive motor 40 is loaded from the memory M129.

Then, in Step P229, the difference in the present fourth correction value of the reference electric current value of the wiping roll drive motor 40 is loaded from the memory M132. Then, in Step P230, the difference in the present third correction value of the reference electric current value of the wiping roll drive motor 40 and the difference in the present fourth correction value of the reference electric current value of the wiping roll drive motor 40 are added to the reference electric current value, at the start of printing, of the wiping roll drive motor 40 to compute the present reference electric current value of the wiping roll drive motor 40, which is stored into the memory M133.

In accordance with the above-described action flow, the optimum present reference electric current value of the wiping roll drive motor 40 conformed to the surface temperature of the wiping roll 20 and room temperature during printing is computed.

Then, in Step P231, it is determined whether the intaglio printing press drive stop switch 121 has been turned on. If the answer is YES, a feeding stop command is outputted to the feeder 10 in Step P132. If the answer is NO in Step P231, the program shifts to Step P237 to be described later.

Then, in Step P233, a printing stop command is outputted to the intaglio printing unit 11. Then, in Step P234, a throw-off command is outputted to the drive device 135 for the wiping roll throw-on and throw-off hydraulic cylinder.

Then, in Step P235, a stop command is outputted to the prime motor driver 138. Then, in Step P236, a stop command is outputted to the wiping roll drive motor driver 144.

Then, in Step P237, the electric current value is loaded from the wiping roll drive motor driver 144, and stored into the memory M123 for storing the present electric current value of the wiping roll drive motor. Then, in Step P238, the present electric current value of the wiping roll drive motor 40 is displayed on the present electric current value display unit 156 for the wiping roll drive motor.

Then, in Step P239, the present reference electric current value of the wiping roll drive motor 40 is loaded from the memory M133. Then, in Step P240, the present reference electric current value of the wiping roll drive motor 40 is subtracted from the present electric current value of the wiping roll drive motor 40 to compute the difference in the present electric current value of the wiping roll drive motor 40, and the computed value is stored into the memory M124.

Then, in Step P241, the absolute value of the difference in the present electric current value of the wiping roll drive motor 40 is computed from the difference in the present electric current value of the wiping roll drive motor 40, and stored into the memory M125. Then, in Step P242, tolerance for the difference in the present electric current value of the wiping roll drive motor 40 is loaded from the memory M126.

Then, in Step P243, it is determined whether the absolute value of the difference in the present electric current value of the wiping roll drive motor is equal to or less than the tolerance for the difference in the present electric current value of the wiping roll drive motor. If the answer is YES, the program returns to Step P215. If the answer is NO, the present electric current value of the wiping roll drive motor 40 is loaded from the memory M123 in Step P244.

Then, in Step P245, the present reference electric current value of the wiping roll drive motor 40 is loaded from the memory M133. Then, in Step P246, it is determined whether the present electric current value of the wiping roll drive motor is greater than the present reference electric current value of the wiping roll drive motor.

If the answer is YES in the above Step P246, a reverse rotation command is outputted to the wiping roll contact pressure adjusting motor driver 147 in Step P247. If the answer is NO in Step P246, the program shifts to Step P256 to be described later.

Then, in Step P248, the count value is loaded from the present position detecting counter 160 for the wiping roll contact pressure adjusting motor, and stored into the memory M134. Then, in Step P249, the present position of the wiping roll contact pressure adjusting motor 30 is computed from the count value of the present position detecting counter 160 for the wiping roll contact pressure adjusting motor, and the computed value is stored into the memory M135.

Then, in Step P250, the present position of the wiping roll contact pressure adjusting motor 30 is displayed on the present position display unit 157 for the wiping roll contact pressure adjusting motor. Then, in Step P251, the electric current value is loaded from the wiping roll drive motor driver 144, and stored into the memory M123 for storing the present electric current value of the wiping roll drive motor.

Then, in Step P252, the present electric current value of the wiping roll drive motor 40 is displayed on the present electric current value display unit 156 for the wiping roll drive motor. Then, in Step P253, the reference electric current value, at the start of printing, of the wiping roll drive motor 40 is loaded from the memory M118.

Then, in Step P254, it is determined whether the present electric current value of the wiping roll drive motor is equal to the reference electric current value, at the start of printing, of the wiping roll drive motor. If the answer is YES, outputting of the reverse rotation command to the wiping roll contact pressure adjusting motor driver 147 is stopped in Step P255. Then, the program returns to the aforementioned Step P215. If the answer is NO in Step P254, the program returns to Step P248.

Then, in the above-mentioned Step P256, a forward rotation command is outputted to the wiping roll contact pressure adjusting motor driver 147. Afterwards, in Step P257, the count value is loaded from the present position detecting counter 160 for the wiping roll contact pressure adjusting motor, and stored into the memory M134. Then, in Step P258, the present position of the wiping roll contact pressure adjusting motor 30 is computed from the count value of the present position detecting counter 160 for the wiping roll contact pressure adjusting motor, and the computed value is stored into the memory M135.

Then, in Step P259, the present position of the wiping roll contact pressure adjusting motor 30 is displayed on the present position display unit 157 for the wiping roll contact pressure adjusting motor. Then, in Step P260, the electric current value is loaded from the wiping roll drive motor driver 144, and stored into the memory M123 for storing the present electric current value of the wiping roll drive motor.

Then, in Step P261, the present electric current value of the wiping roll drive motor 40 is displayed on the present electric current value display unit 156 for the wiping roll drive motor. Then, in Step P262, the reference electric current value, at the start of printing, of the wiping roll drive motor 40 is loaded from the memory M118.

Then, in Step P263, it is determined whether the present electric current value of the wiping roll drive motor is equal to the reference electric current value, at the start of printing, of the wiping roll drive motor. If the answer is YES, in Step P264, outputting of the forward rotation command to the wiping roll contact pressure adjusting motor driver 147 is stopped, and the program returns to the aforementioned Step P215. If the answer is NO in Step P263, the program returns to Step P257.

In accordance with the above-described action flow, the wiping roll contact pressure adjusting motor 30 is automatically drivingly controlled so that the wiping roll 20 is always pressed, at optimum contact pressure, against the intaglio cylinder 17 during the steady-state operation of the intaglio printing press.

According to the present embodiment, as described above, the contact pressure of the wiping roll 20 is adjusted automatically and optimally in accordance with the preset printing conditions. Thus, the burden imposed on the operator is lessened, and a waste of printing materials such as paper and ink is reduced. In addition, the life of the wiping roll 20 can be lengthened.

During printing, moreover, the contact pressure of the wiping roll 20 is adjusted automatically in accordance with the surface temperature of the wiping roll 20 and room temperature. Thus, a waste of printing materials such as paper and ink is further reduced, and the life of the wiping roll 20 can be prolonged.

[Embodiment 2]

Figure 13A:
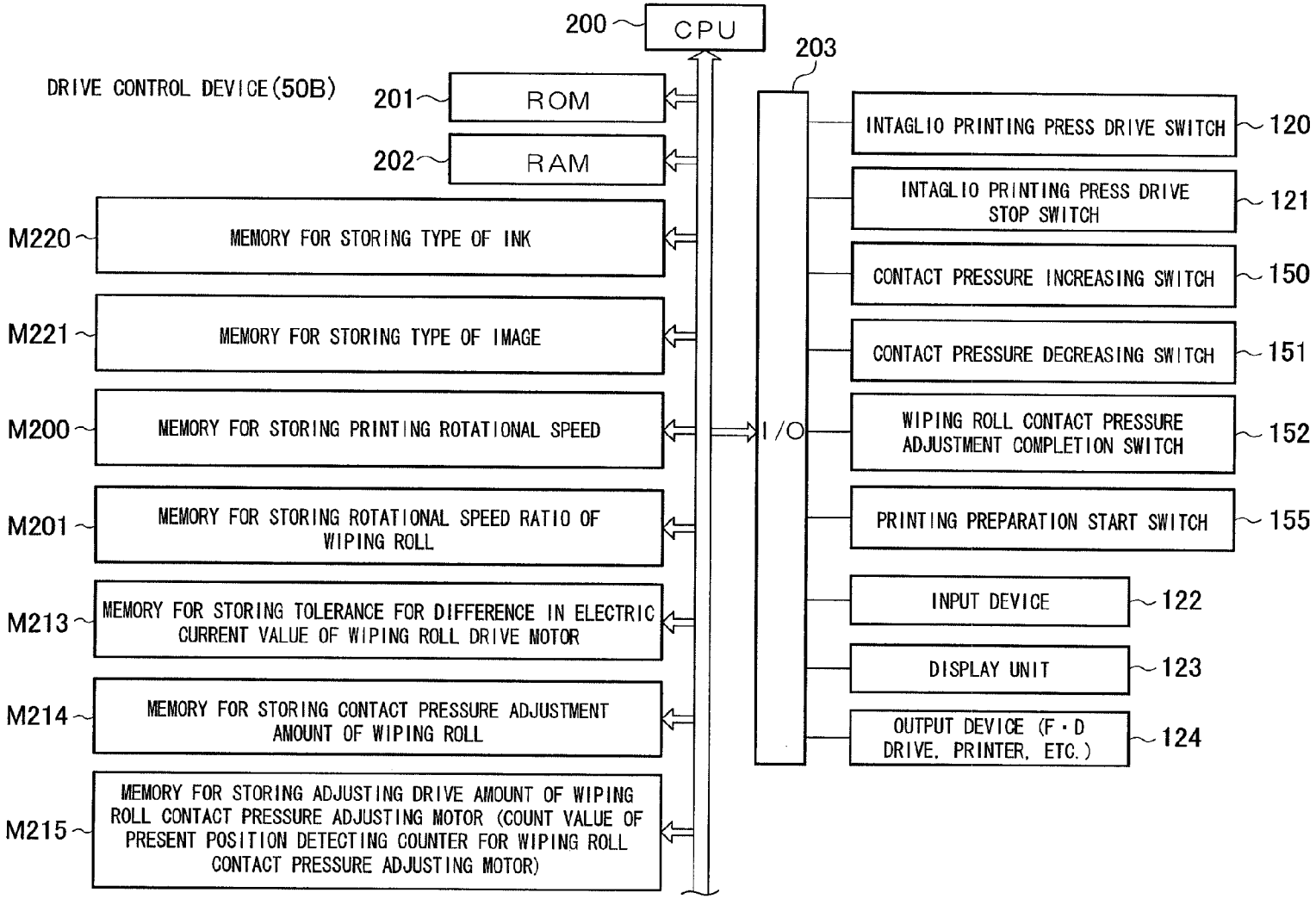
FIG. 13A is a hardware block diagram of a drive control device for a wiping roll drive motor and a wiping roll contact pressure adjusting motor in Embodiment 2 of the present invention.
Figure 13B:
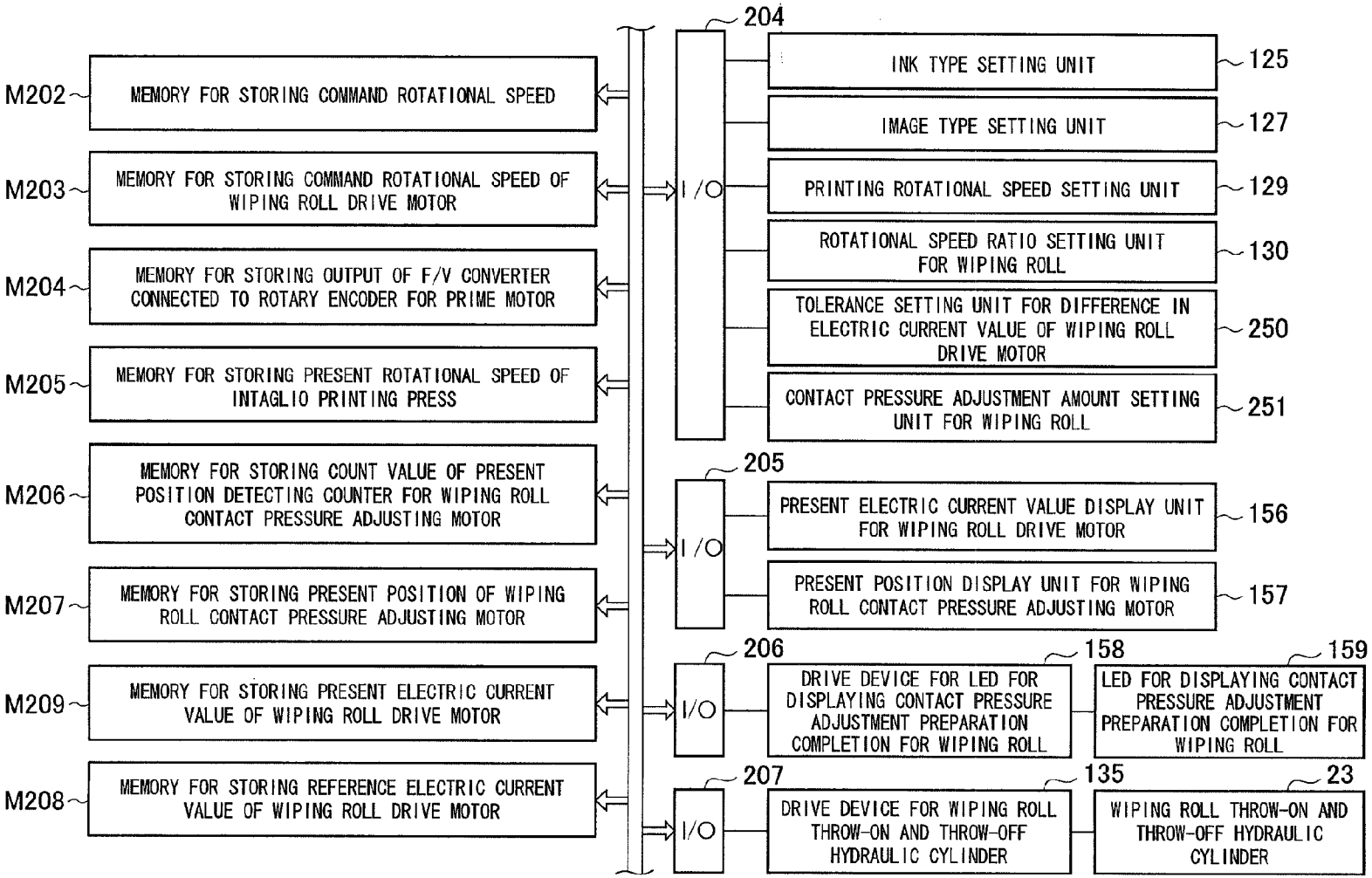
FIG. 13B is a hardware block diagram of the drive control device for the wiping roll drive motor and the wiping roll contact pressure adjusting motor in Embodiment 2 of the present invention.
Figure 13C:
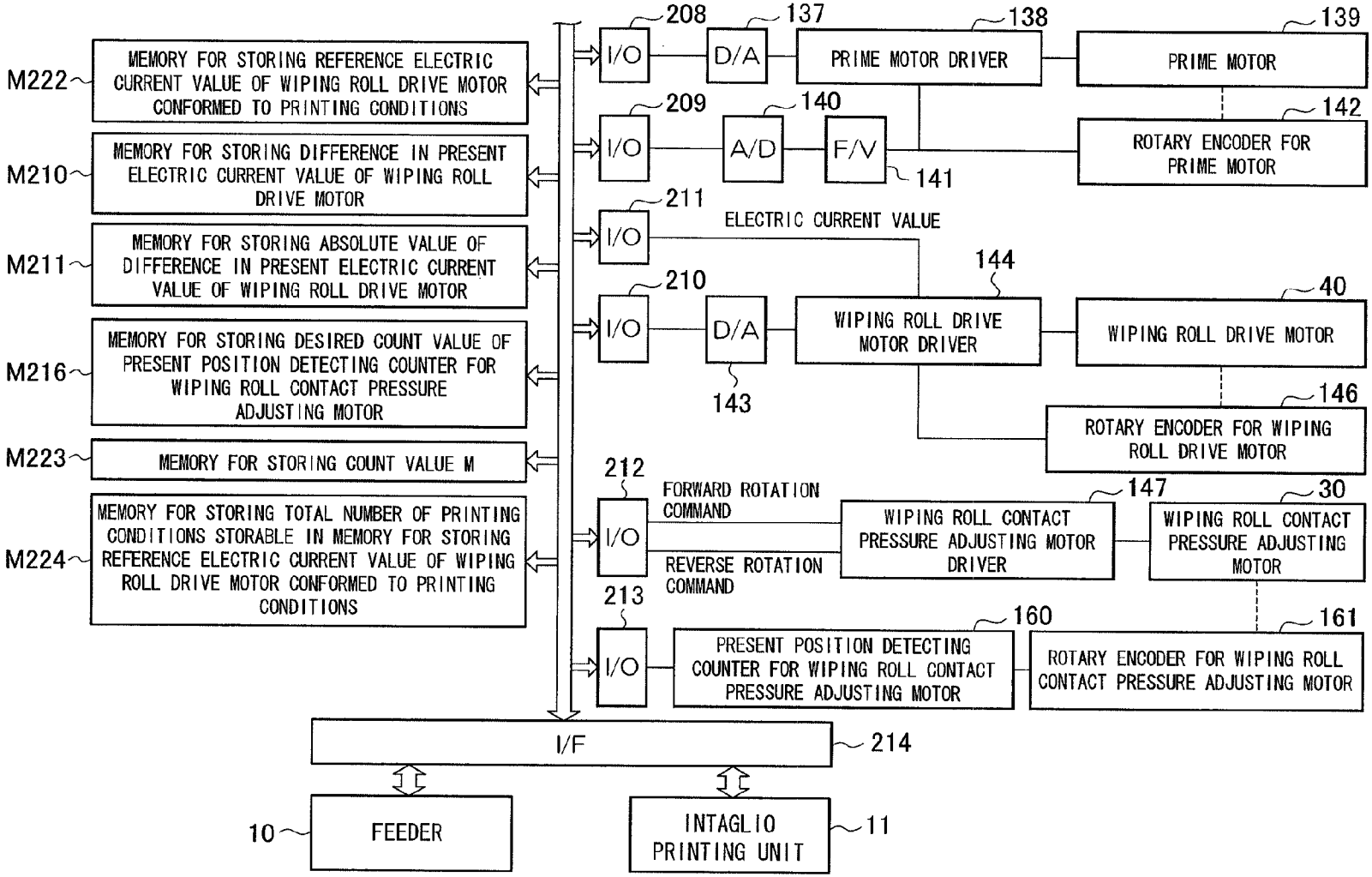
FIG. 13C is a hardware block diagram of the drive control device for the wiping roll drive motor and the wiping roll contact pressure adjusting motor in Embodiment 2 of the present invention.
Figure 14A:
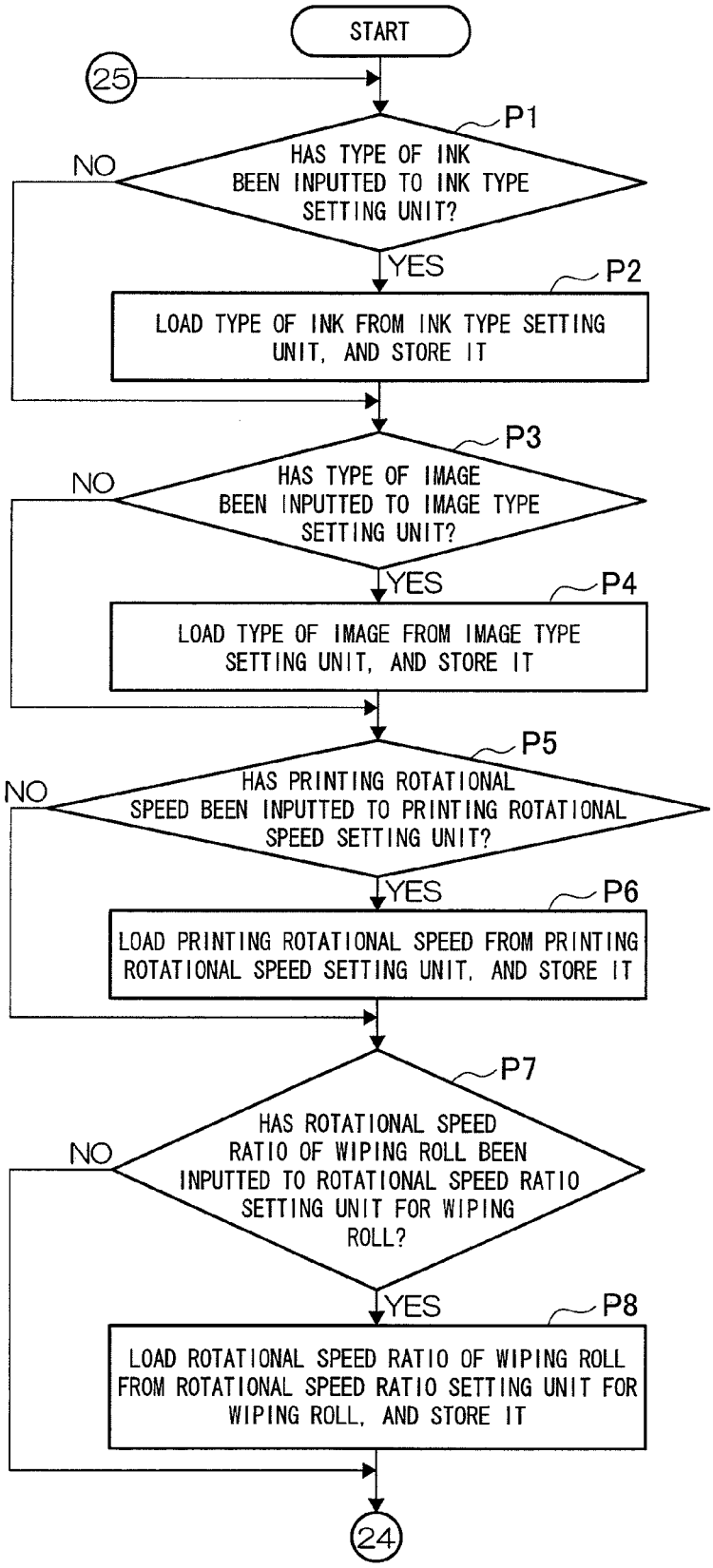
FIG. 14A is an action flow chart of the drive control device for the wiping roll drive motor and the wiping roll contact pressure adjusting motor in Embodiment 2 of the present invention.
Figure 14B:
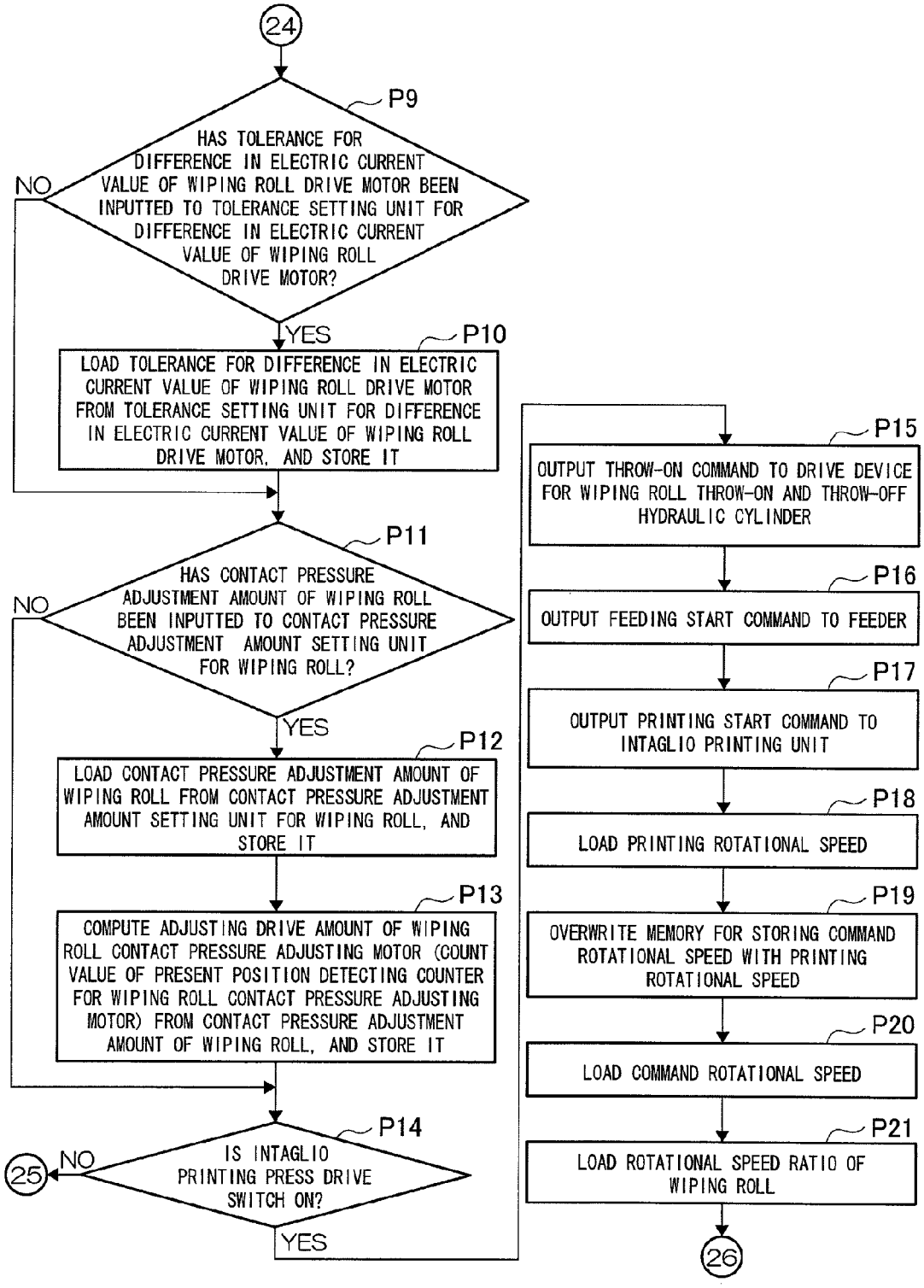
FIG. 14B is an action flow chart of the drive control device for the wiping roll drive motor and the wiping roll contact pressure adjusting motor in Embodiment 2 of the present invention.
Figure 14C:
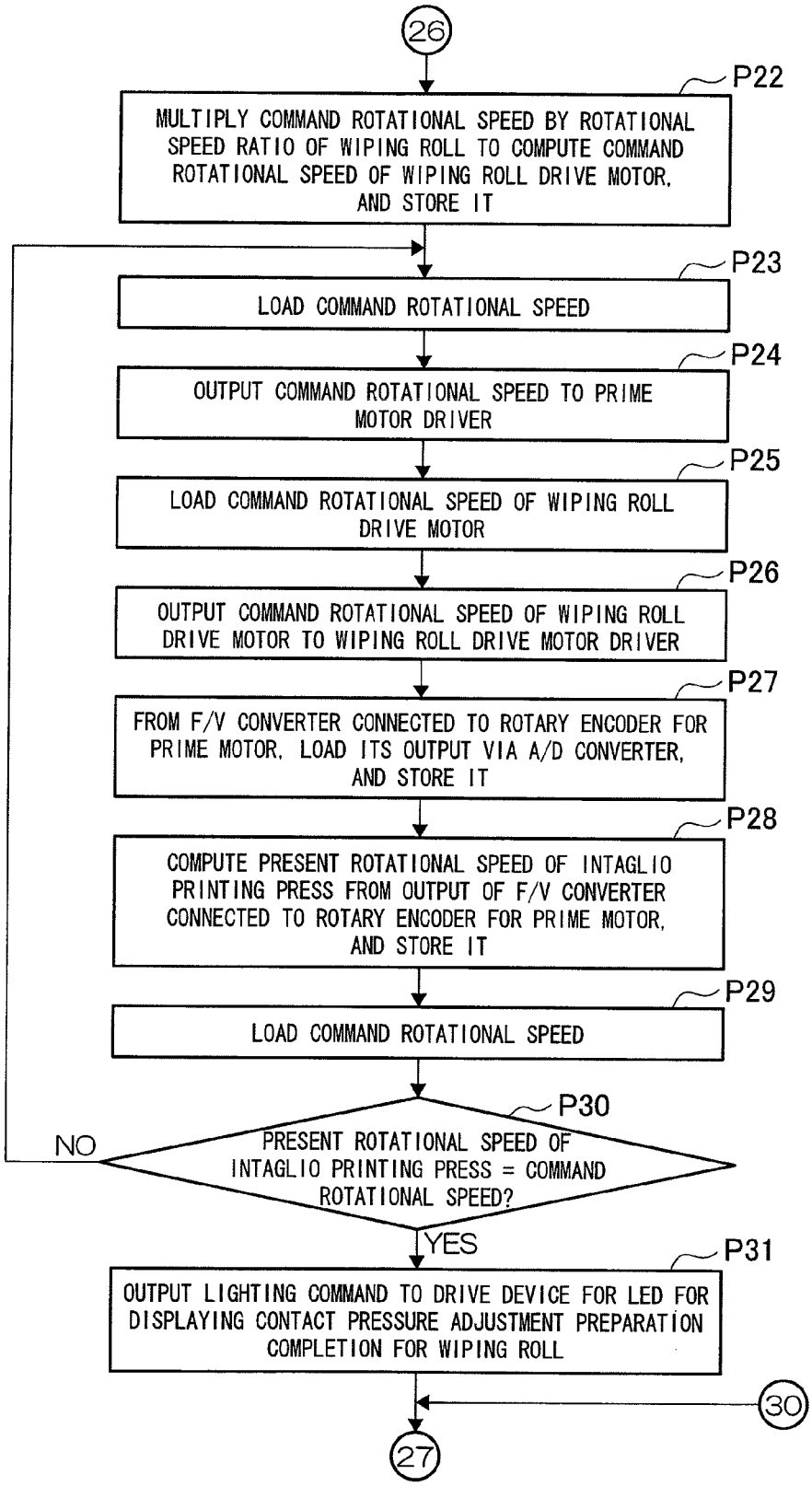
FIG. 14C is an action flow chart of the drive control device for the wiping roll drive motor and the wiping roll contact pressure adjusting motor in Embodiment 2 of the present invention.
Figure 14D:
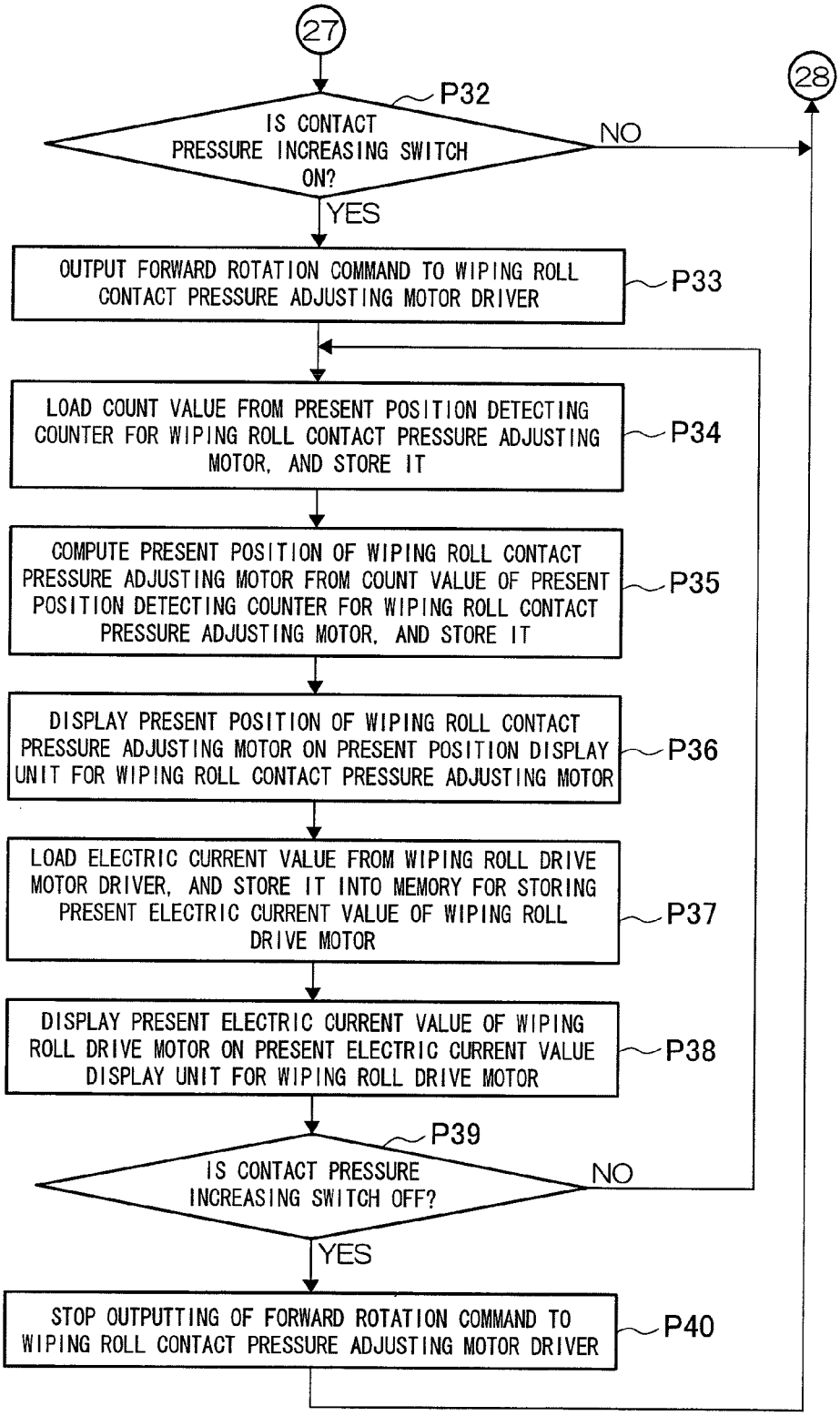
FIG. 14D is an action flow chart of the drive control device for the wiping roll drive motor and the wiping roll contact pressure adjusting motor in Embodiment 2 of the present invention.
Figure 14E:
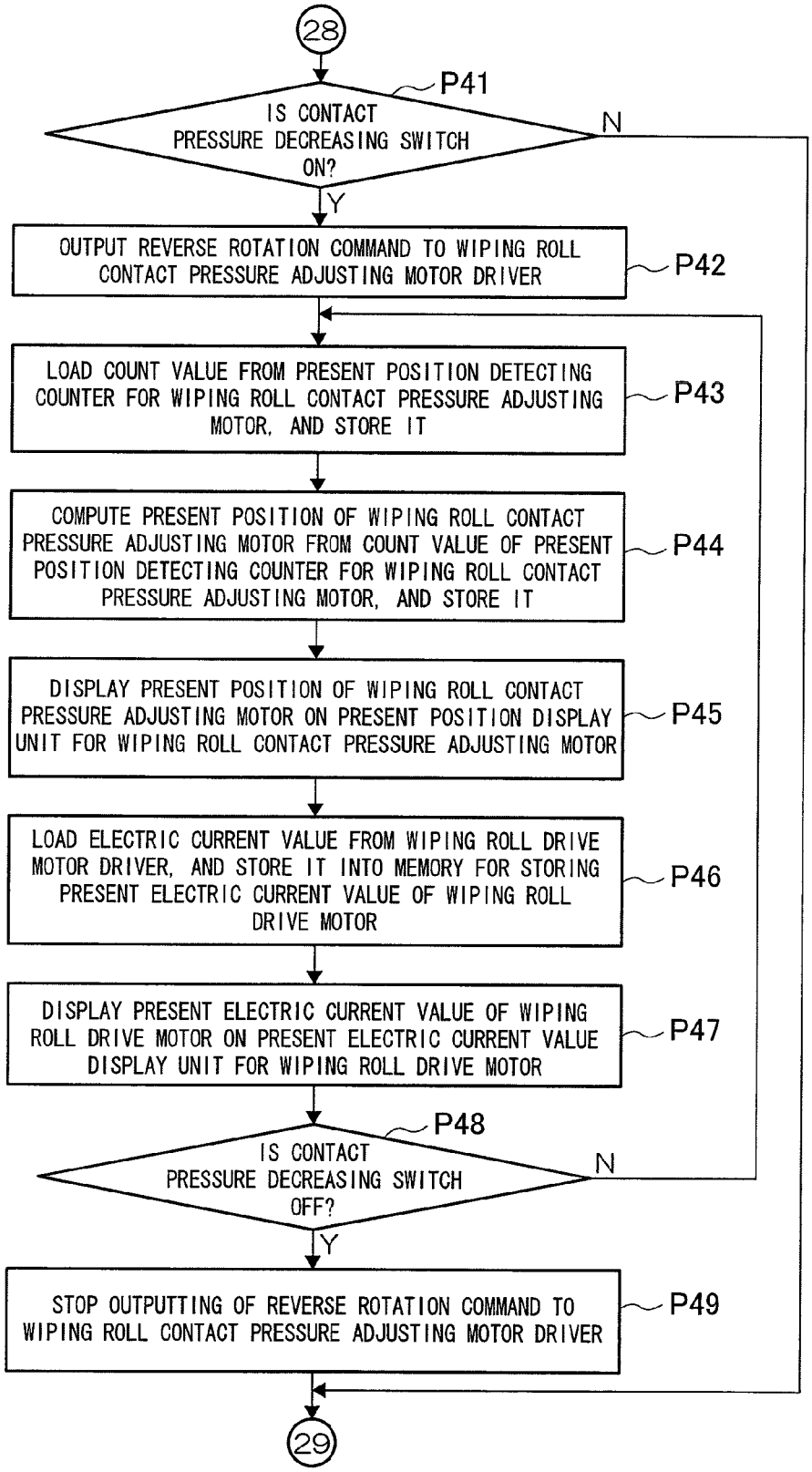
FIG. 14E is an action flow chart of the drive control device for the wiping roll drive motor and the wiping roll contact pressure adjusting motor in Embodiment 2 of the present invention.
Figure 14F:
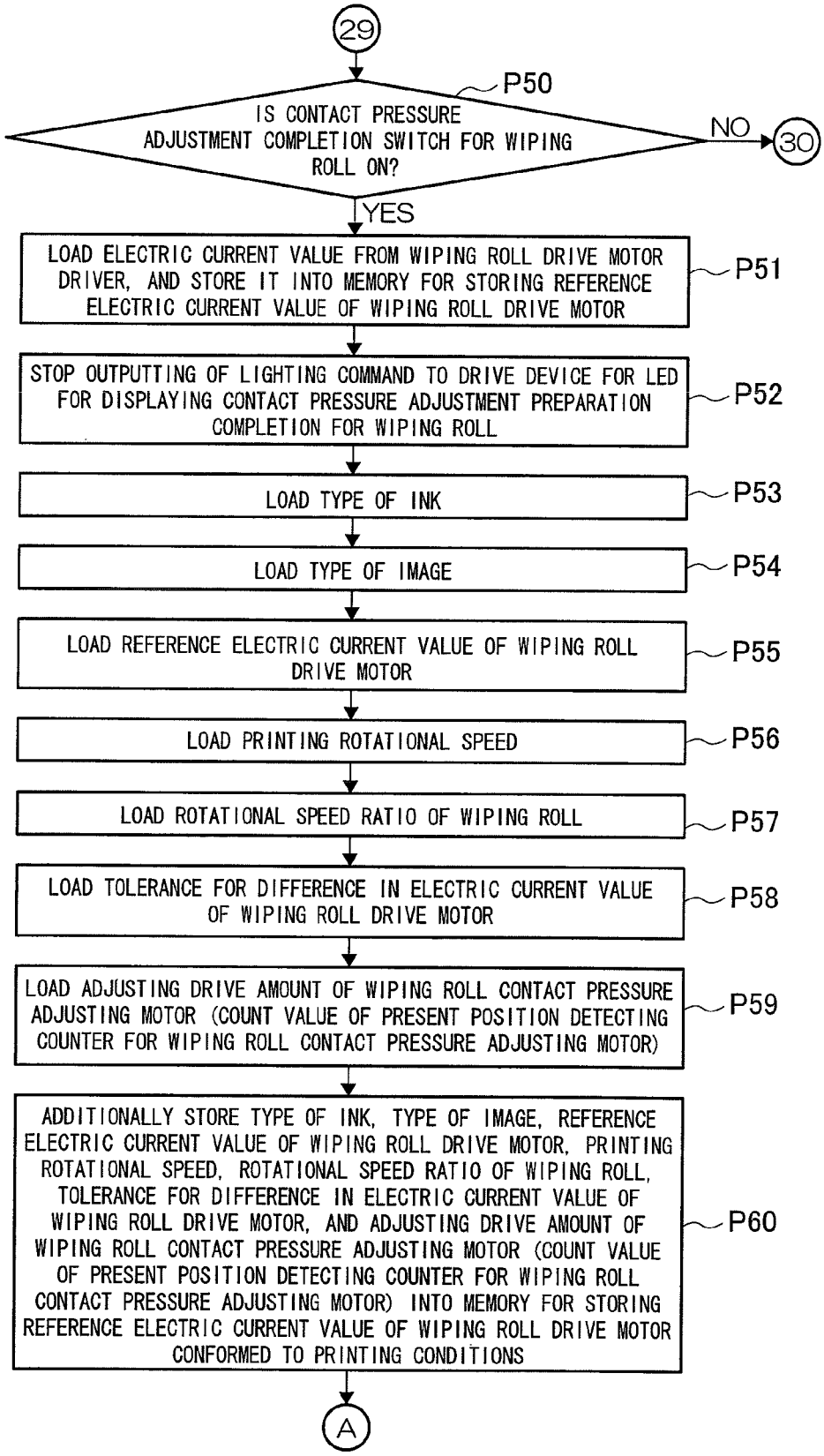
FIG. 14F is an action flow chart of the drive control device for the wiping roll drive motor and the wiping roll contact pressure adjusting motor in Embodiment 2 of the present invention.
Figure 15A:
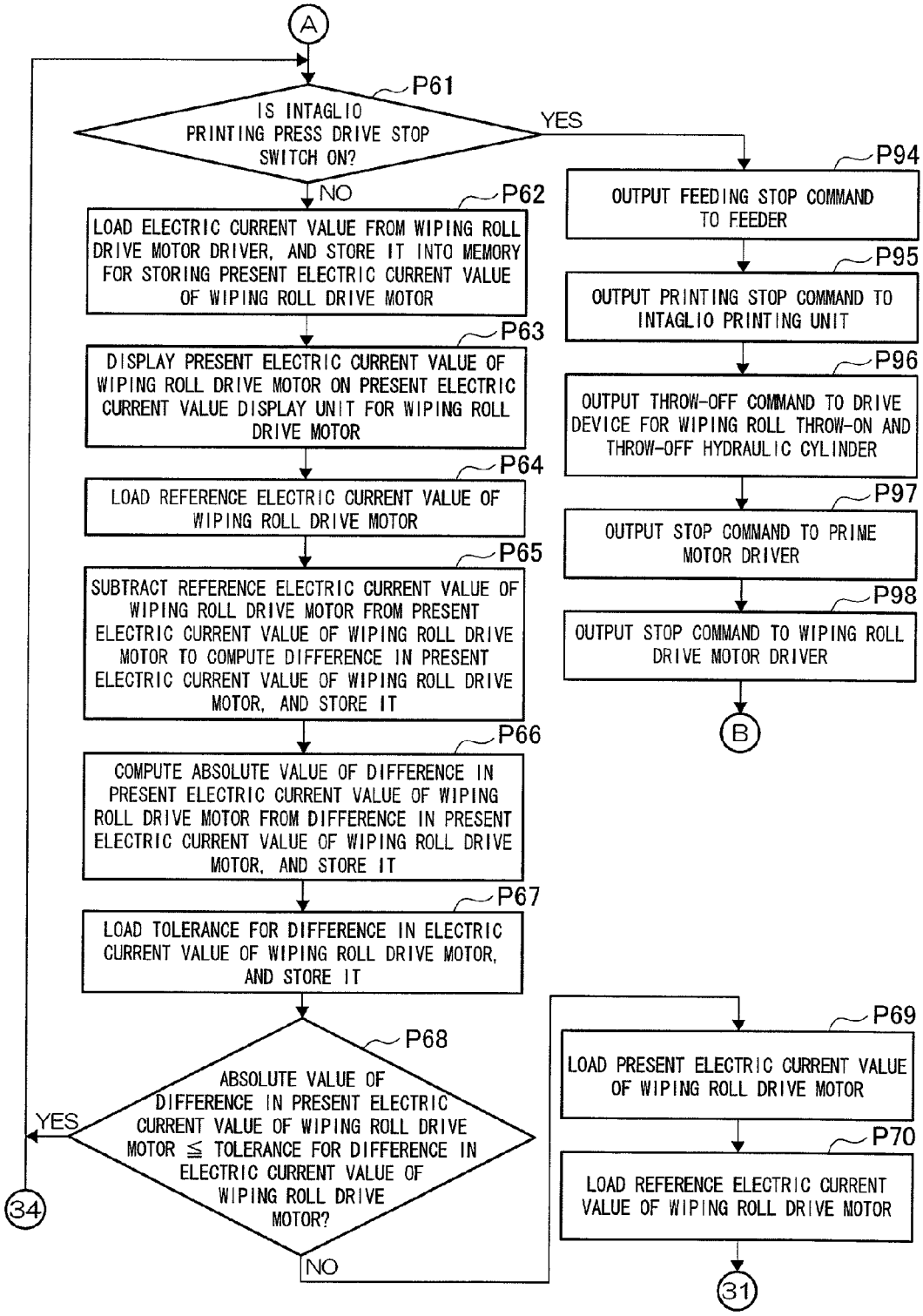
FIG. 15A is an action flow chart of the drive control device for the wiping roll drive motor and the wiping roll contact pressure adjusting motor in Embodiment 2 of the present invention.
Figure 15B:
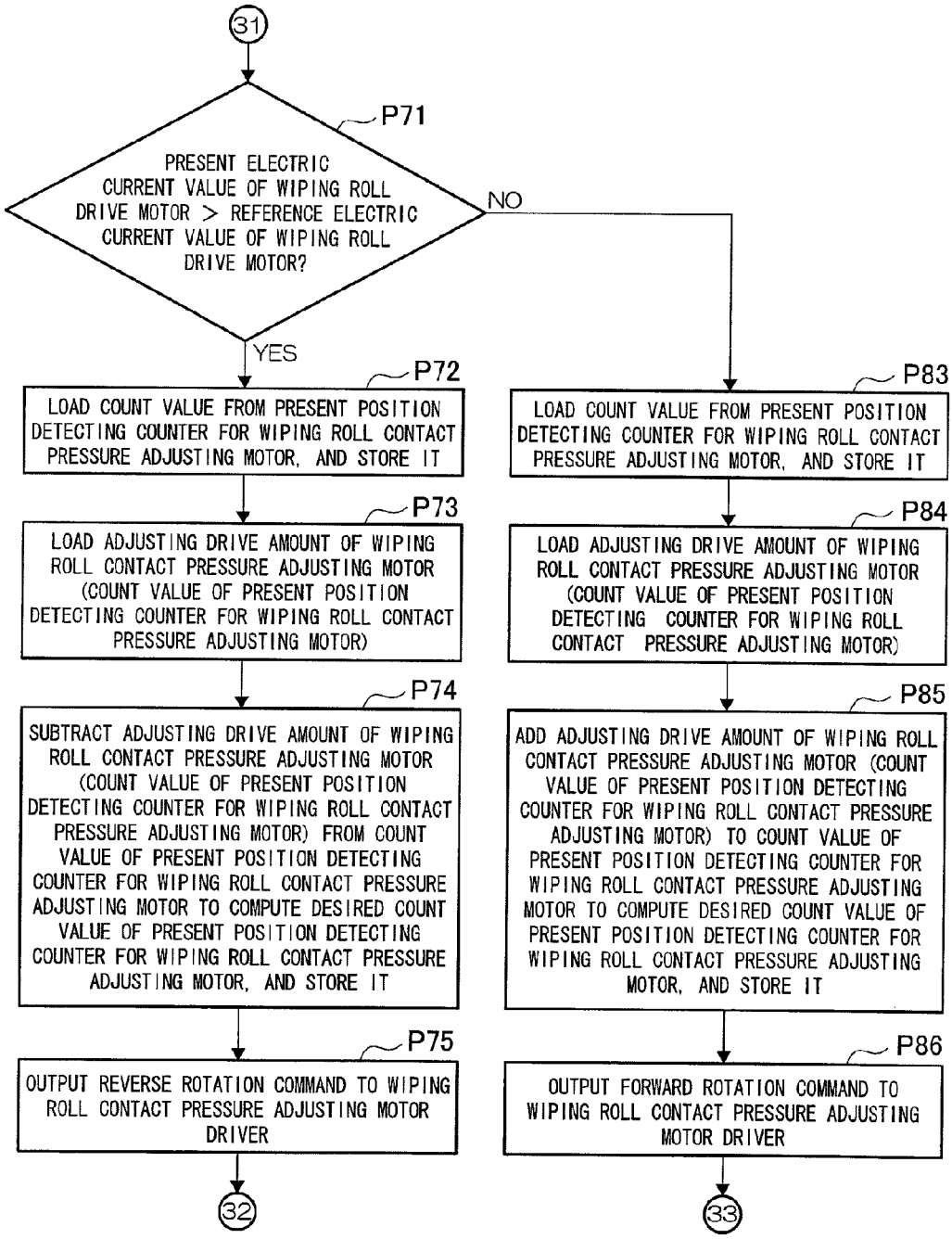
FIG. 15B is an action flow chart of the drive control device for the wiping roll drive motor and the wiping roll contact pressure adjusting motor in Embodiment 2 of the present invention.
Figure 15C:
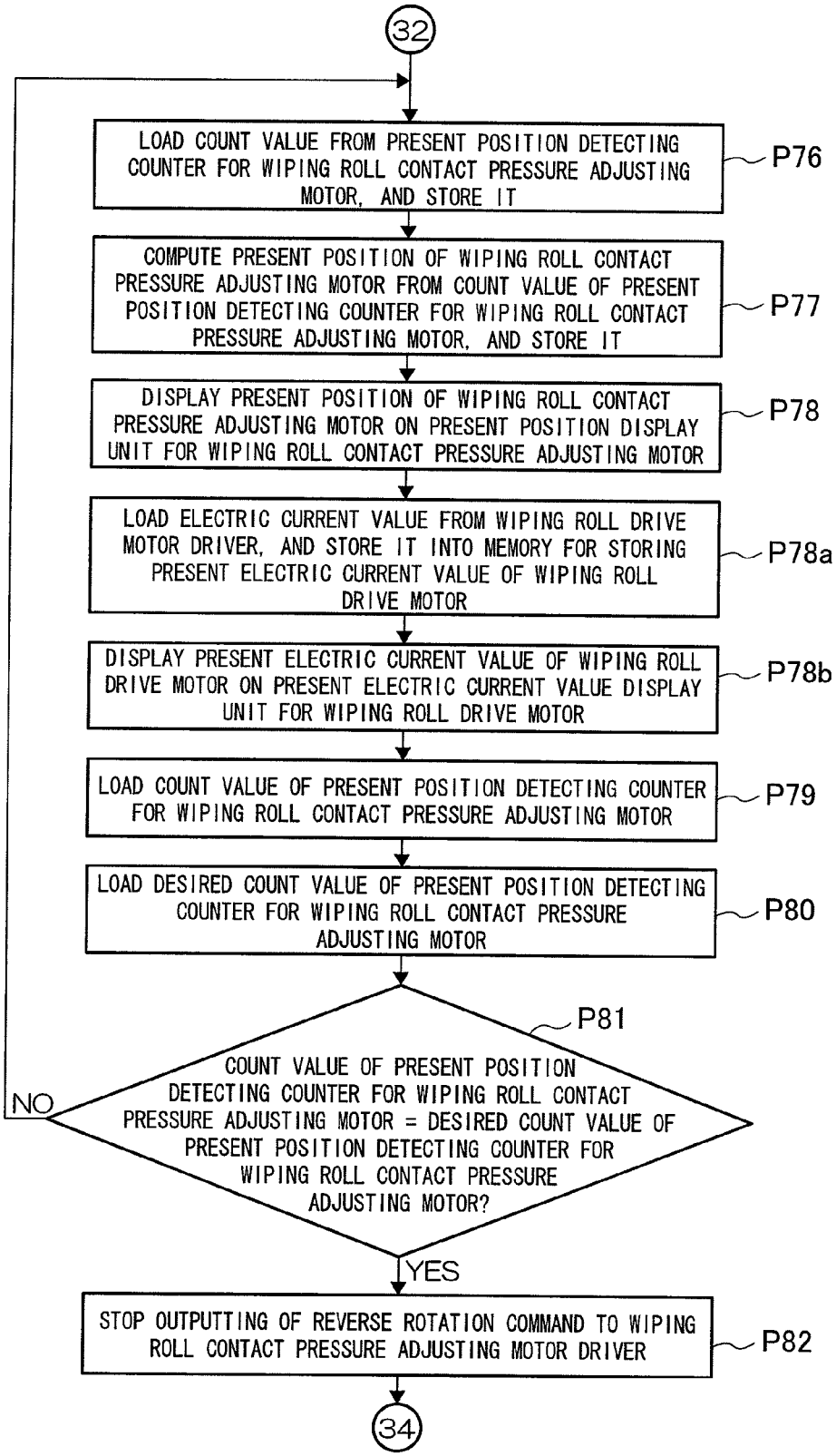
FIG. 15C is an action flow chart of the drive control device for the wiping roll drive motor and the wiping roll contact pressure adjusting motor in Embodiment 2 of the present invention.
Figure 15D:
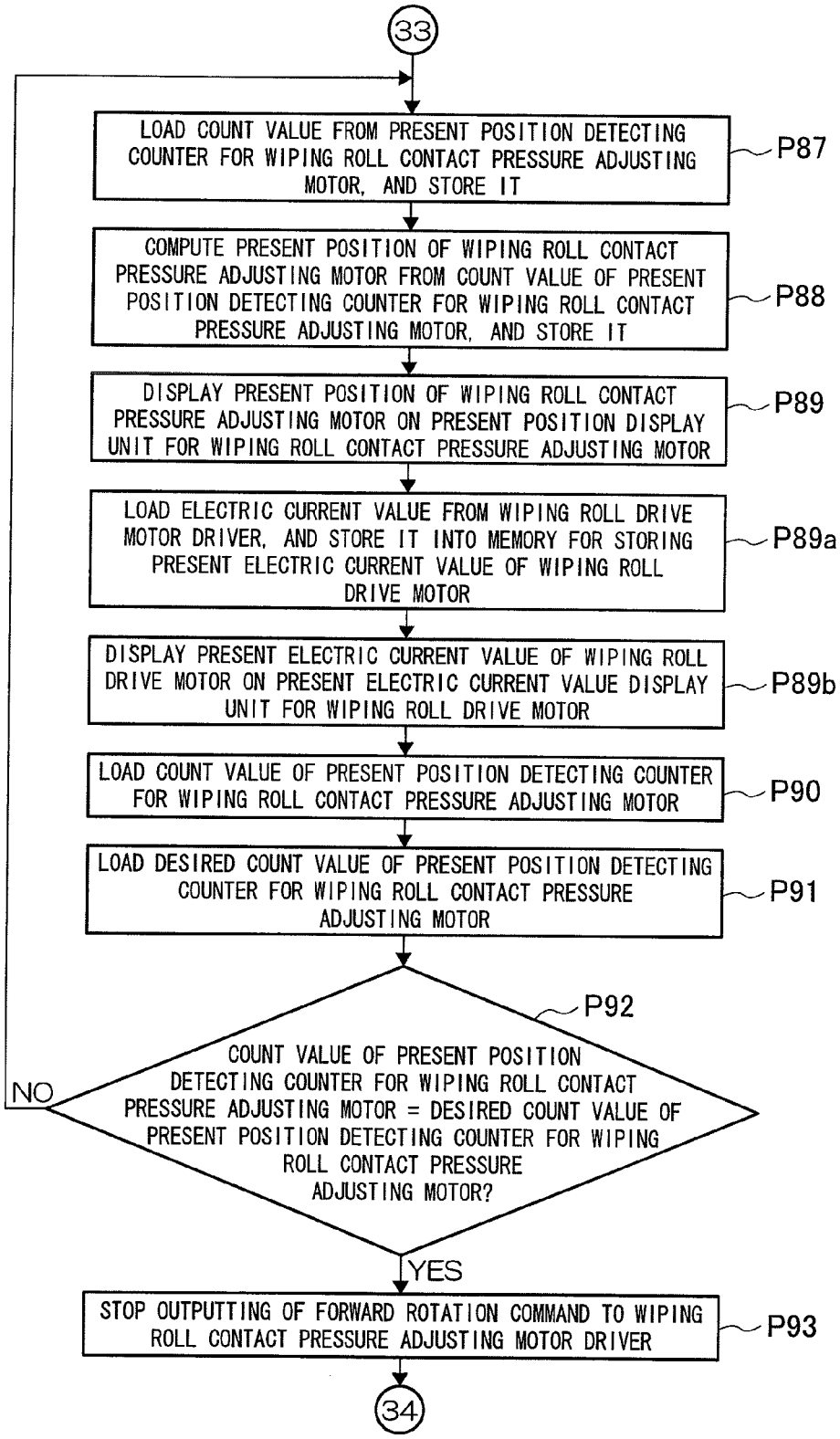
FIG. 15D is an action flow chart of the drive control device for the wiping roll drive motor and the wiping roll contact pressure adjusting motor in Embodiment 2 of the present invention.
Figure 16A:
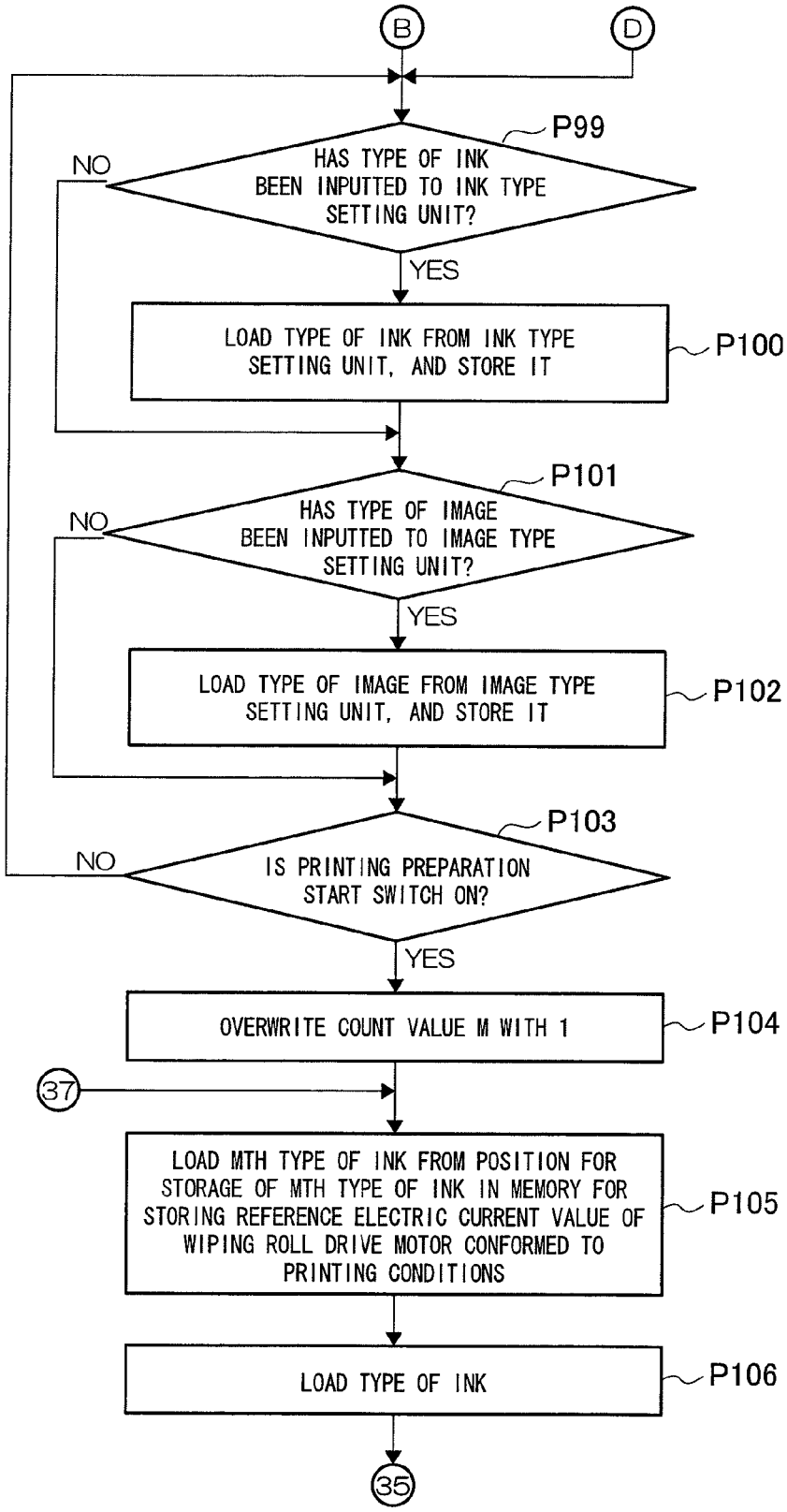
FIG. 16A is an action flow chart of the drive control device for the wiping roll drive motor and the wiping roll contact pressure adjusting motor in Embodiment 2 of the present invention.
Figure 16B:
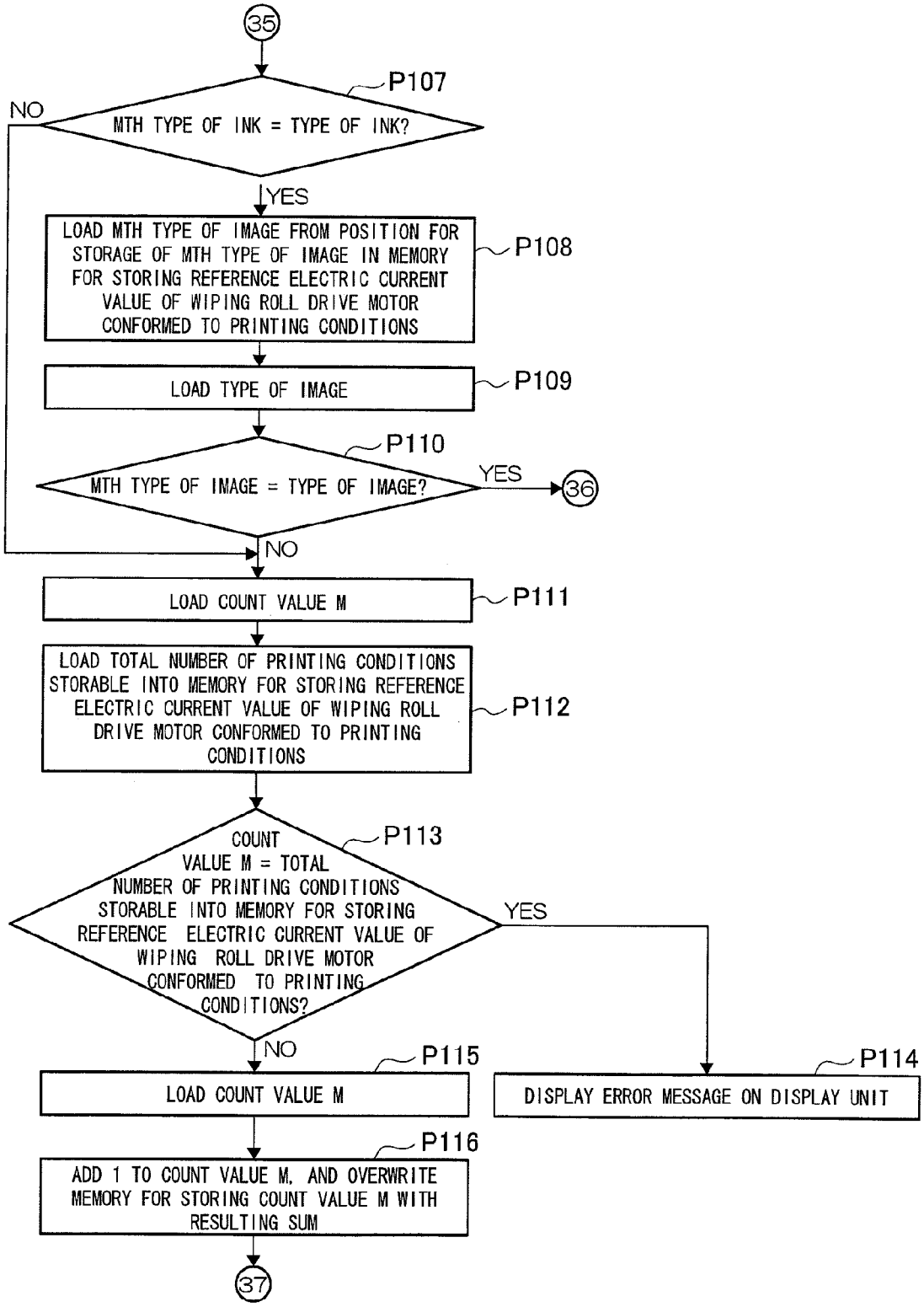
FIG. 16B is an action flow chart of the drive control device for the wiping roll drive motor and the wiping roll contact pressure adjusting motor in Embodiment 2 of the present invention.
Figure 16C:
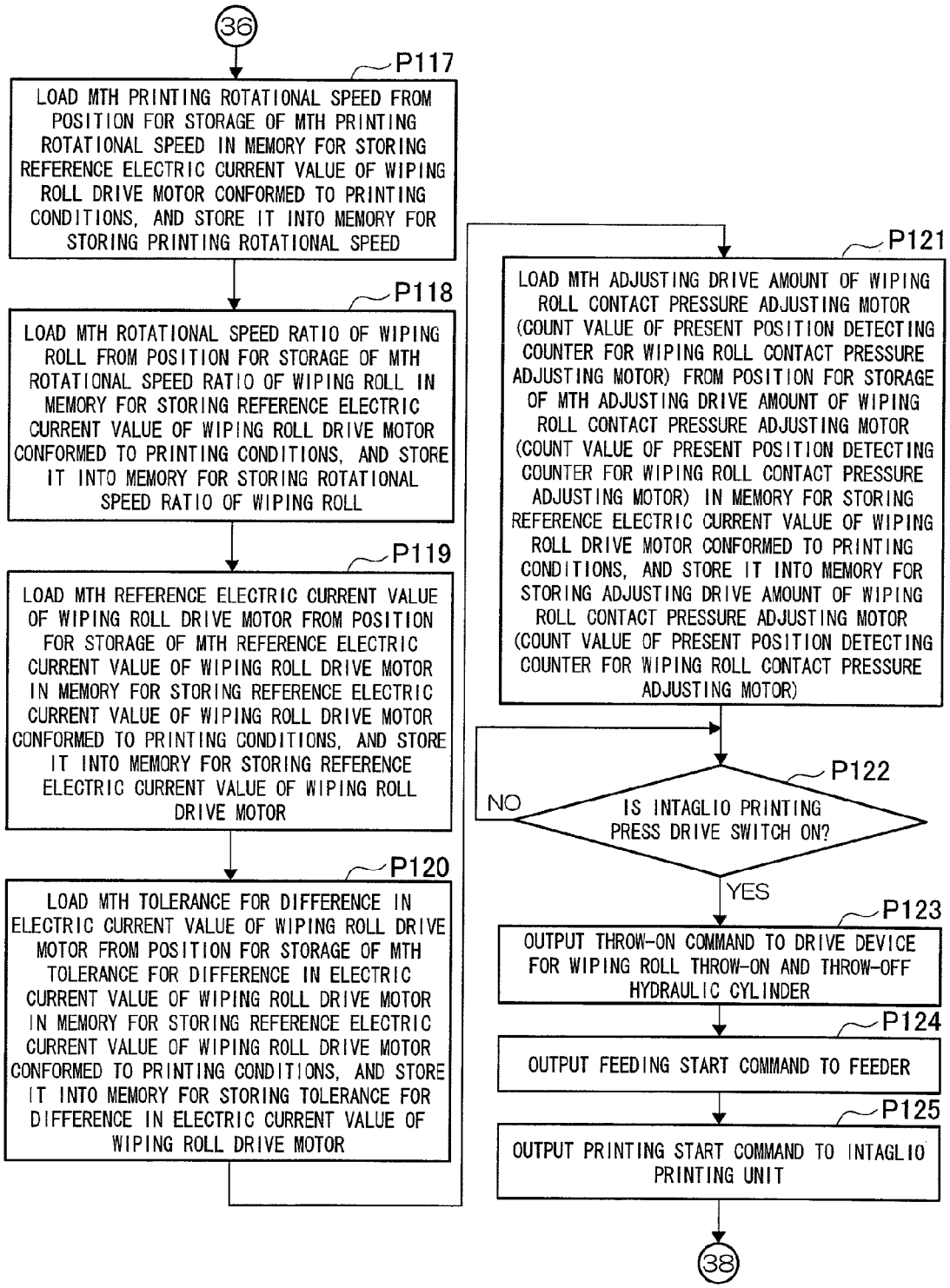
FIG. 16C is an action flow chart of the drive control device for the wiping roll drive motor and the wiping roll contact pressure adjusting motor in Embodiment 2 of the present invention.
Figure 16D:
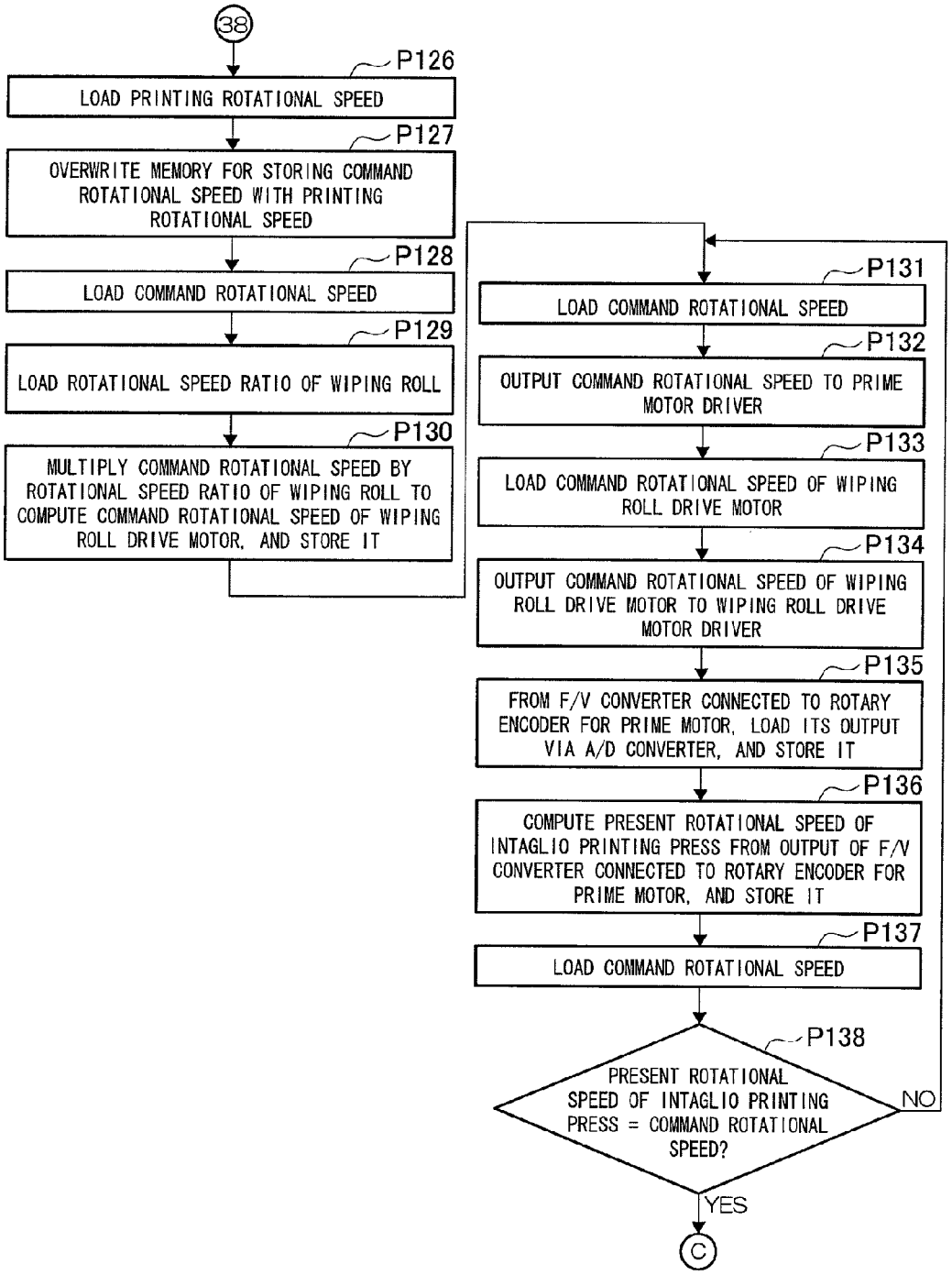
FIG. 16D is an action flow chart of the drive control device for the wiping roll drive motor and the wiping roll contact pressure adjusting motor in Embodiment 2 of the present invention.
Figure 17A:
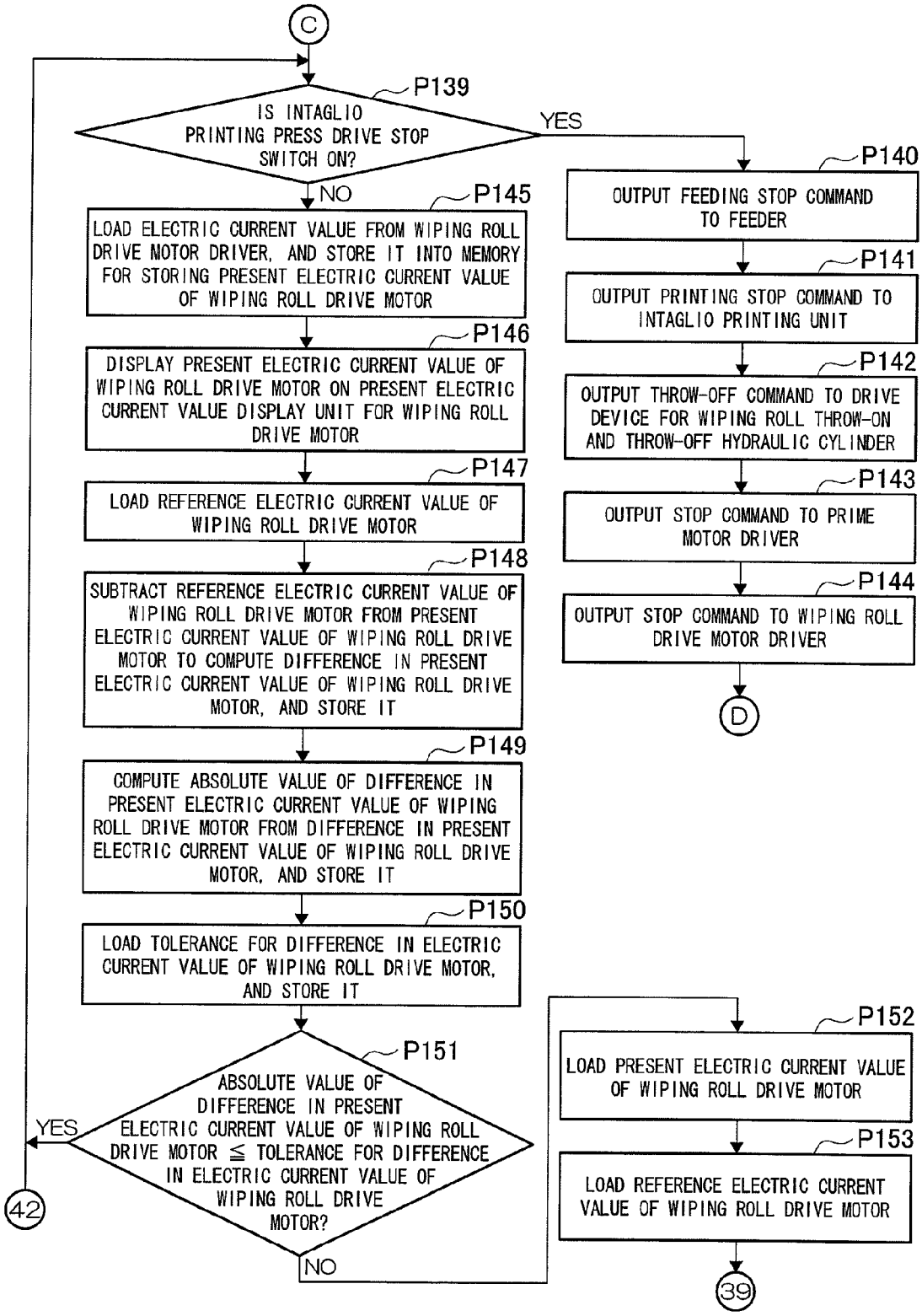
FIG. 17A is an action flow chart of the drive control device for the wiping roll drive motor and the wiping roll contact pressure adjusting motor in Embodiment 2 of the present invention.
Figure 17B:
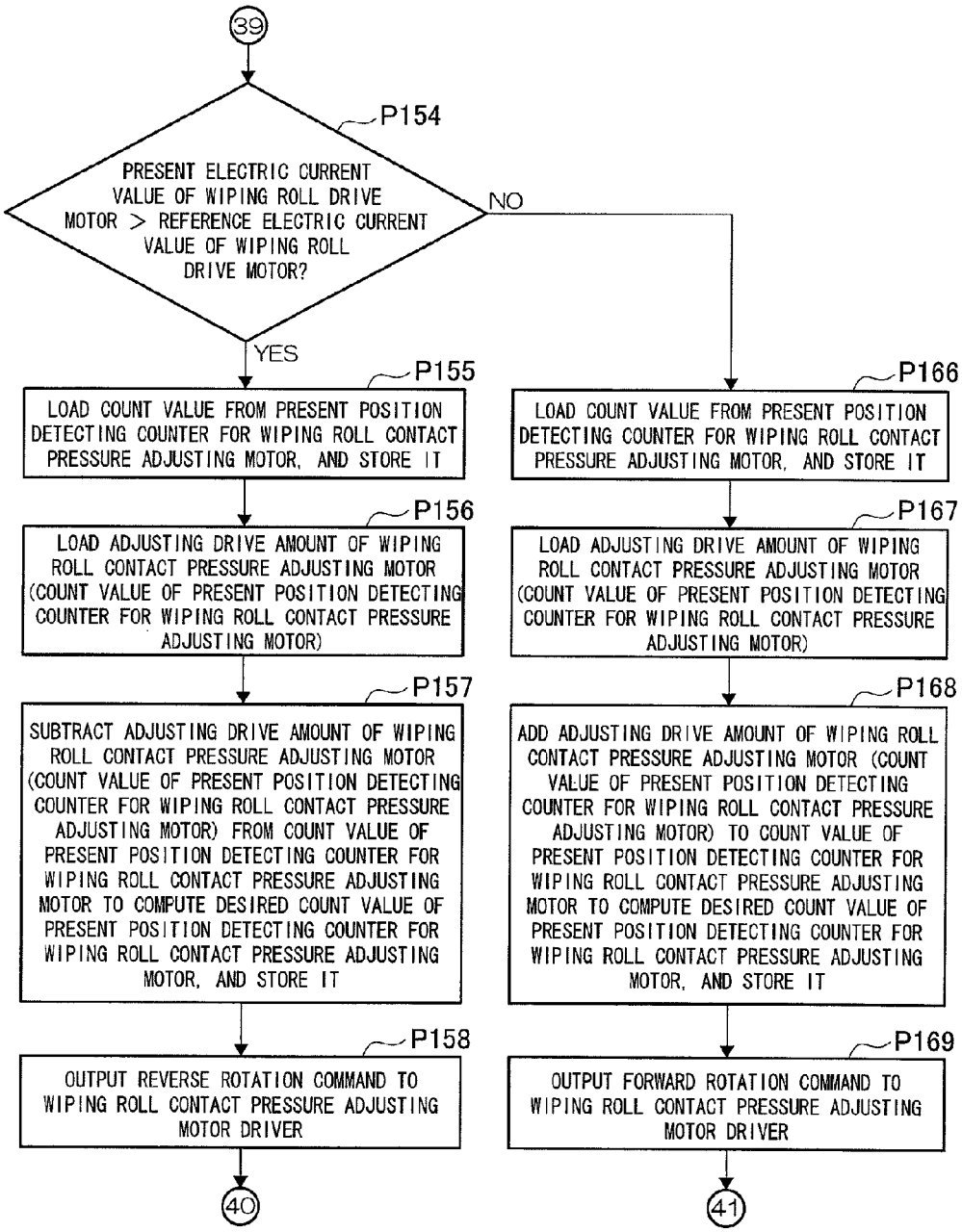
FIG. 17B is an action flow chart of the drive control device for the wiping roll drive motor and the wiping roll contact pressure adjusting motor in Embodiment 2 of the present invention.
Figure 17C:
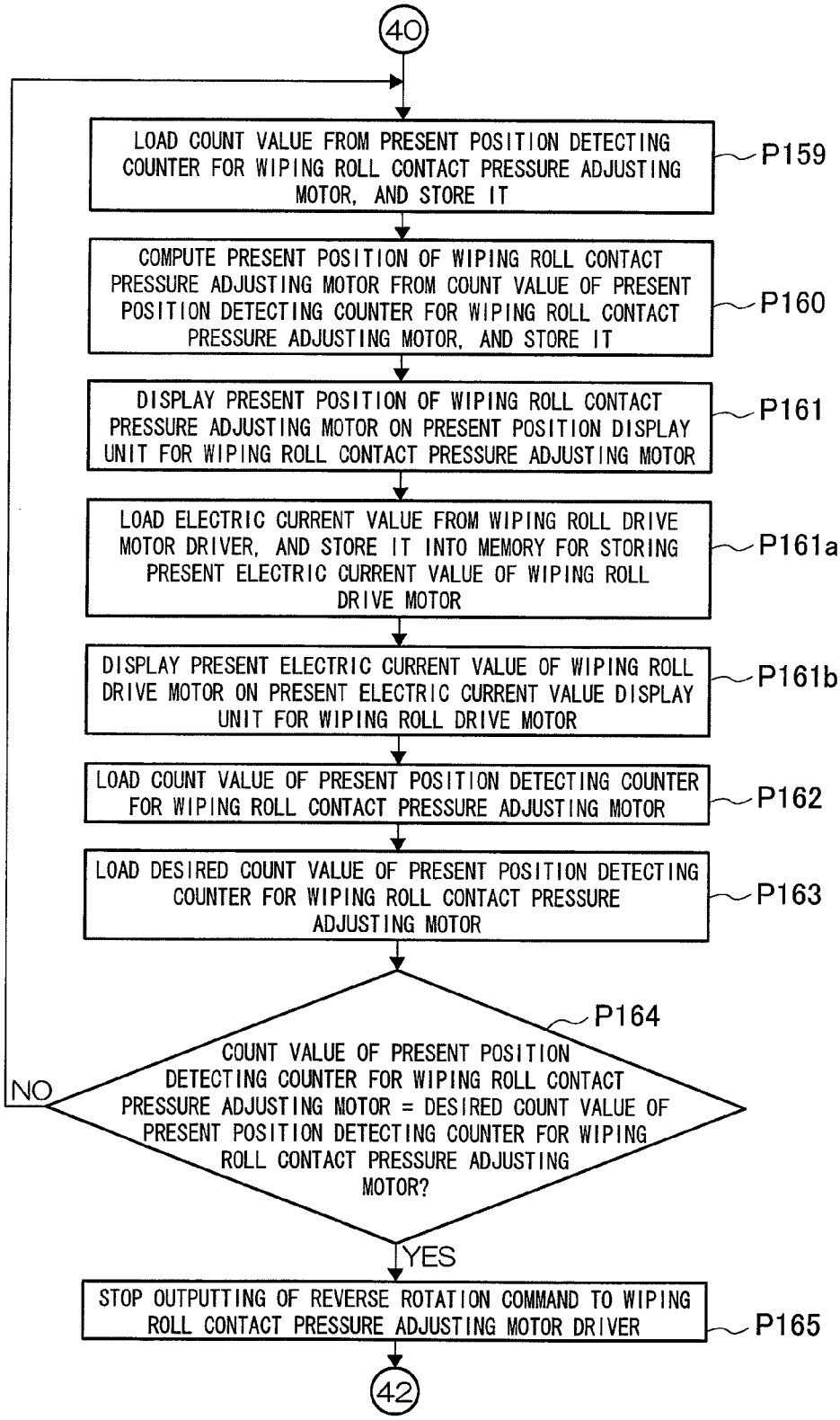
FIG. 17C is an action flow chart of the drive control device for the wiping roll drive motor and the wiping roll contact pressure adjusting motor in Embodiment 2 of the present invention.
Figure 17D:
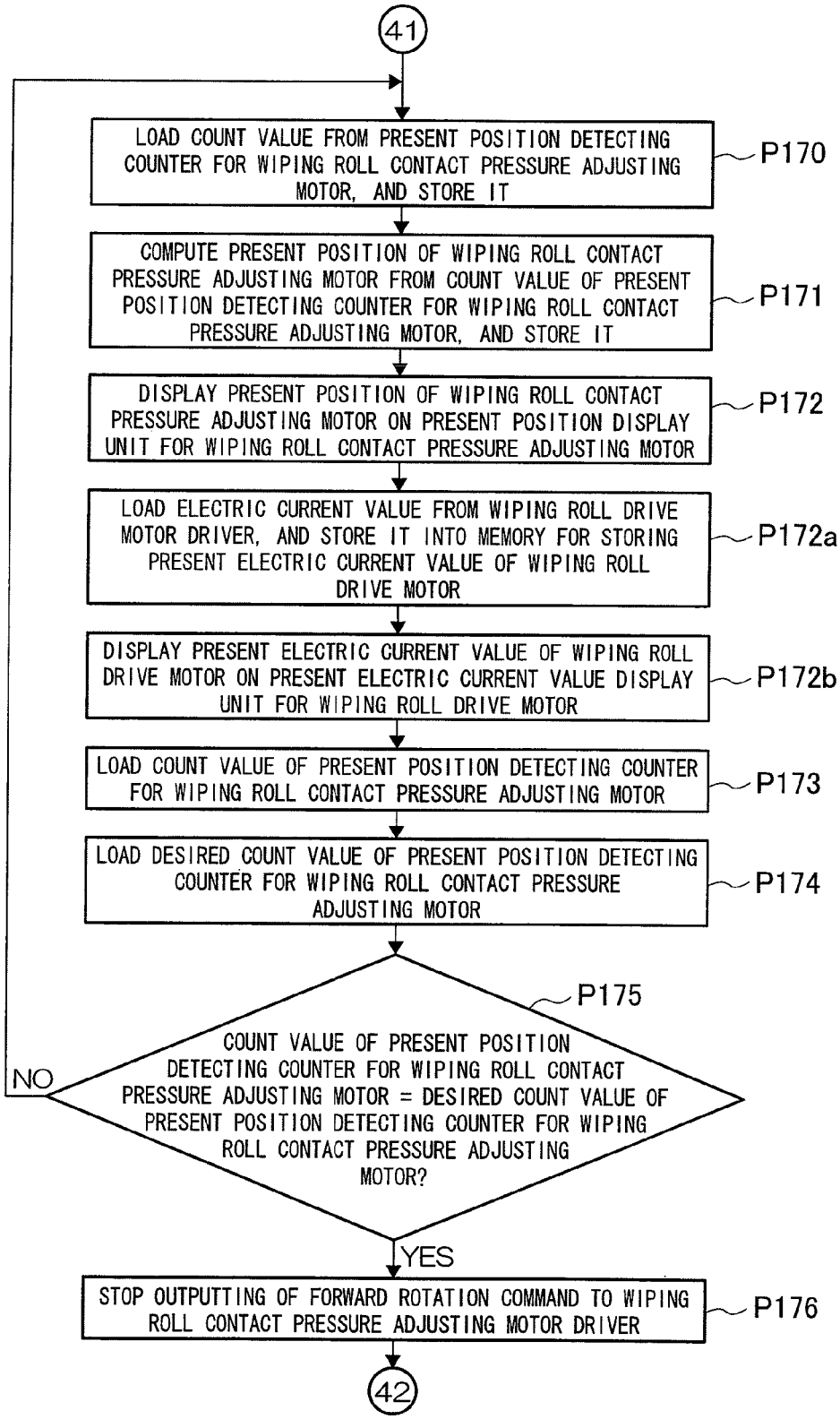
FIG. 17D is an action flow chart of the drive control device for the wiping roll drive motor and the wiping roll contact pressure adjusting motor in Embodiment 2 of the present invention.

FIGS. 13A to 13C are hardware block diagrams of a drive control device for a wiping roll drive motor and a wiping roll contact pressure adjusting motor in Embodiment 2 of the present invention. FIGS. 14A to 14F, FIGS. 15A to 15D, FIGS. 16A to 16D, and FIGS. 17A to 17D are action flowcharts of the drive control device for the wiping roll drive motor and the wiping roll contact pressure adjusting motor in Embodiment 2 of the present invention. Other features are the same as those in Embodiment 1. Thus, reference to FIGS. 10 to 12 is to be made for these features, and duplicate explanations will be omitted.

As shown in FIGS. 13A to 13C, the drive control device 50B for the wiping roll drive motor and the wiping roll contact pressure adjusting motor is composed of CPU 200, ROM 201, RAM 202, input/output devices 203 to 213, and an interface 214 which are interconnected by BUS (bus line).

To the BUS, the following memories are connected: a memory M220 for storing the type of ink; a memory M221 for storing the type of image; a memory M200 for storing a printing rotational speed; a memory M201 for storing the rotational speed ratio of a wiping roll; a memory (third storage means) M213 for storing tolerance for a difference in the electric current value of the wiping roll drive motor; a memory M214 for storing the contact pressure adjustment amount of the wiping roll; a memory (fourth storage means) M215 for storing the adjusting drive amount of the wiping roll contact pressure adjusting motor (count value of a present position detecting counter for the wiping roll contact pressure adjusting motor); a memory M202 for storing a command rotational speed; a memory M203 for storing the command rotational speed of the wiping roll drive motor; a memory M204 for storing the output of an F/V converter connected to a rotary encoder for a prime motor; and a memory M205 for storing the present rotational speed of the intaglio printing press.

To the BUS, the following memories are also connected: a memory M206 for storing the count value of the present position detecting counter for the wiping roll contact pressure adjusting motor; a memory M207 for storing the present position of the wiping roll contact pressure adjusting motor; a memory (first storage means) M208 for storing the reference electric current value of the wiping roll drive motor; a memory (second storage means) M209 for storing the present electric current value of the wiping roll drive motor; a memory M222 for storing the reference electric current value of the wiping roll drive motor conformed to the printing conditions; a memory M210 for storing a difference in the present electric current value of the wiping roll drive motor; a memory M211 for storing the absolute value of the difference in the present electric current value of the wiping roll drive motor; a memory M216 for storing the desired count value of the present position detecting counter for the wiping roll contact pressure adjusting motor; a memory M223 for storing a count value M; and a memory M224 for storing the total number of the printing conditions storable in the memory for storing the reference electric current value of the wiping roll drive motor conformed to the printing conditions.

To the input/output device 203, the following are further connected: an intaglio printing press drive switch 120; an intaglio printing press drive stop switch 121; a contact pressure increasing switch 150; a contact pressure decreasing switch 151; a contact pressure adjustment completion switch 152 for the wiping roll; a printing preparation start switch 155; an input device 122 including a keyboard, various switches, buttons, and the like; a display unit 123 including CRT, lamps and the like; and an output device 124 including a floppy (registered trademark) disk drive, a printer, and the like.

To the input/output device 204, the following are connected: an ink type setting unit 125; an image type setting unit 127; a printing rotational speed setting unit 129; a rotational speed ratio setting unit 130 for the wiping roll; a tolerance setting unit 250 for the difference in the electric current value of the wiping roll drive motor; and a contact pressure adjustment amount setting unit 251 for the wiping roll.

A present electric current value display unit 156 for the wiping roll drive motor, and a present position display unit 157 for the wiping roll contact pressure adjusting motor are connected to the input/output device 205.

An LED 159 for displaying contact pressure adjustment preparation completion for the wiping roll is connected to the input/output device 206 via a drive device 158 for the LED for displaying contact pressure adjustment preparation completion for the wiping roll.

A wiping roll throw-on and throw-off hydraulic cylinder 23 is connected to the input/output device 207 via a drive device 135 for the wiping roll throw-on and throw-off hydraulic cylinder.

A prime motor 139 is connected to the input/output device 208 via a D/A converter 137 and a prime motor driver 138.

A rotary encoder 142 for the prime motor, which is linked to and driven by the prime motor 139, is connected to the input/output device 209 via an A/D converter 140 and an F/V converter 141. The rotary encoder 142 for the prime motor is connected to the prime motor driver 138.

A wiping roll drive motor 40 is connected to the input/output device 210 via a D/A converter 143 and a wiping roll drive motor driver 144. A rotary encoder 146 for the wiping roll drive motor, which is linked to and driven by the wiping roll drive motor 40, is connected to the wiping roll drive motor driver 144.

The wiping roll drive motor driver 144 is connected to the input/output device 211 so that an electric current value is outputted from the motor driver 144.

A wiping roll contact pressure adjusting motor 30 is connected to the input/output device 212 via a wiping roll contact pressure adjusting motor driver 147, and a forward rotation command or a reverse rotation command is outputted to the motor driver 147.

A rotary encoder 161 for the wiping roll contact pressure adjusting motor, which is linked to and driven by the wiping roll contact pressure adjusting motor 30, is connected to the input/output device 213 via a present position detecting counter 160 for the wiping roll contact pressure adjusting motor.

The feeder 10 and the intaglio printing unit 11 are connected to the interface 214.

The actions of the drive control device 50B for the wiping roll drive motor and the wiping roll contact pressure adjusting motor, which has been described above, will be described below.

The drive control device 50B operates in accordance with an operational or action flow shown in FIGS. 14A to 14F, FIGS. 15A to 15D, FIGS. 16A to 16D, and FIGS. 17A to 17D.

In Step P1, it is determined whether the type of ink has been inputted to the ink type setting unit 125. If the answer is yes (YES), in Step P2, the type of ink is loaded from the ink type setting unit 125, and stored into the memory M220. If the answer is no (NO) in Step P1, the program directly shifts to Step P3.

Then, it is determined in Step P3 whether the type of an image has been inputted to the image type setting unit 127. In the answer is YES, in Step P4, the type of image is loaded from the image type setting unit 127, and stored into the memory M221. If the answer is NO in Step P3, the program directly shifts to Step P5.

Then, in Step P5, it is determined whether a printing rotational speed has been inputted to the printing rotational speed setting unit 129. If the answer is YES, in Step 26, the printing rotational speed is loaded from the printing rotational speed setting unit 129, and stored into the memory M200. If the answer is NO, the program directly shifts to Step P7.

Then, in Step P7, it is determined whether the rotational speed ratio of the wiping roll has been inputted to the rotational speed ratio setting unit 130 for the wiping roll. If the answer is YES, in Step P8, the rotational speed ratio of the wiping roll is loaded from the rotational speed ratio setting unit 130 for the wiping roll, and stored into the memory M201. If the answer is NO, the program directly shifts to Step P9.

Then, in Step P9, it is determined whether tolerance for the difference in the electric current value of the wiping roll drive motor 40 has been inputted to the tolerance setting unit 250 for the difference in the electric current value of the wiping roll drive motor. If the answer is YES, in Step P10, the tolerance for the difference in the electric current value of the wiping roll drive motor 40 is loaded from the tolerance setting unit 250 for the difference in the electric current value of the wiping roll drive motor, and stored into the memory M213. If the answer is NO in Step P9, the program directly shifts to Step P11.

Then, in Step P11, it is determined whether the contact pressure adjustment amount of the wiping roll 20 has been inputted to the contact pressure adjustment amount setting unit 251 for the wiping roll. If the answer is YES, the contact pressure adjustment amount of the wiping roll 20 is loaded from the contact pressure adjustment amount setting unit 251 for the wiping roll, and stored into the memory M214. If the answer is NO in Step P11, the program directly shifts to Step P14.

Then, in Step P13, the adjusting drive amount of the wiping roll contact pressure adjusting motor 30 (count value of the present position detecting counter 160 for the wiping roll contact pressure adjusting motor) is computed from the contact pressure adjustment amount of the wiping roll 20, and the computed value is stored into the memory M215. Then, the program shifts to the aforementioned Step P14.

Then, in Step P14, it is determined whether the intaglio printing press drive switch 120 has been turned on. If the answer is YES, a throw-on command is outputted to the drive device 135 for the wiping roll throw-on and throw-off hydraulic cylinder in Step P15. If the answer is NO, the program returns to Step P1.

Then, in Step P16, a feeding start command is outputted to the feeder 10. Then, in Step P17, a printing start command is outputted to the intaglio printing unit 11. Then, in Step P18, the printing rotational speed is loaded from the memory M200.

Then, in Step P19, the memory M202 for storing a command rotational speed is overwritten with the printing rotational speed, whereafter the command rotational speed is loaded from the memory M202 in Step P20. Then, in Step P21, the rotational speed ratio of the wiping roll is loaded from the memory M201.

Then, in Step P22, the command rotational speed is multiplied by the rotational speed ratio of the wiping roll to compute the command rotational speed of the wiping roll drive motor 40, and the computed value is stored into the memory M203. Then, in Step P23, the command rotational speed is loaded from the memory M202.

Then, in Step P24, the command rotational speed is outputted to the prime motor driver 138 via the D/A converter 136. Then, in Step P25, the command rotational speed of the wiping roll drive motor 40 is loaded from the memory M203. Then, in Step P26, the command rotational speed of the wiping roll drive motor 40 is outputted to the wiping roll drive motor driver 144 via the D/A converter 142.

Then, in Step P27, from the F/V converter 140 connected to the rotary encoder 142 for the prime motor, its output is loaded via the A/D converter 139, and stored into the memory M204. Then, in Step P28, the present rotational speed of the intaglio printing press is computed from the output of the F/V converter 140 connected to the rotary encoder 142 for the prime motor, and stored into the memory M205.

Then, in Step P29, the command rotational speed is loaded from the memory M202. Then, in Step P30, it is determined whether the present rotational speed of the intaglio printing press is equal to the command rotational speed. If the answer is YES, in Step P31, a lighting command is outputted to the drive device 158 for the LED for displaying contact pressure adjustment preparation completion for the wiping roll. If the answer is NO in Step P30, the program returns to Step P23.

Then, in Step P32, it is determined whether the contact pressure increasing switch 150 has been turned on. If the answer is YES, in Step P33, a forward rotation command is outputted to the wiping roll contact pressure adjusting motor driver 147. If the answer is NO in Step P32, the program shifts to Step P41 to be described later.

Then, in Step P34, the count value is loaded from the present position detecting counter 160 for the wiping roll contact pressure adjusting motor, and stored into the memory M206. Then, in Step P35, the present position of the wiping roll contact pressure adjusting motor 30 is computed from the count value of the present position detecting counter 160 for the wiping roll contact pressure adjusting motor, and stored into the memory M207.

Then, in Step P36, the present position of the wiping roll contact pressure adjusting motor 30 is displayed on the present position display unit 157 for the wiping roll contact pressure adjusting motor. Then, in Step P37, the electric current value is loaded from the wiping roll drive motor driver 144, and stored into the memory M209 for storing the present electric current value of the wiping roll drive motor.

Then, in Step P38, the present electric current value of the wiping roll drive motor 40 is displayed on the present electric current value display unit 156 for the wiping roll drive motor. Then, in Step P39, it is determined whether the contact pressure increasing switch 150 has been turned off. If the answer is YES, in Step P40, outputting of the forward rotation command to the wiping roll contact pressure adjusting motor driver 147 is stopped. If the answer is NO in Step P39, the program returns to Step P34.

Then, in the aforementioned Step P41, it is determined whether the contact pressure decreasing switch 151 has been turned on. If the answer is YES, a reverse rotation command is outputted to the wiping roll contact pressure adjusting motor driver 147 in Step P42. If the answer is YES (Y) in Step P41, the program shifts to Step P50 to be described later.

Then, in Step P43, the count value is loaded from the present position detecting counter 160 for the wiping roll contact pressure adjusting motor, and stored into the memory M206. Then, in Step P44, the present position of the wiping roll contact pressure adjusting motor 30 is computed from the count value of the present position detecting counter 160 for the wiping roll contact pressure adjusting motor, and the computed value is stored into the memory M207.

Then, in Step P45, the current position of the wiping roll contact pressure adjusting motor 30 is displayed on the present position display unit 157 for the wiping roll contact pressure adjusting motor. Then, in Step P46, the electric current value is loaded from the wiping roll drive motor driver 144, and stored into the memory M209 for storing the present electric current value of the wiping roll drive motor.

Then, in Step P47, the present electric current value of the wiping roll drive motor 40 is displayed on the present electric current value display unit 156 for the wiping roll drive motor. Then, in Step P48, it is determined whether the contact pressure decreasing switch 151 has been turned off. If the answer is Y, outputting of the reverse rotation command to the wiping roll contact pressure adjusting motor driver 147 is stopped in Step P49. If the answer is N in Step P48, the program returns to Step P43.

Then, in Step P50, it is determined whether the contact pressure adjustment completion switch 152 for the wiping roll has been turned on. If the answer is YES, in Step P51, the electric current value is loaded from the wiping roll drive motor driver 144, and stored into the memory M208 for storing the reference electric current value of the wiping roll drive motor. Then, in Step P52, outputting of the lighting command to the drive device 158 for the LED for displaying contact pressure adjustment preparation completion for the wiping roll is stopped. If the answer is NO in Step P50, the program returns to Step P32.

Then, in Step P53, the type of ink is loaded from the memory M220. Then, in Step P54, the type of image is loaded from the memory M221. Then, in Step P55, the reference electric current value of the wiping roll drive motor 40 is loaded from the memory M208.

Then, in Step P56, the printing rotational speed is loaded from the memory M200. Then, in Step P57, the rotational speed ratio of the wiping roll 20 is loaded from the memory M201. Then, in Step P58, the tolerance for the difference in the electric current value of the wiping roll drive motor is loaded from the memory M213.

Then, in Step P59, the adjusting drive amount of the wiping roll contact pressure adjusting motor (count value of the present position detecting counter for the wiping roll contact pressure adjusting motor) is loaded from the memory M215. Then, in Step P60, the type of ink, the type of image, the reference electric current value of the wiping roll drive motor 40, the printing rotational speed, the rotational speed ratio of the wiping roll 20, the tolerance for the difference in the electric current value of the wiping roll drive motor 40, and the adjusting drive amount of the wiping roll contact pressure adjusting motor 30 (count value of the present position detecting counter 160 for the wiping roll contact pressure adjusting motor) are additionally stored into the memory M222 for storing the reference electric current value of the wiping roll drive motor conformed to the printing conditions.

In accordance with the above-described operational or action flow, there are stored the reference electric current value of the wiping roll drive motor 40 and the adjusting drive amount of the wiping roll contact pressure adjusting motor 30 when the wiping roll 20 is thrown on the intaglio cylinder 17 at optimum contact pressure in accordance with the type of ink and the type of image while the operator is visually checking and operating the machine.

Then, in Step P61, it is determined whether the intaglio printing press drive stop switch 121 has been turned on. If the answer is NO, in Step P62, the electric current value is loaded from the wiping roll drive motor driver 144, and stored into the memory M209 for storing the present electric current value of the wiping roll drive motor. Then, in Step P63, the present electric current value of the wiping roll drive motor 40 is displayed on the present electric current value display unit 156 for the wiping roll drive motor.

Then, in Step P64, the reference electric current value of the wiping roll drive motor 40 is loaded from the memory M208. Then, in Step P65, the reference electric current value of the wiping roll drive motor 40 is subtracted from the present electric current value of the wiping roll drive motor 40 to compute the difference in the present electric current value of the wiping roll drive motor 40, and this difference is stored into the memory M210.

Then, in Step P66, the absolute value of the difference in the present electric current value of the wiping roll drive motor 40 is computed from the difference in the present electric current value of the wiping roll drive motor 40, and this value is stored into the memory M211. Then, in Step P67, the tolerance for the difference in the electric current value of the wiping roll drive motor 40 is loaded from the memory M213.

Then, in Step P68, it is determined whether the absolute value of the difference in the present electric current value of the wiping roll drive motor is equal to or less than the tolerance for the difference in the electric current value of the wiping roll drive motor. If the answer is YES, the program returns to Step P61. If the answer is NO, the present electric current value of the wiping roll drive motor 40 is loaded from the memory M209 in Step P69.

Then, in Step P70, the reference electric current value of the wiping roll drive motor 40 is loaded from the memory M208. Then, in Step P71, it is determined whether the present electric current value of the wiping roll drive motor is greater than the reference electric current value of the wiping roll drive motor.

If the answer is YES in the above Step P71, the count value is loaded from the present position detecting counter 160 for the wiping roll contact pressure adjusting motor in Step P72, and stored into the memory M206. Then, in Step P73, the adjusting drive amount of the wiping roll contact pressure adjusting motor 30 (count value of the present position detecting counter 160 for the wiping roll contact pressure adjusting motor) is loaded from the memory M215.

Then, in Step P74, the adjusting drive amount of the wiping roll contact pressure adjusting motor 30 (count value of the present position detecting counter 160 for the wiping roll contact pressure adjusting motor) is subtracted from the count value of the present position detecting counter 160 for the wiping roll contact pressure adjusting motor to compute the desired count value of the present position detecting counter 160 for the wiping roll contact pressure adjusting motor, and the computed value is stored into the memory M216. Then, in Step P75, a reverse rotation command is outputted to the wiping roll contact pressure adjusting motor driver 147.

Then, in Step P76, the count value is loaded from the present position detecting counter 160 for the wiping roll contact pressure adjusting motor, and stored into the memory M206. Then, in Step P77, the present position of the wiping roll contact pressure adjusting motor 30 is computed from the count value of the present position detecting counter 160 for the wiping roll contact pressure adjusting motor, and stored into the memory M207.

Then, in Step P78, the present position of the wiping roll contact pressure adjusting motor 30 is displayed on the present position display unit 157 for the wiping roll contact pressure adjusting motor. Then, in Step P78*a*, the electric current value is loaded from the wiping roll drive motor driver 144, and stored into the memory M209 for storing the present electric current value of the wiping roll drive motor. Then, in Step P78*b*, the present electric current value of the wiping roll drive motor 40 is displayed on the present electric current value display unit 156 for the wiping roll drive motor. Then, in Step P79, the count value of the present position detecting counter 160 for the wiping roll contact pressure adjusting motor is loaded from the memory M206.

Then, in Step P80, the desired count value of the present position detecting counter for the wiping roll contact pressure adjusting motor is loaded from the memory M216. Then, in Step P81, it is determined whether the count value of the present position detecting counter for the wiping roll contact pressure adjusting motor is equal to the desired count value of the present position detecting counter for the wiping roll contact pressure adjusting motor.

If the answer is YES in the above Step P81, outputting of the reverse rotation command to the wiping roll contact pressure adjusting motor driver 147 is stopped in Step P82. Then, the program returns to Step P61. If the answer is NO in Step P81, the program returns to Step P76.

If the answer is NO in the aforementioned Step P71, Step P83 is executed to load the count value from the present position detecting counter 160 for the wiping roll contact pressure adjusting motor, and store it into the memory M206. Then, in Step P84, the adjusting drive amount of the wiping roll contact pressure adjusting motor 30 (count value of the present position detecting counter 160 for the wiping roll contact pressure adjusting motor) is loaded from the memory M215.

Then, in Step P85, the adjusting drive amount of the wiping roll contact pressure adjusting motor 30 (count value of the present position detecting counter 160 for the wiping roll contact pressure adjusting motor) is added to the count value of the present position detecting counter 160 for the wiping roll contact pressure adjusting motor to compute the desired count value of the present position detecting counter 160 for the wiping roll contact pressure adjusting motor, and the computed value is stored into the memory M216. Then, in Step P86, a forward rotation command is outputted to the wiping roll contact pressure adjusting motor driver 147.

Then, in Step P87, the count value is loaded from the present position detecting counter 160 for the wiping roll contact pressure adjusting motor, and stored into the memory M206. Then, in Step P88, the present position of the wiping roll contact pressure adjusting motor 30 is computed from the count value of the present position detecting counter 160 for the wiping roll contact pressure adjusting motor, and stored into the memory M207.

Then, in Step P89, the present position of the wiping roll contact pressure adjusting motor 30 is displayed on the present position display unit 157 for the wiping roll contact pressure adjusting motor. Then, in Step P89*a*, the electric current value is loaded from the wiping roll drive motor driver 144, and stored into the memory M209 for storing the present electric current value of the wiping roll drive motor. Then, in Step P89*b*, the present electric current value of the wiping roll drive motor 40 is displayed on the present electric value display unit 156 for the wiping roll drive motor. Then, in Step P90, the count value of the present position detecting counter 160 for the wiping roll contact pressure adjusting motor is loaded from the memory M206.

Then, in Step P91, the desired count value of the present position detecting counter 160 for the wiping roll contact pressure adjusting motor is loaded from the memory M216. Then, in Step P92, it is determined whether the count value of the present position detecting counter for the wiping roll contact pressure adjusting motor is equal to the desired count value of the present position detecting counter for the wiping roll contact pressure adjusting motor.

If the answer is Y in the above Step P92, outputting of the forward rotation command to the wiping roll contact pressure adjusting motor driver 147 is stopped in Step P93. Then, the program returns to Step P61. If the answer is N in Step P92, the program returns to Step P87.

If the answer is YES in the above Step P61, a feeding stop command is outputted to the feeder 10 in Step P94. Then, in Step P95, a printing stop command is outputted to the intaglio printing unit 11. Then, in Step P96, a throw-off command is outputted to the drive device 135 for the wiping roll throw-on and throw-off hydraulic cylinder. Afterwards, a stop command is outputted to the prime motor driver 138 in Step P97. Then, in Step P98, a stop command is outputted to the wiping roll drive motor driver 144.

Then, in Step P99, it is determined whether the type of ink has been inputted to the ink type setting unit 125. If the answer is YES, the type of ink is loaded from the ink type setting unit 125, and stored into the memory M220, in Step P100. If the answer is NO in Step P99, the program directly shifts to Step P101.

Then, in Step P101, it is determined whether the type of image has been inputted to the image type setting unit 127. If the answer is YES, the type of image is loaded from the image type setting unit 127, and stored into the memory M221, in Step P102. If the answer is NO in Step P101, the program directly shifts to Step P103.

Then, in Step P103, it is determined whether the printing preparation start switch 155 has been turned on. If the answer is YES, the count value M of the memory M223 is overwritten with 1 in Step P104. If the answer is NO, the program returns to Step P99.

Then, in Step P105, the Mth type of ink is loaded from the position of storage of the Mth type of ink in the memory M222 for storing the reference electric current value of the wiping roll drive motor conformed to the printing conditions. Then, in Step P106, the type of ink is loaded from the memory M220.

Then, in Step P107, it is determined whether the Mth type of ink is equal to the type of ink. If the answer is YES, Step P108 is executed to load the Mth type of image from the position for storage of the Mth type of image in the memory M222 for storing the reference electric current value of the wiping roll drive motor conformed to the printing conditions. If the answer is NO in Step P107, the program directly shifts to Step P111.

Then, in Step P109, the type of image is loaded from the memory M221. Then, in Step P110, it is determined whether the Mth type of image is equal to the type of image. If the answer is YES, the program shifts to Step P117 to be described later. If the answer is NO in Step P110, the count value M is loaded from the memory M223 in Step P111.

Then, in Step P112, the total number of the printing conditions, which can be stored into the memory M222 for storing the reference electric current value of the wiping roll drive motor conformed to the printing conditions, is loaded from the memory M224. Then, in Step P113, it is determined whether the count value M is equal to the total number of the printing conditions which can be stored into the memory for storing the reference electric current value of the wiping roll drive motor conformed to the printing conditions.

If the answer is YES in the above Step P113, an error message is displayed on the display unit 123 in Step P114. If the answer is NO in Step P113, the count value M is loaded from the memory M223 in Step P115. Then, in Step P116, 1 is added to the count value M, and the memory M223 for storing the count value M is overwritten with the resulting sum. Then, the program returns to Step P105.

Then, in the aforementioned Step P117, the Mth printing rotational speed is loaded from the position for storage of the Mth printing rotational speed in the memory M222 for storing the reference electric current value of the wiping roll drive motor conformed to the printing conditions, and is stored into the memory M200 for storing the printing rotational speed. Then, in Step P118, the Mth rotational speed ratio of the wiping roll is loaded from the position for storage of the Mth rotational speed ratio of the wiping roll in the memory M222 for storing the reference electric current value of the wiping roll drive motor conformed to the printing conditions, and is stored into the memory M201 for storing the rotational speed ratio of the wiping roll.

Then, in Step P119, the Mth reference electric current value of the wiping roll drive motor 40 is loaded from the position for storage of the Mth reference electric current value of the wiping roll drive motor in the memory M222 for storing the reference electric current value of the wiping roll drive motor conformed to the printing conditions, and is stored into the memory M208 for storing the reference electric current value of the wiping roll drive motor. Then, in Step P120, the Mth tolerance for the difference in the electric current value of the wiping roll drive motor 40 is loaded from the position for storage of the Mth tolerance for the difference in the electric current value of the wiping roll drive motor in the memory M222 for storing the reference electric current value of the wiping roll drive motor conformed to the type of ink and the type of image, and the loaded value is stored into the memory M213 for storing the tolerance for the difference in the electric current value of the wiping roll drive motor.

Then, in Step P121, the Mth adjusting drive amount of the wiping roll contact pressure adjusting motor (count value of the present position detecting counter for the wiping roll contact pressure adjusting motor) is loaded from the position for storage of the Mth adjusting drive amount of the wiping roll contact pressure adjusting motor (count value of the present position detecting counter 160 for the wiping roll contact pressure adjusting motor) in the memory M222 for storing the reference electric current value of the wiping roll drive motor conformed to the printing conditions, and is stored into the memory M215 for storing the adjusting drive amount of the wiping roll contact pressure adjusting motor (count value of the present position detecting counter for the wiping roll contact pressure adjusting motor).

Then, in Step P122, it is determined whether the intaglio printing press drive switch 120 has been turned on. If the answer is YES, a throw-on command is outputted to the drive device 135 for the wiping roll throw-on and throw-off hydraulic cylinder in Step P123.

Then, in Step P124, a feeding start command is outputted to the feeder 10. Then, in Step P125, a printing start command is outputted to the intaglio printing unit 11. Then, in Step P126, the printing rotational speed is loaded from the memory M200.

Then, in Step P127, the memory M202 for storing the command rotational speed is overwritten with the printing rotational speed. Afterwards, the command rotational speed is loaded from the memory M202 in Step P128. Then, in Step P129, the rotational speed ratio of the wiping roll is loaded from the memory M201.

Then, in Step P130, the command rotational speed is multiplied by the rotational speed ratio of the wiping roll to compute the command rotational speed of the wiping roll drive motor 40, which is stored into the memory M203. Then, the command rotational speed is loaded from the memory M202 in Step P131.

Then, in Step P132, the command rotational speed is outputted to the prime motor driver 138 via the D/A converter 136. Then, in Step P133, the command rotational speed of the wiping roll drive motor 40 is loaded from the memory M203. Then, in Step P134, the command rotational speed of the wiping roll drive motor 40 is outputted to the wiping roll drive motor driver 144 via the D/A converter 142.

Then, in Step P135, from the F/V converter 140 connected to the rotary encoder 142 for the prime motor, its output is loaded via the A/D converter 139, and stored into the memory M204. Then, in Step P136, the present rotational speed of the intaglio printing press is computed from the output of the F/V converter 140 connected to the rotary encoder 142 for the prime motor, and stored into the memory M205.

Then, in Step P137, the command rotational speed is loaded from the memory M202. Then, in Step P138, it is determined whether the present rotational speed of the intaglio printing press is equal to the command rotational speed. If the answer is YES, the program shifts to Step P139 to be described later. If the answer is NO, the program returns to Step P131.

Then, in the aforementioned Step P139, it is determined whether the intaglio printing press drive stop switch 121 has been turned on. If the answer is YES, a feeding stop command is outputted to the feeder 10 in Step P140. Then, in Step P141, a printing stop command is outputted to the intaglio printing unit 11. Then, in Step P142, a throw-off command is outputted to the drive device 135 for the wiping roll throw-on and throw-off hydraulic cylinder. Then, in Step P143, a stop command is outputted to the prime motor driver 138. Then, in Step P144, a stop command is outputted to the wiping roll drive motor driver 144, whereafter the program returns to Step P99.

If the answer is NO in the above-mentioned Step P139, the electric current value is loaded from the wiping roll drive motor driver 144, and stored into the memory M209 for storing the present electric current value of the wiping roll drive motor, in Step P145. Then, in Step P146, the present electric current value of the wiping roll drive motor 40 is displayed on the present electric current value display unit 156 for the wiping roll drive motor.

Then, in Step P147, the reference electric current value of the wiping roll drive motor 40 is loaded from the memory M208. Then, in Step P148, the reference electric current value of the wiping roll drive motor 40 is subtracted from the present electric current value of the wiping roll drive motor 40 to compute the difference in the present electric current value of the wiping roll drive motor 40, which is stored into the memory M210.

Then, in Step P149, the absolute value of the difference in the present electric current value of the wiping roll drive motor 40 is computed from the difference in the present electric current value of the wiping roll drive motor 40, and this value is stored into the memory M211. Then, in Step P150, the tolerance for the difference in the present electric current value of the wiping roll drive motor 40 is loaded from the memory M213.

Then, in Step P151, it is determined whether the absolute value of the difference in the present electric current value of the wiping roll drive motor is equal to or less than the tolerance for the difference in the present electric current value of the wiping roll drive motor. If the answer is YES, the program returns to Step P139. If the answer is NO in Step P151, the present electric current value of the wiping roll drive motor 40 is loaded from the memory M209 in Step P152.

Then, in Step P153, the reference electric current value of the wiping roll drive motor 40 is loaded from the memory M208. Then, in Step P154, it is determined whether the present electric current value of the wiping roll drive motor is greater than the reference electric current value of the wiping roll drive motor.

If the answer is YES in the above Step P154, the count value is loaded from the present position detecting counter 160 for the wiping roll contact pressure adjusting motor, and stored into the memory M206, in Step P155. Then, in Step P156, the adjusting drive amount of the wiping roll contact pressure adjusting motor 30 (count value of the present position detecting counter 160 for the wiping roll contact pressure adjusting motor) is loaded from the memory M215.

Then, in Step P157, the adjusting drive amount of the wiping roll contact pressure adjusting motor 30 (count value of the present position detecting counter 160 for the wiping roll contact pressure adjusting motor) is subtracted from the count value of the present position detecting counter 160 for the wiping roll contact pressure adjusting motor to compute the desired count value of the present position detecting counter 160 for the wiping roll contact pressure adjusting motor, and the computed value is stored into the memory M216. Then, in Step P158, a reverse rotation command is outputted to the wiping roll contact pressure adjusting motor driver 147.

Then, in Step P159, the count value is loaded from the present position detecting counter 160 for the wiping roll contact pressure adjusting motor, and stored into the memory M206. Then, in Step P160, the present position of the wiping roll contact pressure adjusting motor 30 is computed from the count value of the present position detecting counter 160 for the wiping roll contact pressure adjusting motor, and stored into the memory M207.

Then, in Step P161, the present position of the wiping roll contact pressure adjusting motor 30 is displayed on the present position display unit 157 for the wiping roll contact pressure adjusting motor. Then, in Step P161*a*, the electric current value is loaded from the wiping roll drive motor driver 144, and stored into the memory M209 for storing the present electric current value of the wiping roll drive motor. Then, in Step P161*b*, the present electric current value of the wiping roll drive motor 40 is displayed on the present electric current value display unit 156 for the wiping roll drive motor. Then, in Step P162, the count value of the present position detecting counter 160 for the wiping roll contact pressure adjusting motor is loaded from the memory M206.

Then, in Step P163, the desired count value of the present position detecting counter for the wiping roll contact pressure adjusting motor is loaded from the memory M216. Then, in Step P164, it is determined whether the count value of the present position detecting counter for the wiping roll contact pressure adjusting motor is equal to the desired count value of the present position detecting counter for the wiping roll contact pressure adjusting motor.

If the answer is Y (yes) in the above Step P164, outputting of the reverse rotation command to the wiping roll contact pressure adjusting motor driver 147 is stopped in Step P165. Then, the program returns to Step P139. If the answer is N (no) in Step P164, the program returns to Step P159.

If the answer is NO in the aforementioned Step P154, Step P166 is executed to load the count value from the present position detecting counter 160 for the wiping roll contact pressure adjusting motor, and store it into the memory M206. Then, in Step P167, the adjusting drive amount of the wiping roll contact pressure adjusting motor 30 (count value of the present position detecting counter 160 for the wiping roll contact pressure adjusting motor) is loaded from the memory M215.

Then, in Step P168, the adjusting drive amount of the wiping roll contact pressure adjusting motor 30 (count value of the present position detecting counter 160 for the wiping roll contact pressure adjusting motor) is added to the count value of the present position detecting counter 160 for the wiping roll contact pressure adjusting motor to compute the desired count value of the present position detecting counter 160 for the wiping roll contact pressure adjusting motor, and the computed value is stored into the memory M216. Then, in Step P169, a forward rotation command is outputted to the wiping roll contact pressure adjusting motor driver 147.

Then, in Step P170, the count value is loaded from the present position detecting counter 160 for the wiping roll contact pressure adjusting motor, and stored into the memory M206. Then, in Step P171, the present position of the wiping roll contact pressure adjusting motor 30 is computed from the count value of the present position detecting counter 160 for the wiping roll contact pressure adjusting motor, and stored into the memory M207.

Then, in Step P172, the present position of the wiping roll contact pressure adjusting motor 30 is displayed on the present position display unit 157 for the wiping roll contact pressure adjusting motor. Then, in Step P172*a*, the electric current value is loaded from the wiping roll drive motor driver 144, and stored into the memory M209 for storing the present electric current value of the wiping roll drive motor. Then, in Step P172*b*, the present electric current value of the wiping roll drive motor 40 is displayed on the present electric value display unit 156 for the wiping roll drive motor. Then, in Step P173, the count value of the present position detecting counter 160 for the wiping roll contact pressure adjusting motor is loaded from the memory M206.

Then, in Step P174, the desired count value of the present position detecting counter for the wiping roll contact pressure adjusting motor is loaded from the memory M216. Then, in Step P175, it is determined whether the count value of the present position detecting counter for the wiping roll contact pressure adjusting motor is equal to the desired count value of the present position detecting counter for the wiping roll contact pressure adjusting motor.

If the answer is Y in the above Step P175, outputting of the forward rotation command to the wiping roll contact pressure adjusting motor driver 147 is stopped in Step P176. Then, the program returns to Step P139. If the answer is N in Step P175, the program returns to Step P170.

In accordance with the above-described action flow, the wiping roll contact pressure adjusting motor 30 is drivingly controlled so that the wiping roll 20 is thrown on the intaglio cylinder 17 always at optimum contact pressure in accordance with the printing conditions during the steady-state operation of the intaglio printing press.

In the present embodiment, as described above, when printing is done again using the same type of ink or the same type of image, the contact pressure of the wiping roll 20 which has been prestored in conformity therewith is loaded and set. Thus, the burden imposed on the operator when making preparations for printing is lessened, and a waste of printing materials such as paper and ink is reduced.

Furthermore, the contact pressure (load) of the wiping roll 20 on the intaglio cylinder 17 is converted into the torque value (electric current value) of the wiping roll drive motor 40. When this torque value exceeds the preset tolerance, the wiping roll contact pressure adjusting motor 30 is driven by a constant amount. Thus, the above contact pressure can be adjusted always with high accuracy, without influence from mechanical oscillations (disturbance such as noise).

In the present embodiment, moreover, the speed reducer 46 comprising the worm gear mechanism is interposed in the drive system between the wiping roll drive motor 40 and the wiping roll 20. Thus, mechanical oscillations (load variations) can be absorbed by the backlash within the speed reducer 46. The worm gear mechanism, in particular, minimally transmits mechanical oscillations (load variations) from the wiping roll side to the wiping roll drive motor side. Hence, the advantage is obtained that only long-term load variations can be effectively detected even more stably.

It goes without saying that the present invention is not limited to the above embodiments, and various changes and modifications may be made without departing from the gist of the present invention. Moreover, the present invention can also be applied to the adjustment of contact pressure between an ink fountain roll which is independently driven and a pattern roll whose position adjustment can be made.

INDUSTRIAL APPLICABILITY

The present invention can be applied to a contact pressure adjusting method and a contact pressure adjusting apparatus for a printing press such as an intaglio printing press.

REFERENCE SIGNS LIST

10 Feeder
11 Intaglio printing unit
14 Wiping device
17 Intaglio cylinder
20 Wiping roll
23 Wiping roll throw-on and throw-off hydraulic cylinder
30 Wiping roll contact pressure adjusting motor
40 Wiping roll drive motor
46 Speed reducer
50A, 50B Drive control device for wiping roll drive motor and wiping roll contact pressure adjusting motor
125 Ink type setting unit
126 Type setting unit for material to be printed
127 Image type setting unit
128 Material setting unit for wiping roll
129 Printing rotational speed setting unit
130 Rotational speed ratio setting unit for wiping roll
144 Wiping roll drive motor driver
146 Rotary encoder for wiping roll drive motor
147 Wiping roll contact pressure adjusting motor driver
150 Contact pressure increasing switch
151 Contact pressure decreasing switch
152 Wiping roll contact pressure adjustment completion switch
153 Reprinting switch
154 New printing switch
155 Printing preparation start switch
156 Present electric current value display unit for wiping roll drive motor
157 Present position display unit for wiping roll contact pressure adjusting motor
158 Drive device for LED for displaying contact pressure adjustment preparation completion for wiping roll
159 LED for displaying contact pressure adjustment preparation completion for wiping roll
161 Rotary encoder for wiping roll contact pressure adjusting motor
250 Tolerance setting unit for difference in electric current value of wiping roll drive motor
251 Contact pressure adjustment amount setting unit for wiping roll

The invention claimed is:

1. A contact pressure adjusting method for a printing press, the printing press including, a first rotating body, a second rotating body opposed to and making contact with the first rotating body, a second rotating body drive motor for rotationally driving the second rotating body, a contact pressure adjusting mechanism for adjusting a contact pressure of the second rotating body on the first rotating body, and a contact pressure adjusting motor for driving the contact pressure adjusting mechanism, the contact pressure adjusting method comprising:

detecting an electric current value of a motor driver of the second rotating body drive motor, and driving the contact pressure adjusting motor in response to the detected electric current value, wherein the first rotating body is an intaglio cylinder having an intaglio supported thereon, the second rotating body is a wiping roll opposed to and making contact with the intaglio and supported rotatably, the second rotating body drive motor is a wiping roll drive motor for rotationally driving the wiping roll, and the contact pressure adjusting mechanism adjusts a contact pressure of the wiping roll on the intaglio, the contact pressure adjusting method further comprising setting the type of a material to be printed, the type of ink, the type of an image, and a material for the wiping roll as printing conditions, determining a reference electric current value of the wiping roll driving motor in accordance with the set type of the material to be printed, type of ink, type of the image, and material for the wiping roll, and during printing, driving the contact pressure adjusting motor so that an electric current value of the wiping roll drive motor equals the reference electric current value.

2. The contact pressure adjusting method for a printing press according to claim 1, wherein the printing press further includes, first storage means for storing a reference electric current value for driving the second rotating body drive motor, second storage means for storing an electric current value for driving the second rotating body drive motor, third storage means for storing tolerance for the electric current value for driving the second rotating body drive motor, and fourth storage means for storing a drive amount for driving the contact pressure adjusting motor, and the method further comprising:

driving the contact pressure adjusting motor in response to the drive amount stored in the fourth storage means when a difference between the reference electric current value stored in the first storage means and the electric current value stored in the second storage means exceeds the tolerance for the electric current value stored in the third storage means.

3. The contact pressure adjusting method for a printing press according to claim 2, further comprising:

interposing a speed reducer in a drive system between the second rotating body drive motor and the second rotating body.

4. The contact pressure adjusting method for a printing press according to claim 2, the contact pressure adjusting method further comprising:

providing a setting unit for setting a printing specification; and storing a position of the contact pressure adjusting motor together with the printing specification set by the setting unit, wherein when a printing specification identical with the printing specification is then set by the setting unit, loading the position of the contact pressure adjusting motor stored together with the set printing specification, and controlling the contact pressure adjusting motor so as to be located at the loaded position.

5. The contact pressure adjusting method for a printing press according to claim 1, further comprising:

interposing a speed reducer in a drive system between the second rotating body drive motor and the second rotating body.

6. The contact pressure adjusting method for a printing press according to claim 1, the contact pressure adjusting method further comprising:

providing a setting unit for setting a printing specification; and storing a position of the contact pressure adjusting motor together with the printing specification set by the setting unit, wherein when a printing specification identical with the printing specification is then set by the setting unit, loading the position of the contact pressure adjusting motor stored together with the set printing specification, and controlling the contact pressure adjusting motor so as to be located at the loaded position.

7. The contact pressure adjusting method for a printing press according to claim 1, the contact pressure adjusting method further comprising:

detecting a surface temperature of the wiping roll;

correcting a reference electric current value of the wiping roll drive motor in accordance with the detected surface temperature of the wiping roll; and driving the contact pressure adjusting motor so that an electric current value of the wiping roll drive motor equals the corrected reference electric current value.

8. A contact pressure adjusting apparatus for a printing press, the printing press including, a first rotating body, a second rotating body opposed to and making contact with the first rotating body, a second rotating body drive motor for rotationally driving the second rotating body, a contact pressure adjusting mechanism for adjusting a contact pressure of the second rotating body on the first rotating body, and a contact pressure adjusting motor for driving the contact pressure adjusting mechanism, the contact pressure adjusting apparatus comprising:

a control device for detecting an electric current value of a motor driver of the second rotating body drive motor, and driving the contact pressure adjusting motor in response to the detected electric current value, wherein the first rotating body is an intaglio cylinder having an intaglio supported thereon, the second rotating body is a wiping roll opposed to and making contact with the intaglio and supported rotatably, the second rotating body drive motor is a wiping roll drive motor for rotationally driving the wiping roll, and the contact pressure adjusting mechanism adjusts a contact pressure of the wiping roll on the intaglio, the contact pressure adjusting apparatus further comprising a setting unit for setting the type of a material to be printed, the type of ink, the type of an image, and a material for the wiping roll as printing conditions, and the control device determines a reference electric current value of the wiping roll drive motor in accordance with the type of the material to be printed, type of ink, type of the image, and material for the wiping roll set by the setting unit and, during printing, drivingly controls the contact pressure adjusting motor so that an electric current value of the wiping roll drive motor equals the reference electric current value.

9. The contact pressure adjusting apparatus for a printing press according to claim 8, further comprising:

first storage means for storing a reference electric current value for driving the second rotating body drive motor;

second storage means for storing an electric current value for driving the second rotating body drive motor;

third storage means for storing tolerance for the electric current value for driving the second rotating body drive motor; and fourth storage means for storing a drive amount for driving the contact pressure adjusting motor, wherein the control device drives the contact pressure adjusting motor by the drive amount stored in the fourth storage means when a difference between the reference electric current value stored in the first storage means and the electric current value stored in the second storage means exceeds the tolerance for the electric current value stored in the third storage means.

10. The contact pressure adjusting apparatus for a printing press according to claim 9, wherein a speed reducer is interposed in a drive system between the second rotating body drive motor and the second rotating body.

11. The contact pressure adjusting apparatus for a printing press according to claim 9, the contact pressure adjusting apparatus further comprising:

a setting unit for setting a printing specification, wherein the control device stores a position of the contact pressure adjusting motor together with the printing specification set by the setting unit and, when a printing specification identical with the printing specification is then set by the setting unit, loads the position of the contact pressure adjusting motor stored together with the set printing specification, and controls the contact pressure adjusting motor so as to be located at the loaded position.

12. The contact pressure adjusting apparatus for a printing press according to claim 8, wherein a speed reducer is interposed in a drive system between the second rotating body drive motor and the second rotating body.

13. The contact pressure adjusting apparatus for a printing press according to claim 8, the contact pressure adjusting apparatus further comprising:

a setting unit for setting a printing specification, wherein the control device stores a position of the contact pressure adjusting motor together with the printing specification set by the setting unit and, when a printing specification identical with the printing specification is then set by the setting unit, loads the position of the contact pressure adjusting motor stored together with the set printing specification, and controls the contact pressure adjusting motor so as to be located at the loaded position.

14. The contact pressure adjusting apparatus for a printing press according to claim 8, the contact pressure adjusting apparatus further comprising detection means for detecting a surface temperature of the wiping roll, and the control device corrects a reference electric current value of the wiping roll drive motor in accordance with the surface temperature of the wiping roll detected by the detection means and drivingly controls the contact pressure adjusting motor so that an electric current value of the wiping roll drive motor equals the corrected reference electric current value.

* * * * *